US012543822B2

(12) United States Patent
Bonin et al.

(10) Patent No.: US 12,543,822 B2
(45) Date of Patent: Feb. 10, 2026

(54) ARTICLE OF FOOTWEAR HAVING A SOLE PLATE

(71) Applicant: PUMA SE, Herzogenaurach (DE)

(72) Inventors: Mauro Bonin, Nuremberg (DE); Andreas Siegismund, Rückersdorf (DE); Arnaud Redon, Nuremberg (DE)

(73) Assignee: PUMA SE, Herzogenaurach (DE)

( * ) Notice: Subject to any disclaimer, the term of this patent is extended or adjusted under 35 U.S.C. 154(b) by 0 days.

(21) Appl. No.: 18/101,958

(22) Filed: Jan. 26, 2023

(65) Prior Publication Data

US 2023/0180888 A1 Jun. 15, 2023

Related U.S. Application Data

(63) Continuation of application No. 17/218,353, filed on Mar. 31, 2021, now Pat. No. 12,225,968.

(60) Provisional application No. 63/139,447, filed on Jan. 20, 2021.

(51) Int. Cl.
*A43B 13/18* (2006.01)
*A43B 13/26* (2006.01)

(52) U.S. Cl.
CPC ..... *A43B 13/186* (2013.01); *A43B 13/183* (2013.01); *A43B 13/188* (2013.01); *A43B 13/26* (2013.01)

(58) Field of Classification Search
CPC ... A43B 13/186; A43B 13/188; A43B 13/183; A43B 13/26; A43B 13/122; A43B 5/06; A43B 13/184; A43B 13/223; A43C 13/04; A43C 15/02; A43C 15/16; A43C 15/161
See application file for complete search history.

(56) References Cited

U.S. PATENT DOCUMENTS

| | | | | |
|---|---|---|---|---|
| 324,065 A | | 8/1885 | Andrews | |
| 413,693 A | | 10/1889 | Walker | |
| 634,588 A | | 10/1899 | Roche | |
| 1,088,328 A | * | 2/1914 | Cucinotta | A43B 13/182 D2/947 |
| 2,245,706 A | | 6/1941 | Nutt | |
| 4,020,569 A | | 5/1977 | Fukuoka | |
| 4,241,523 A | | 12/1980 | Daswick | |

(Continued)

FOREIGN PATENT DOCUMENTS

| | | |
|---|---|---|
| CN | 2904704 Y | 5/2007 |
| CN | 204132549 U | 2/2015 |

(Continued)

OTHER PUBLICATIONS

International Search Report of International Application No. PCT/IB2021/062487, mailed Mar. 30, 2022, 7 pages.

(Continued)

*Primary Examiner* — Haley A Smith
(74) *Attorney, Agent, or Firm* — Quarles & Brady LLP

(57) ABSTRACT

An article of footwear comprising a sole structure and an upper. The sole structure includes an outsole that defines a ground engaging surface in at least a forefoot region of the sole structure, and the outsole includes at least one first ground engaging element that extends away from the ground engaging surface. The sole structure further includes a cushioning member that extends between the outsole and the upper, and the cushioning member is a supercritical foam with pockets of gas therein.

18 Claims, 40 Drawing Sheets

(56) References Cited

U.S. PATENT DOCUMENTS 4,348,821 A 9/1982 Daswick
4,463,505 A 8/1984 Duclos
4,492,046 A 1/1985 Kosova
4,510,700 A 4/1985 Brown
4,542,598 A 9/1985 Misevich et al.
4,837,949 A 6/1989 Dufour
4,910,884 A 3/1990 Lindh et al.
5,024,007 A 6/1991 DuFour
5,052,130 A 10/1991 Barry et al.
5,138,776 A 8/1992 Levin
5,179,791 A 1/1993 Lain
5,191,727 A 3/1993 Barry et al.
5,203,095 A 4/1993 Allen
5,339,544 A 8/1994 Caberlotto
5,353,523 A 10/1994 Kilgore et al.
5,435,079 A 7/1995 Gallegos
5,461,800 A 10/1995 Luthi et al.
5,528,842 A 6/1996 Ricci et al.
5,592,757 A 1/1997 Jackinsky
5,706,589 A 1/1998 Marc
5,806,209 A 9/1998 Crowley et al.
5,875,567 A 3/1999 Bayley
6,029,374 A 2/2000 Herr et al.
6,502,330 B1 1/2003 David et al.
6,505,421 B1 1/2003 Vaz
6,625,905 B2 9/2003 Kita
6,775,930 B2 8/2004 Fuerst
6,826,852 B2 12/2004 Fusco
6,857,205 B1 2/2005 Fusco et al.
6,944,972 B2 9/2005 Schmid
7,013,582 B2 3/2006 Lucas et al.
7,016,867 B2 3/2006 Lyden
7,096,605 B1 8/2006 Kozo et al.
7,100,308 B2 9/2006 Aveni
7,100,309 B2 9/2006 Smith et al.
7,107,235 B2 9/2006 Lyden
7,152,343 B2 12/2006 Whatley
7,219,447 B2 5/2007 LeVert
7,350,320 B2 4/2008 Chandler et al.
7,401,419 B2 7/2008 Lucas et al.
7,401,422 B1 7/2008 Scholz et al.
7,434,337 B2 10/2008 Gibert et al.
7,437,835 B2 10/2008 Marvin et al.
7,484,317 B2 2/2009 Kita et al.
7,513,065 B2 4/2009 Kita et al.
7,536,808 B2 5/2009 Myers et al.
7,624,515 B2 12/2009 Kita et al.
7,644,518 B2 1/2010 Chandler et al.
7,707,743 B2 5/2010 Schindler et al.
7,786,193 B2 8/2010 Wilding et al.
7,832,117 B2 11/2010 Auger et al.
7,886,461 B2 2/2011 Sato
7,900,376 B2 3/2011 Rabushka
7,946,059 B2 5/2011 Borel
7,950,091 B2 5/2011 Auger et al.
7,984,569 B2 7/2011 Chaney et al.
7,987,618 B2 8/2011 Nishiwaki et al.
8,028,442 B2 10/2011 Hodgson
8,074,377 B2 12/2011 Nishiwaki et al.
8,079,160 B2 12/2011 Baucom et al.
8,112,909 B2 2/2012 Kubo et al.
8,122,615 B2 2/2012 Lucas et al.
8,186,079 B2 5/2012 Carboy et al.
8,341,856 B2 1/2013 Smith et al.
8,393,028 B2 3/2013 Namkook et al.
8,418,379 B2 4/2013 Nishiwaki et al.
8,479,417 B2 7/2013 Flannery et al.
D688,037 S 8/2013 Dekovic
8,567,094 B2 10/2013 Lubart
8,613,149 B2 12/2013 Schwirian
8,615,901 B2 12/2013 Caine et al.
8,635,785 B2 1/2014 Seo
8,732,984 B2 5/2014 Ha
D707,428 S 6/2014 Seamarks
8,752,307 B2 6/2014 Cooper et al.
8,776,397 B2 7/2014 Borel et al.
8,850,718 B2 10/2014 Lubart
8,919,015 B2 12/2014 Holt et al.
8,945,449 B2 2/2015 Atwal et al.
8,978,274 B2 3/2015 Auger et al.
8,984,775 B2 3/2015 Dombrow et al.
9,009,988 B2 4/2015 Jacobs et al.
9,015,962 B2 4/2015 Boudreau et al.
9,066,559 B2 6/2015 Butler
9,144,265 B2 9/2015 Lubart
9,167,864 B1 10/2015 Piontkowski et al.
9,179,733 B2 11/2015 Peyton et al.
9,204,686 B2 12/2015 Baum et al.
9,210,967 B2 12/2015 Gerber
9,241,533 B2 1/2016 Heard et al.
9,259,050 B2 2/2016 Smith et al.
9,326,562 B2 5/2016 Weidl et al.
9,339,079 B2 5/2016 Lucas et al.
9,375,048 B2 6/2016 James et al.
9,491,983 B2 11/2016 Rushbrook
9,516,916 B2 12/2016 Derrier
9,549,589 B2 1/2017 Auger et al.
9,572,394 B2 2/2017 Heard et al.
9,572,398 B2 2/2017 Hurd et al.
9,615,625 B1 4/2017 Huard et al.
9,661,896 B2 5/2017 Elliott et al.
9,668,540 B2 6/2017 Scofield et al.
9,750,306 B2 9/2017 Baum et al.
9,775,404 B2 10/2017 Lyden
9,820,528 B2 11/2017 Reinhardt et al.
9,820,529 B2 11/2017 Droege et al.
9,883,714 B2 2/2018 Cavaliere et al.
9,894,958 B2 2/2018 Cheney et al.
9,930,934 B2 4/2018 Cook et al.
9,961,959 B2 5/2018 Gerber
9,968,157 B2 5/2018 Wardlaw et al.
9,968,160 B2 5/2018 Peyton
10,010,135 B2 7/2018 Lovell et al.
10,010,137 B2 7/2018 Foxen
10,016,919 B2 7/2018 Cook et al.
10,081,716 B2 9/2018 Chang et al.
10,111,491 B2 10/2018 Tanabe et al.
10,130,140 B2 11/2018 Dyer et al.
10,159,303 B2 12/2018 Wang et al.
10,165,821 B2 1/2019 Truelsen
10,165,824 B2 1/2019 Auger et al.
10,172,416 B2 1/2019 Hatfield et al.
10,226,097 B2 3/2019 Farris et al.
10,231,517 B2 3/2019 Baucom et al.
10,253,149 B2 4/2019 Watkins et al.
10,271,614 B2 4/2019 Huard et al.
10,299,535 B2 5/2019 Hurd et al.
10,314,365 B2 6/2019 James et al.
10,314,367 B2 6/2019 Kilgore et al.
10,314,369 B2 6/2019 Auger et al.
10,349,700 B2 7/2019 Amis et al.
10,433,616 B2 10/2019 Takeshita et al.
10,441,027 B2 10/2019 Bartel et al.
10,448,701 B2 10/2019 Farris et al.
10,448,704 B2 10/2019 Dupre et al.
10,477,919 B2 11/2019 Taylor et al.
10,485,294 B2 11/2019 Schneider
10,512,300 B2 12/2019 Rushbrook
10,512,301 B2 12/2019 Peyton
10,517,350 B2 12/2019 Orand et al.
10,517,351 B2 12/2019 Arciuolo
10,524,536 B2 1/2020 Bunnell et al.
10,548,368 B2 2/2020 Bartel et al.
10,555,580 B2 2/2020 Peyton
10,588,378 B2 3/2020 Groeneweg et al.
10,595,587 B2 3/2020 Cook et al.
10,609,984 B2 4/2020 Adeagbo et al.
10,653,205 B2 5/2020 Orand
10,743,606 B2 8/2020 Bartel et al.
10,743,607 B2 8/2020 Amis et al.
10,750,817 B2 8/2020 Barnes et al.
10,758,001 B2 9/2020 Case et al.
D913,663 S 3/2021 Essilfie-Taylor
D954,417 S 6/2022 Bidal

(56) References Cited

U.S. PATENT DOCUMENTS

| | | | | |
|---|---|---|---|---|
| D964,717 | S | 9/2022 | Mahoney | |
| D973,337 | S | 12/2022 | Lesecq | |
| 2002/0174567 | A1 | 11/2002 | Krafsur et al. | |
| 2003/0208929 | A1* | 11/2003 | Lucas | A43B 3/0063 36/28 |
| 2003/0233770 | A1 | 12/2003 | Foscaro | |
| 2004/0107601 | A1 | 6/2004 | Schmid | |
| 2004/0200097 | A1 | 10/2004 | Boyd | |
| 2005/0102858 | A1 | 5/2005 | Yen | |
| 2005/0126039 | A1 | 6/2005 | LeVert | |
| 2005/0155254 | A1* | 7/2005 | Smith | A43B 21/26 36/27 |
| 2005/0166422 | A1 | 8/2005 | Schaeffer et al. | |
| 2006/0196084 | A1 | 9/2006 | Kos | |
| 2007/0043630 | A1 | 2/2007 | Lyden | |
| 2007/0101617 | A1 | 5/2007 | Brewer et al. | |
| 2007/0266593 | A1 | 11/2007 | Schindler et al. | |
| 2007/0271818 | A1 | 11/2007 | Rabushka | |
| 2008/0189982 | A1 | 8/2008 | Krafsur | |
| 2009/0100718 | A1* | 4/2009 | Gerber | A43C 15/04 36/67 A |
| 2009/0183393 | A1 | 7/2009 | Lee | |
| 2009/0307925 | A1 | 12/2009 | Pfister | |
| 2010/0218397 | A1 | 9/2010 | Nishiwaki et al. | |
| 2010/0263228 | A1 | 10/2010 | Kang | |
| 2012/0317835 | A1 | 12/2012 | Raysse et al. | |
| 2013/0192090 | A1 | 8/2013 | Smith | |
| 2014/0068966 | A1 | 3/2014 | Chaffin | |
| 2014/0230280 | A1 | 8/2014 | Heard et al. | |
| 2014/0230283 | A1 | 8/2014 | Cordova | |
| 2014/0237852 | A1 | 8/2014 | Oberschneider et al. | |
| 2014/0245640 | A1 | 9/2014 | Heard et al. | |
| 2015/0047224 | A1 | 2/2015 | Zhao et al. | |
| 2015/0107132 | A1 | 4/2015 | Takeshita | |
| 2016/0262492 | A1 | 9/2016 | Fujita | |
| 2017/0079376 | A1 | 3/2017 | Bunnell et al. | |
| 2017/0105477 | A1 | 4/2017 | Wilkerson | |
| 2017/0150779 | A1* | 6/2017 | Walker | A43B 3/34 |
| 2017/0150780 | A1* | 6/2017 | Walker | B29C 65/04 |
| 2017/0196307 | A1 | 7/2017 | Keating et al. | |
| 2017/0245590 | A1 | 8/2017 | Kohatsu et al. | |
| 2018/0027922 | A1 | 2/2018 | Orand | |
| 2018/0035752 | A1 | 2/2018 | Walker et al. | |
| 2018/0042338 | A1 | 2/2018 | Orand | |
| 2018/0153254 | A1 | 6/2018 | Fusco et al. | |
| 2018/0163009 | A1 | 6/2018 | Baghdadi | |
| 2018/0168281 | A1 | 6/2018 | Case et al. | |
| 2018/0199666 | A1 | 7/2018 | Moriyasu et al. | |
| 2018/0199675 | A1 | 7/2018 | Cook et al. | |
| 2018/0213886 | A1 | 8/2018 | Connell et al. | |
| 2018/0235310 | A1 | 8/2018 | Wardlaw et al. | |
| 2018/0271215 | A1 | 9/2018 | Foxen | |
| 2018/0338568 | A1 | 11/2018 | Chambers et al. | |
| 2018/0352902 | A1* | 12/2018 | Wardle | A43B 13/181 |
| 2019/0082781 | A1 | 3/2019 | Iuchi et al. | |
| 2019/0150558 | A1 | 5/2019 | Shorten | |
| 2019/0150563 | A1 | 5/2019 | Shorten | |
| 2019/0159547 | A1 | 5/2019 | Nakatsuka | |
| 2019/0174873 | A1 | 6/2019 | Baucom et al. | |
| 2019/0223549 | A1 | 7/2019 | Howley et al. | |
| 2019/0246738 | A1* | 8/2019 | Connell | A43B 13/186 |
| 2019/0283355 | A1 | 9/2019 | Bartel et al. | |
| 2019/0289961 | A1 | 9/2019 | Uchi et al. | |
| 2019/0313733 | A1* | 10/2019 | Bartel | B29D 35/142 |
| 2019/0320759 | A1 | 10/2019 | Conrad et al. | |
| 2019/0351592 | A1 | 11/2019 | Falken | |
| 2019/0365030 | A1 | 12/2019 | Chambers et al. | |
| 2019/0365033 | A1 | 12/2019 | Chambers et al. | |
| 2019/0365034 | A1 | 12/2019 | Connell et al. | |
| 2019/0373982 | A1 | 12/2019 | Dupre et al. | |
| 2020/0008519 | A1 | 1/2020 | Farris et al. | |
| 2020/0046068 | A1 | 2/2020 | Choi et al. | |
| 2020/0100564 | A1 | 4/2020 | Bunnell et al. | |
| 2020/0121021 | A1 | 4/2020 | Bartel et al. | |
| 2020/0154819 | A1 | 5/2020 | Matthews et al. | |
| 2020/0281314 | A1* | 9/2020 | Stockbridge | B29D 35/128 |
| 2020/0281322 | A1 | 9/2020 | Caldwell et al. | |
| 2020/0307134 | A1 | 10/2020 | Yoshida | |
| 2020/0323307 | A1 | 10/2020 | Kim | |
| 2020/0383422 | A1* | 12/2020 | Bidal | A43B 13/41 |
| 2021/0015209 | A1 | 1/2021 | Buck | |
| 2021/0030112 | A1 | 2/2021 | Amoako et al. | |
| 2021/0052037 | A1 | 2/2021 | Greenspan | |
| 2022/0015505 | A1 | 1/2022 | Constantinou | |
| 2022/0053879 | A1 | 2/2022 | Redon et al. | |
| 2022/0225729 | A1 | 7/2022 | Bonin et al. | |

FOREIGN PATENT DOCUMENTS

| | | | |
|---|---|---|---|
| CN | 204467084 | U | 7/2015 |
| CN | 113966893 | A | 1/2022 |
| DE | 4015138 | A1 | 11/1991 |
| DE | 102012104264 | A1 | 11/2013 |
| DE | 102018122753 | A1 | 3/2019 |
| DE | 102019107402 | A1 | 9/2019 |
| EP | 1483981 | A1 | 12/2004 |
| EP | 1346655 | B1 | 8/2006 |
| EP | 1525284 | B1 | 6/2007 |
| EP | 2138063 | A1 | 12/2009 |
| EP | 2689681 | A1 | 1/2014 |
| EP | 2491807 | B1 | 10/2014 |
| EP | 1847193 | B1 | 1/2015 |
| EP | 1386553 | B1 | 6/2015 |
| EP | 2269478 | B1 | 9/2015 |
| EP | 1690460 | B1 | 8/2016 |
| EP | 1894484 | B1 | 3/2018 |
| EP | 2979567 | B1 | 10/2018 |
| EP | 3399882 | A1 | 11/2018 |
| EP | 2911542 | B1 | 12/2018 |
| EP | 3422893 | A1 | 1/2019 |
| EP | 3434132 | A1 | 1/2019 |
| EP | 3174419 | B1 | 7/2019 |
| EP | 3574791 | A1 | 12/2019 |
| EP | 2938218 | B1 | 3/2020 |
| EP | 3331393 | B1 | 4/2020 |
| EP | 3316721 | B1 | 5/2020 |
| EP | 3457882 | B1 | 6/2020 |
| EP | 3355738 | B1 | 8/2020 |
| EP | 3689171 | A1 | 8/2020 |
| EP | 3771358 | A1 | 2/2021 |
| FR | 2827126 | A1 | 1/2003 |
| FR | 2932963 | B1 | 8/2010 |
| FR | 2993758 | B1 | 3/2015 |
| GB | 2376408 | A | 12/2002 |
| JP | 2007089734 | A | 4/2007 |
| KR | 100844183 | B1 | 7/2008 |
| WO | 9842221 | A1 | 10/1998 |
| WO | 2000074515 | A1 | 12/2000 |
| WO | 2007113595 | A2 | 10/2007 |
| WO | 2008125716 | A1 | 10/2008 |
| WO | 2011020798 | A1 | 2/2011 |
| WO | 2013023163 | A1 | 2/2013 |
| WO | 2016094714 | A1 | 6/2016 |
| WO | 2017023532 | A1 | 2/2017 |
| WO | 2017120006 | A1 | 7/2017 |
| WO | 2017151501 | A1 | 9/2017 |
| WO | 2019157244 | A1 | 8/2019 |
| WO | 2021016163 | A1 | 1/2021 |

OTHER PUBLICATIONS

Written Opinion of International Application No. PCT/IB2021/062487, mailed Mar. 30, 2022, 7 pages.

[adidas Adizero], available on Amazon.com, Nov. 23, 2015 [online], [May 5, 2023], Available from the internet URL: https:// www.amazon.com/adidas-Adizero-Prime-Collegiate-White/dp/BO119E37WS/ref=cm_cr_arp_d_product_top?ie=UTFS (Year: 2015), 4 pages.

[Puma EvoSpeed Sprint 14], announced on YouTube on Jan. 5, 2023 [online], [site visited May 5, 2023], Available from the internet URL: PUMA evoSpeed Sprint 14 SKU: 9787857 (Year: 2023), 3 pages.

(56) References Cited

OTHER PUBLICATIONS

Puma Fast-R Nitro Elite, Retrieved Jan. 15, 2025 via website https://us.puma.com/us/en/pd/fast-r-nitro%E2%84%A2-elite-2-mens-running-shoes/310683?search=true&swatch=05.
Brooks Aurora BL, Retrieved Jan. 15, 2025 via website https://www.brooksrunning.com/en_dk/aurora-bl-mens-road-running-shoe/110367.html.
David Henry, "Brooks Neuro Review", published Jun. 6, 2016 ("Henry"), Retrieved Jan. 15, 2025 via website https://runblogger.com/2016/06/brooks-neuro-review.html.
Brooks Neuro, Retrieved Jan. 15, 2025 via website https://www.rei.com/product/123930/brooks-neuro-road-running-shoes-mens.
Puma evoSPEED Naio Nitro, Retrieved Jan. 15, 2025 via website https://about.puma.com/en/newsroom/news/puma-takes-its-forever-faster-spirit-world-athletics-championships-strong-athletes.
Puma evoSPEED Naio Nitro Elite, Retrieved Jan. 15, 2025 via website https://us.puma.com/us/en/pd/evospeed-long-distance-nitro-elite+-track-spikes/378222?srsltid=AfmBOooLiVhSLhpQbpee4y1-K8qgMsKxj1QFywd-zLfwoX0edlaiGeTI.
PUMA evoSPEED Naio Jump Nitro, Retrieved Jan. 15, 2025 via website https://www.deporvillage.net/puma-evospeed-long-jump-nitro-2-shoes-orange?country=US&srsltid=AfmBOoovnt9hqdvZiRJ7dYzXGh9B58GviBqmwMSMEZ7Hy9KkmLL-viLBrq0&gQT=2.
Puma Fast-FWD Nitro Elite, Retrieved Jan. 15, 2025 via website https://www.roadtrailrun.com/2023/04/puma-fast-fwd-nitro-elite-multi-tester.html.
Brooks Hyperion Elite MD, Retrieved Jan. 16, 2025 via website https://www.brooksrunning.com/en_us/featured/unisex-running-shoes/hyperion-elite-md/100048.html.
Brooks Hyperion Elite LD, Retrieved Jan. 16, 2025 via website https://www.brooksrunning.com/en_us/featured/unisex-running-shoes/hyperion-elite-ld/100047.html.
Bryan Byrne, "Adidas Predator 20.1 Mutator 'Low Cut' Review", published Sep. 26, 2020 ("Byrne"), Retrieved Jan. 16, 2025 via website https://www.soccercleats101.com/2020/09/26/adidas-predator-20-1-mutator-low-cut-review/.
Adidas Predator 20.1 Mutator, ("Adidas Predator"), Retrieved Jan. 16, 2025 via website https://www.ebay.com/itm/405388871735?chn=ps&mkevt=1&mkcid=28&google_free_listing_action=view_item&gQT=2.
Sam Grawe, "Nike: Better Is Temporary," published 2020 by Phaidon Press Limited ("Grawe"), Retrieved Jan. 16, 2025 via website https://www.phaidon.com/store/design/nike-better-is-temporary-9781838660512/.
Hunter York, "Hypervenom Phantom 3 Review", published Apr. 20, 2017 ("York"), Retrieved Jan. 16, 2025 via website https://www.soccerpro.com/theinstep/hypervenom-phantom-3-review/.
Christian Habermeier and Sebastian Jager, "The Adidas Archive," published 2020 by Taschen GmbH ("Adidas Archive"), Retrieved Jan. 16, 2025 via website https://www.taschen.com/en/books/fashion/40739/the-adidas-archive-the-footwear-collection-40th-ed.
Solereview Editors, "Nike Vaporfly 4% Flyknit Review", published Jun. 13, 2019 ("Vaporfly Review"), Retrieved Jan. 16, 2025 via website https://www.solereview.com/nike-vaporfly-4-flyknit-review/#expand.
Nike Vaporfly 4%, Retrieved Jan. 16, 2025 via website https://shop.redcoyoterunning.com/product/4497/nike/vaporfly-4-flyknit?gQT=2.
Hoka One One Carbon X ("Hoka Carbon X"), Retrieved Jan. 16, 2025 via website https://www.hoka.com/en/us/carbon-x/192410627981.html.
Dan Roe, "The Carbon X Is a Stiff, Quick Hoka", published May 16, 2019 ("Roe"), Retrieved Jan. 16, 2025 via website https://www.runnersworld.com/gear/a27495253/hoka-one-one-carbon-x/.
Brooks Hyperion Elite 2, Retrieved Jan. 16, 2025 via website https://www.brooksrunning.com/en_us/featured/unisex-running-shoes/hyperion-elite-2/1000371D111.050.html.
Brooks Hyperion Elite 4, Retrieved Jan. 16, 2025 via website https://www.brooksrunning.com/en_us/featured/unisex-running-shoes/hyperion-elite-4/100046.html.
Hoka Bondi X, Retrieved Jan. 16, 2025 via website https://us.shop.runningroom.com/en_us/hoka-men-s-bondi-x-d-width-running-shoe.html? srsltid=AfmBOor6unVUTyOnfmj7iHwt5LbnzX2v_2R1_WeGNszeCMB5B_rWDHV5Ap4&gQT=2.
Nike Zoomx Vaporfly Next% 2 ("Nike Zoomx"), Retrieved Jan. 16, 2025 via website https://www.nike.com/t/zoomx-vaporfly-next-2-by-you-mens-road-racing-shoes-LJwJjl.
Paul Ronto, "Nike ZoomX Vaporfly NEXT% 2", published Mar. 13, 2021 ("Ronto"). Retrieved Jan. 16, 2025 via website https://runrepeat.com/nike-zoom-x-vaporfly-next-2.
Nike Air Zoom Alphafly NEXT% ("Nike Alphafly"), Retrieved Jan. 16, 2025 via website https://www.nike.com/t/alphafly-3-womens-road-racing-shoes-LQX5b4/FD8315-700.
Michael Le, "Nike's Elite Roster Of 2020 Runners Are On The Cusp Of A World Record Breaking Run", published Feb. 5, 2020 ("Le"), Retrieved Jan. 16, 2025 via website https://sneakernews.com/2020/02/05/nike-elite-running-shoes-2020-release-info/).
Ruggero Loda, "New Generation of Nike Next%—Now it's 3 different Shoes plus a Track Spike", published Feb. 6, 2020 ("Loda"), Retrieved Jan. 16, 2025 via website https://www.runningshoesguru.com/2020/02/new-generation-of-nike-next-now-its-3-different-shoes-plus-a-track-spike/.
Jane Mcquire, "Nike reveal Air Zoom Alphafly Next%, which will be legal for Tokyo 2020", published Feb. 6, 2020 ("Mcquire"), Retrieved Jan. 16, 2025 via website https://runnersworldonline.com.au/nike-reveal-air-zoom-alphafly-tokyo-2020-legal-which-will-be-next-for/.
Jarrod Castillo, "Check Out This Pretty Clean Colorway of the Nike Air Max 270 SE", published Jun. 7, 2019 ("Castillo"), Retrieved Jan. 16, 2025 via website https://weartesters.com/nike-air-max-270-se/.

* cited by examiner

ARTICLE OF FOOTWEAR HAVING A SOLE PLATE

CROSS REFERENCE TO RELATED APPLICATIONS

This application is a continuation of U.S. patent application Ser. No. 17/218,353, filed on Mar. 31, 2021, which claims priority to U.S. Provisional Application Ser. No. 63/139,447, filed on Jan. 20, 2021, the contents of which is incorporated by reference herein in its entirety and is to be considered a part of this application.

REFERENCE REGARDING FEDERALLY SPONSORED RESEARCH OR DEVELOPMENT

Not applicable

SEQUENCE LISTING

Not applicable

BACKGROUND

1. Field of the Invention

The present disclosure relates generally to an article of footwear including a sole plate.

2. Description of the Background

Many conventional shoes or other articles of footwear generally comprise an upper and a sole attached to a lower end of the upper. Conventional shoes further include an internal space, i.e., a void or cavity, which is created by interior surfaces of the upper and sole, that receives a foot of a user before securing the shoe to the foot. The sole is attached to a lower surface or boundary of the upper and is positioned between the upper and the ground. As a result, the sole typically provides stability and cushioning to the user when the shoe is being worn. In some instances, the sole may include multiple components, such as an outsole, a midsole, and a top portion. The outsole may provide traction to a bottom surface of the sole, and the midsole may be attached to an inner surface of the outsole, and may provide cushioning or added stability to the sole. For example, a sole may include a particular foam material that may increase stability at one or more desired locations along the sole, or a foam material that may reduce stress or impact energy on the foot or leg when a user is running, walking, or engaged in another activity. The sole may also include additional components, such as plates, embedded with the sole to increase the overall stiffness of the sole and reduce energy loss during use.

The upper generally extends upward from the sole and defines an interior cavity that completely or partially encases a foot. In most cases, the upper extends over the instep and toe regions of the foot, and across medial and lateral sides thereof. Many articles of footwear may also include a tongue that extends across the instep region to bridge a gap between edges of medial and lateral sides of the upper, which define an opening into the cavity. The tongue may also be disposed below a lacing system and between medial and lateral sides of the upper, to allow for adjustment of shoe tightness. The tongue may further be manipulatable by a user to permit entry or exit of a foot from the internal space or cavity. In addition, the lacing system may allow a user to adjust certain dimensions of the upper or the sole, thereby allowing the upper to accommodate a wide variety of foot types having varying sizes and shapes.

The upper of many shoes may comprise a wide variety of materials, which may be utilized to form the upper and chosen for use based on one or more intended uses of the shoe. The upper may also include portions comprising varying materials specific to a particular area of the upper. For example, added stability may be desirable at a front of the upper or adjacent a heel region so as to provide a higher degree of resistance or rigidity. In contrast, other portions of a shoe may include a soft woven textile to provide an area with stretch-resistance, flexibility, air-permeability, or moisture-wicking properties.

However, in many cases, articles of footwear having uppers with an increased comfort and better fit are desired, along with soles having improved cushioning systems or structural characteristics such as a sole plate to add rigidity or spring-like properties.

SUMMARY

An article of footwear, as described herein, may have various configurations. The article of footwear may have an upper and a sole structure connected to the upper.

According to one aspect of the disclosure, an article of footwear can include a sole structure and an upper. The sole structure can include an outsole that can define a ground engaging surface in at least a forefoot region of the sole structure. The outsole can include at least one first ground engaging element extending away from the ground engaging surface. In addition, the sole structure can include a cushioning member that can extend between the outsole and the upper. The cushioning member can be a supercritical foam with pockets of gas therein.

In some embodiments, the outsole can be configured as a rigid plate that can extend between a lateral side and a medial side of the sole structure in the forefoot region. In some cases, the outsole can include a first portion in the forefoot region of the sole structure, a second portion in a midfoot region of the sole structure, and a third portion in a heel region of the sole structure. At least one of the first portion can extend across the forefoot region from a lateral side of the sole structure to a medial side of the sole structure, the second portion can extend partially across the sole structure from the lateral side to the medial side, or the third portion can extend partially across the sole structure from the lateral side to the medial side. In some cases, the third portion of the outsole can further include a plurality of second ground engaging elements extending away from the ground engaging surface in the heel region of the outsole. The cushioning member can extend between the third portion of the outsole and the upper.

In some embodiments, the at least one first ground engaging element can be one of a first plurality of first ground engaging elements. The first plurality of first ground engaging elements can be arranged along one of a medial side or a lateral side of the outsole. In some cases, a second plurality of first ground engaging elements can be arranged along the other of the medial side of the lateral side of the outsole. In some cases, a plurality of second ground engaging elements can extend away from the ground engaging surface. The plurality of second ground engaging elements can be arranged along a respective medial or lateral edge of the outsole so that the plurality of second ground engaging elements is disposed closer to the respective medial or lateral edge than is the first plurality of first ground engaging elements. Each of the plurality of second ground engaging elements can be shaped differently from ground engaging elements of the first and second pluralities of ground engaging elements. More specifically, each of the first ground engaging elements can be configured as a spike with a conical tip and each of the second ground engaging members can be configured as a barb with a triangular pyramidal shape.

In some embodiments, the supercritical fluid can be nitrogen. The supercritical foam can be formed by pressurizing a mixture of the supercritical fluid and a molten material of the cushioning member and then releasing the pressure to convert the supercritical fluid to a gas, which causes the material to expand and foam, thereby forming the pockets of nitrogen gas therein.

According to another aspect of the disclosure, an article of footwear can include a sole structure and an upper. The sole structure can include an outsole that can define a ground engaging surface. The outsole can include a lateral outsole portion with a first plurality of ground engaging elements extending away from the ground engaging surface and a medial outsole portion with a second plurality of ground engaging elements extending away from the ground engaging surface. Additionally, a cushioning member can be disposed between the outsole and the upper. The cushioning member can be a supercritical foam with pockets of gas therein.

In some cases, the sole structure can further include a top portion disposed between the cushioning member and the upper. The top portion can extend through a forefoot region, a midfoot region, and a heel region of the sole structure.

In some embodiments, each of the first plurality of ground engaging elements and the second plurality of ground engaging elements can be arranged in longitudinal rows extending generally in a heel-to-toe direction in a forefoot region. In some cases, the outsole can further include a third plurality of ground engaging-elements extending from the ground engaging surface and positioned along a lateral edge of the lateral outsole portion and a fourth plurality of ground engaging elements extending from the ground engaging surface and positioned along a medial edge of the medial outsole portion. Additionally, the outsole can further include a middle outsole portion extending between the lateral outsole portion and the medial outsole portion. The middle outsole portion including a fifth plurality of ground engaging elements.

In some embodiments, the supercritical fluid can be nitrogen. The supercritical foam can be formed by pressurizing a mixture of the supercritical fluid and a molten material of the cushioning member and then releasing the pressure to convert the supercritical fluid to a gas, which causes the material to expand and foam, thereby forming the pockets of nitrogen gas therein.

According to yet another aspect of the disclosure, an article of footwear can include a sole structure and an upper. The sole structure can include an outsole defining a ground engaging surface. The outsole can include a plurality of first ground engaging elements. The plurality of first ground engaging elements can include a first group of first ground engaging elements positioned on a lateral half of the outsole in the forefoot region and a second group of first ground engaging elements positioned on a lateral half of the outsole in the forefoot region. Additionally, the outsole can include a plurality of second ground engaging elements spaced around a periphery of the outsole in the forefoot region. Further, a cushioning member can be disposed between the outsole and the upper. The cushioning member can be a supercritical foam with pockets of gas therein.

In some embodiments, the outsole can extend through a midfoot region of the sole structure and into a heel region of the sole structure. The outsole can include a plurality of longitudinal ribs in the midfoot region.

In some embodiments, the plurality of second ground engaging elements can include at least two groups of second ground engaging elements. In some cases, each of the plurality of first ground engaging elements can be configured as a spike with a conical tip and each of the plurality of second ground engaging members can be configured as a barb with a triangular pyramidal shape. At least one of the plurality of second ground engaging members can be angled toward a heel end of the article sole structure.

In some embodiments, the supercritical fluid can be nitrogen. The supercritical foam can be formed by pressurizing a mixture of the supercritical fluid and a molten material of the cushioning member and then releasing the pressure to convert the supercritical fluid to a gas, which causes the material to expand and foam, thereby forming the pockets of nitrogen gas therein.

Other aspects of the article of footwear, including features and advantages thereof, will become apparent to one of ordinary skill in the art upon examination of the figures and detailed description herein. Therefore, all such aspects of the article of footwear are intended to be included in the detailed description and this summary.

DETAILED DESCRIPTION OF THE DRAWINGS

Figure 1:
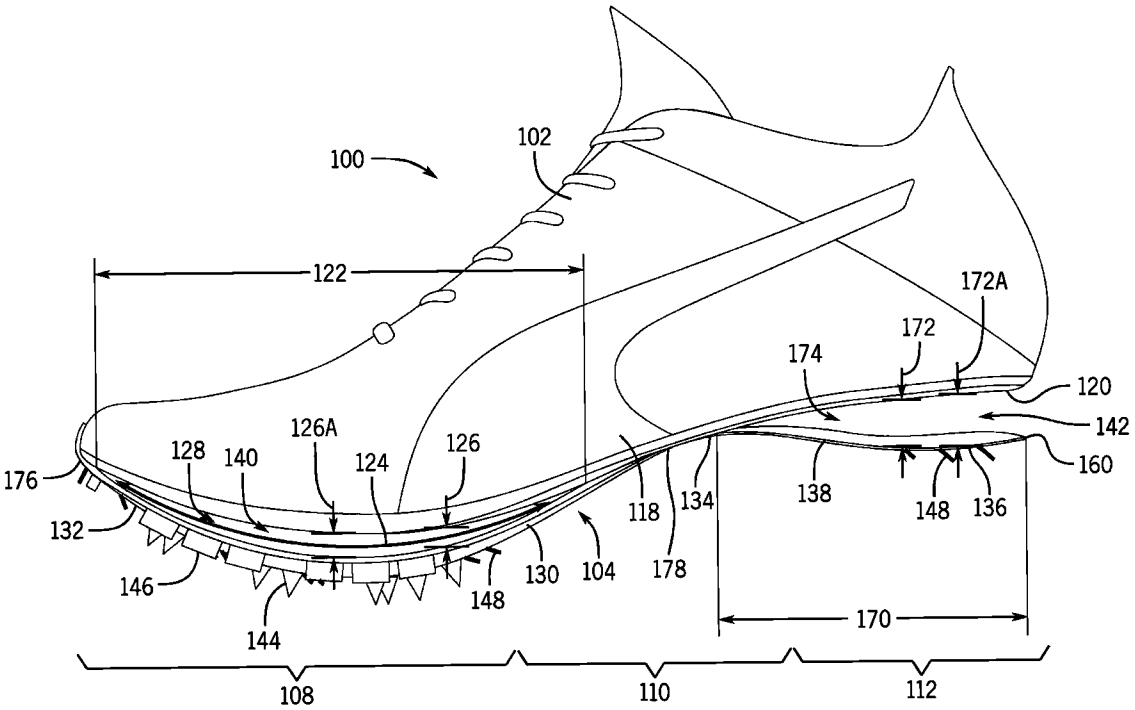
FIG. 1 is a lateral side view of an article of footwear configured as a left shoe that includes an upper and a sole structure, according to an embodiment of the disclosure.

The following discussion and accompanying figures disclose various embodiments or configurations of a shoe and a sole structure. Although embodiments of a shoe or sole structure are disclosed with reference to a sports shoe, such as a running shoe, tennis shoe, basketball shoe, etc., concepts associated with embodiments of the shoe or the sole structure may be applied to a wide range of footwear and footwear styles, including cross-training shoes, football shoes, golf shoes, hiking shoes, hiking boots, ski and snowboard boots, soccer shoes and cleats, walking shoes, and track cleats, for example. Concepts of the shoe or the sole structure may also be applied to articles of footwear that are considered non-athletic, including dress shoes, sandals, loafers, slippers, and heels. In addition to footwear, particular concepts described herein may also be applied and incorporated in other types of apparel or other athletic equipment, including helmets, padding or protective pads, shin guards, and gloves. Even further, particular concepts described herein may be incorporated in cushions, backpack straps, golf clubs, or other consumer or industrial products. Accordingly, concepts described herein may be utilized in a variety of products.

The term "about," as used herein, refers to variation in the numerical quantity that may occur, for example, through typical measuring and manufacturing procedures used for articles of footwear or other articles of manufacture that may include embodiments of the disclosure herein; through inadvertent error in these procedures; through differences in the manufacture, source, or purity of the ingredients used to make the compositions or mixtures or carry out the methods; and the like. Throughout the disclosure, the terms "about" and "approximately" refer to a range of values 5% of the numeric value that the term precedes.

The terms "weight percent," "wt-%," "percent by weight," "% by weight," and variations thereof, as used herein, refer to the concentration of a substance or component as the weight of that substance or component divided by the total weight, for example, of the composition or of a particular component of the composition, and multiplied by 100. It is understood that, as used herein, "percent," "%," and the like may be synonymous with "weight percent" and "wt-%."

As used herein in the context of geometric descriptions, unless otherwise limited or defined, "substantially" indicates correspondence to a particular shape or dimension within conventional manufacturing tolerances for components of a similar type or that are formed using similar processes. In this regard, for example, "substantially round" can indicate a profile that deviates from a circle to within acceptable manufacturing tolerances.

Further, as used herein, unless otherwise defined or limited, directional terms are used for convenience of reference for discussion of particular figures or examples. For example, references to "downward," or other directions, or "lower" or other positions, may be used to discuss aspects of a particular example or figure, but do not necessarily require similar orientation or geometry in all installations or configurations.

The present disclosure is directed to an article of footwear and/or specific components of the article of footwear, such as an upper and/or a sole or sole structure. The upper may comprise a knitted component, a woven textile, and/or a non-woven textile. The knitted component may be made by knitting of yarn, the woven textile by weaving of yarn, and the non-woven textile by manufacture of a unitary non-woven web. Knitted textiles include textiles formed by way of warp knitting, weft knitting, flat knitting, circular knitting, and/or other suitable knitting operations. The knit textile may have a plain knit structure, a mesh knit structure, and/or a rib knit structure, for example. Woven textiles include, but are not limited to, textiles formed by way of any of the numerous weave forms, such as plain weave, twill weave, satin weave, dobbin weave, jacquard weave, double weaves, and/or double cloth weaves, for example. Non-woven textiles include textiles made by air-laid and/or spun-laid methods, for example. The upper may comprise a variety of materials, such as a first yarn, a second yarn, and/or a third yarn, which may have varying properties or varying visual characteristics.

Figure 2:
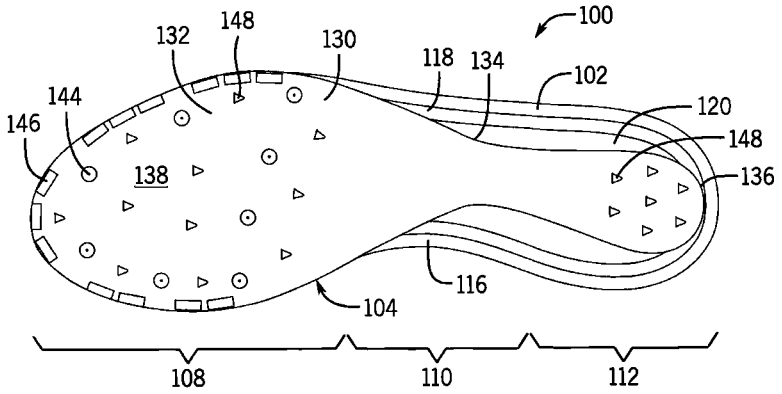
FIG. 2 is a bottom view of the article of footwear of FIG. 1.
Figure 3:
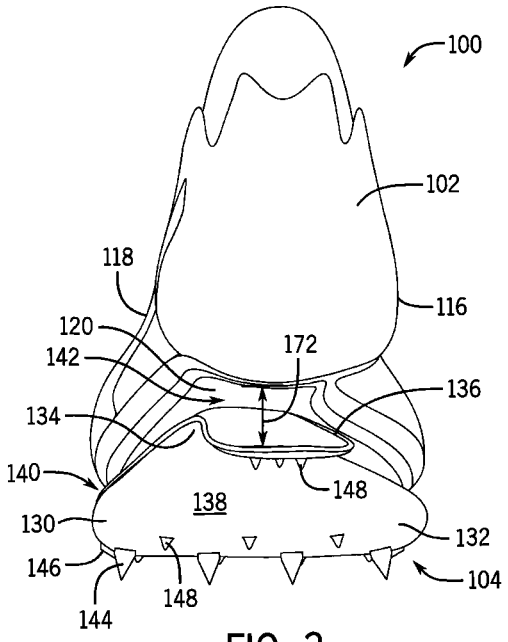
FIG. 3 is a rear view of the article of footwear of FIG. 1.

FIGS. 1-3 depict an embodiment of an article of footwear 100 including an upper 102 a top portion 120, and a sole structure 104. The upper 102 is attached to the top portion 120 and together define an interior cavity into which a foot may be inserted. For reference, the article of footwear 100 defines a forefoot region 108, a midfoot region 110, and a heel region 112. The forefoot region 108 generally corresponds with portions of the article of footwear 100 that encase portions of the foot that includes the toes, the ball of the foot, and joints connecting the metatarsals with the toes or phalanges. The midfoot region 110 is proximate and adjoining the forefoot region 108, and generally corresponds with portions of the article of footwear 100 that encase the arch of the foot, along with the bridge of the foot. The heel region 112 is proximate and adjoining the midfoot region 110 and generally corresponds with portions of the article of footwear 100 that encase rear portions of the foot, including the heel or calcaneus bone, the ankle, and/or the Achilles tendon.

Many conventional footwear uppers are formed from multiple elements (e.g., textiles, polymer foam, polymer sheets, leather, and synthetic leather) that are joined through bonding or stitching at a seam. In some embodiments, the upper 102 of the article of footwear 100 is formed from a knitted structure or knitted components. In various embodiments, a knitted component may incorporate various types of yarn that may provide different properties to an upper. For example, one area of the upper 102 may be formed from a first type of yarn that imparts a first set of properties, and another area of the upper 102 may be formed from a second type of yarn that imparts a second set of properties. Using this configuration, properties of the upper 102 may vary throughout the upper 102 by selecting specific yarns for different areas of the upper 102.

The article of footwear 100 also includes a medial side 116 (e.g., see FIG. 2) and a lateral side 118 (e.g., see FIG. 2). In particular, the lateral side 118 corresponds to an outside portion of the article of footwear 100 and the medial side 116 corresponds to an inside portion of the article of footwear 100. As such, left and right articles of footwear have opposing lateral and medial sides, such that the medial sides 116 are closest to one another when a user is wearing the articles of footwear 100, while the lateral sides 118 are defined as the sides that are farthest from one another while being worn. The medial side 116 and the lateral side 118 adjoin one another at opposing, distal ends of the article of footwear 100.

Unless otherwise specified, the forefoot region 108, the midfoot region 110, the heel region 112, the medial side 116, and the lateral side 118 are intended to define boundaries or areas of the article of footwear 100. To that end, the forefoot region 108, the midfoot region 110, the heel region 112, the medial side 116, and the lateral side 118 generally characterize sections of the article of footwear 100. Further, the upper 102, the top portion 120, and the sole structure 104 may be characterized as having portions within the forefoot region 108, the midfoot region 110, the heel region 112, and on the medial side 116 and the lateral side 118. Therefore, the upper 102, the top portion 120, and the sole structure 104, and/or individual portions of the upper 102, the top portion 120, and the sole structure 104, may include portions thereof that are disposed within the forefoot region 108, the midfoot region 110, the heel region 112, and on the medial side 116 and the lateral side 118.

The top portion 120 is connected to the upper 102 and, as stated above, can provide support for an arch of a user. The top portion 120 can be a strobel board, a forefoot board, a lasting board, etc., or a combination thereof and may include an insole. In some embodiments, the top portion 120 can provide support for an arch of a user.

The sole structure 104 is connected or secured to the top portion 120 and extends between a foot of a user and the ground when the article of footwear 100 is worn by the user. The sole structure 104 may include one or more components, which may include an outsole, a midsole, and/or a heel. For example, in some embodiments, a sole structure may include an outsole that provides structural integrity to the sole structure, along with providing traction for a user, and a midsole that provides a cushioning system. As will be further discussed herein, the sole structure 104 of the present embodiment of the invention includes one or more components that provide the sole structure 104 with preferable spring and damping properties.

The sole structure 104 includes an outsole 130. The outsole 130 may be a rigid plate formed from one or more materials to impart durability, wear-resistance, abrasion resistance, or traction to the sole structure 104. In some embodiments, the outsole 130 may comprise a polyurethane (PU) plastic, such as a thermoplastic polyurethane (TPU) material, for example. Other thermoplastic elastomers consisting of block copolymers are also possible. In other embodiments, the outsole 130 can include carbon fiber or high-density wood, for example. In some embodiments, the outsole 130 has a uniform thickness.

As shown in FIGS. 1 and 2, the outsole 130 has a front portion 132, a middle portion 134, and a rear portion 136. The outsole 130 extends front to rear through the forefoot region 108 and the midfoot region 110 and at least partially through the heel region 112. Further, the outsole 130 can extend across the entire forefoot region 108 from the medial side 116 to the lateral side 118 and only partially across the midfoot and heel regions 110, 112. The front portion 132 of the outsole 130 is coupled to the upper 102 and the top portion 120 at the forefoot region 108 at a forefoot coupling point 176 and the middle portion 134 is coupled to the top portion 120 at the midfoot region 110 at a midfoot coupling point 178. The outsole 130 is spaced from the top portion 120 between the forefoot coupling point 176 and the midfoot coupling point 178, and defines a front spacing 140 at the forefoot region 108.

The article of footwear 100 is shown in a rested, or unloaded state (i.e., no downward force is being exerted on the article of footwear 100 other than the nominal force of gravity). When viewed from the side and from beneath, the front spacing 140 has a first longitudinal length 122 defined as a straight line distance between the forefoot coupling point 176 and the midfoot coupling point 178. In the embodiment shown, the front spacing 140 has a crescent profile with a curved length 124 defined as a curved line following the midpoint between the top portion 120 and the outsole 130 along the first longitudinal length 122 and between the forefoot coupling point 176 and the midfoot coupling point 178. The front spacing 140 also has a first gap height 126 defined by the distance between the top portion 120 and the outsole 130. The first gap height 126 changes along the curved length 124, increasing and then decreasing from the forefoot region 108 to the midfoot region 110, with the first gap height 126 being largest beneath where the ball of a user's foot would be received within the upper 102 and being defined as the maximum first gap height 126A. The front spacing 140 also has a front spacing volume 128 as defined by the top portion 120, the outsole 130, and an unseen boundary extending from and between the periphery of the top portion 120 and the outsole 130.

As further illustrated in FIGS. 1 and 3, the middle portion 134 of the outsole 130 extends away from the midfoot coupling point 178, spacing the rear portion 136 of the outsole 130 at the heel region 112 from the top portion 120 and defining a rear spacing 142 between the rear portion 136 and the top portion 120. When viewed from the side, the rear spacing 142 has a wedge profile. As shown, the rear spacing 142 has a second longitudinal length 170 defined as a straight line distance between the midfoot coupling point 178 and a terminal end 160 of the rear portion 136 of the outsole 130. The rear spacing 142 also has a second gap height 172 defined by the distance between the top portion 120 and the outsole 130 along the second longitudinal length 170. The second gap height 172 increases from the midfoot region 110 toward the heel region 112 and is substantially constant along the heel region 112 beneath where the heel of a user's foot would be received within the upper 102. The greatest height of the second gap height 172 defining a maximum second gap height 172A. The rear spacing 142 also has a rear spacing volume 174 as defined by the top portion 120, the outsole 130, and an unseen boundary extending from and between the periphery of the top portion 120 and the outsole 130 in the heel region 112.

In the rested state, the first longitudinal length 122 of the article of footwear 100 is greater than the second longitudinal length 170 and the maximum first gap height 126A is smaller than the maximum second gap height 172A. In some embodiments, the first longitudinal length 122 can be in a range from about 1.5 times to about 2.0 times the second longitudinal length 170. In some embodiments, the maximum second gap height 172A can be in a range from about 1.1 times to about 1.5 times the maximum first gap height 126A. In some embodiments, the front spacing volume is approximately the same as the rear spacing volume.

In a neutral state (not shown), when a user's foot is received within the upper 102 and the user is standing (i.e., no downward force is being applied to the article of footwear 100 other than the weight of the user), the first gap height 126 is decreased due to the top portion 120 being urged toward the outsole 130 under the force of the weight of the user. In some embodiments, for example, the percentage decrease in the front spacing volume 128 from the rested state to the neutral state can be in a range of about 1 percent to about 20 percent, more preferably the percentage decrease in the front spacing volume 128 can be in a range of about 5 percent to about 10 percent. Additionally, the rear spacing volume 174 will be decreased in the neutral state. In some embodiments, for example, the percentage decrease of the rear spacing volume 174 from the rested state to the neutral state can be in a range of about 1 percent to about 50 percent, more preferably the percentage decrease in the rear spacing volume 174 can be in a range of about 10 percent to about 30 percent. Further, the middle portion 134 of the outsole 130 contacts the top portion 120 in the midfoot region 110 and provides additional support of the arch of the user when in the neutral state.

During use, in an active state (not shown), when the outsole 130 is in contact with the ground and a user exerts a downward force in the forefoot region 108, the downward force will urge the top portion 120 toward the outsole 130 and further decrease the front spacing volume 128 while lengthening the first longitudinal length 122. In some embodiments, for example, the percentage decrease in the first spacing volume 128 from the rested state to the active state can be a range of about 10 percent to about 100 percent, more preferably, the percentage decrease in the front spacing volume 128 can be in a range of about 50 percent to about 90 percent. Additionally, in the active state, if a user applies a force to the heel portion 112, the rear spacing volume 174 can experience a percentage decrease in volume. In some embodiments, for example, the decrease in volume from the rested state to the active state can be in a range of about 90 percent to about 100 percent. Further, the middle portion 134 of the outsole 130 can act as a fulcrum when in the active state. For example, a user can strike the heel portion 112 on the ground while walking or running and rotate the foot forward about the middle portion 134 in the midfoot region 110, and continue rotating the foot forward, striking the forefoot region 108 on the ground.

The outsole 130 along with the front spacing 140 and the rear spacing 142 can therefore provide force absorption as a user exerts downward force onto the forefoot region 108 and the heel region 112, respectively, of the article of footwear 100 and can also provide a spring effect as the downward force from the user is relieved. This can reduce the severity of the impact to a user's foot and leg joints during use.

The outsole 130 may define a bottom end or bottom surface 138 of the sole structure 104 across the forefoot region 108, the midfoot region 110, and the heel region 112. Further, the outsole 130 may be a ground-engaging portion or include a ground-engaging surface of the sole structure 104 and may be opposite of the upper 102. For example, the outsole 130 can include any combination of ground engaging members (e.g., spikes 144, teeth 146, and barbs 148) that extend from the bottom surface 138 of the outsole 130 and which can be positioned throughout the front portion 132 and the rear portion 136.

As shown, the article of footwear 100 includes spikes 144 and teeth 146 in the front portion 132 and barbs 148 in the front and rear portions 132, 136. The number and placement of spikes can affect traction with respect to linear movement. As shown, each of the spikes 144 has a conical tip. In some embodiments, the spikes 144 can vary in shape and size depending on user preference and environmental considerations such as the type of ground surface covering and weather conditions. For example, see the small spikes 1794 in FIGS. 49-53 and as discussed with respect to another embodiment or an article of footwear 1700 below. It is contemplated that at least one of the spikes 144 can be removable.

The teeth 146 can extend from and can be spaced around the periphery of the outsole 130 in the front portion 132. As shown, the teeth 146 can be blade-like and can have a rectangular profile. The number and placement of teeth 146 can affect traction with respect to lateral and medial (i.e., side-to-side) movement. In some embodiments, the teeth 146 can be formed as part of the outsole 130 during the production of the outsole 130 (e.g., the teeth 146 can be formed as continuous extensions of the outsole 130). Further, the teeth 146 can be provided in groups, for example in groups of two or three as shown. Teeth 146 can also be provided in front of a user's toe to support "toe off."

The barbs 148 can extend from the outsole 130 at multiple locations and can be angled toward the rear of the article of footwear 100. As shown, the barbs 148 have a triangular pyramidal shape. In some embodiments, the barbs 148 can be formed as part of the outsole 130 (e.g., the barbs 148 can be formed as continuous extensions of the outsole 130).

Figure 4:
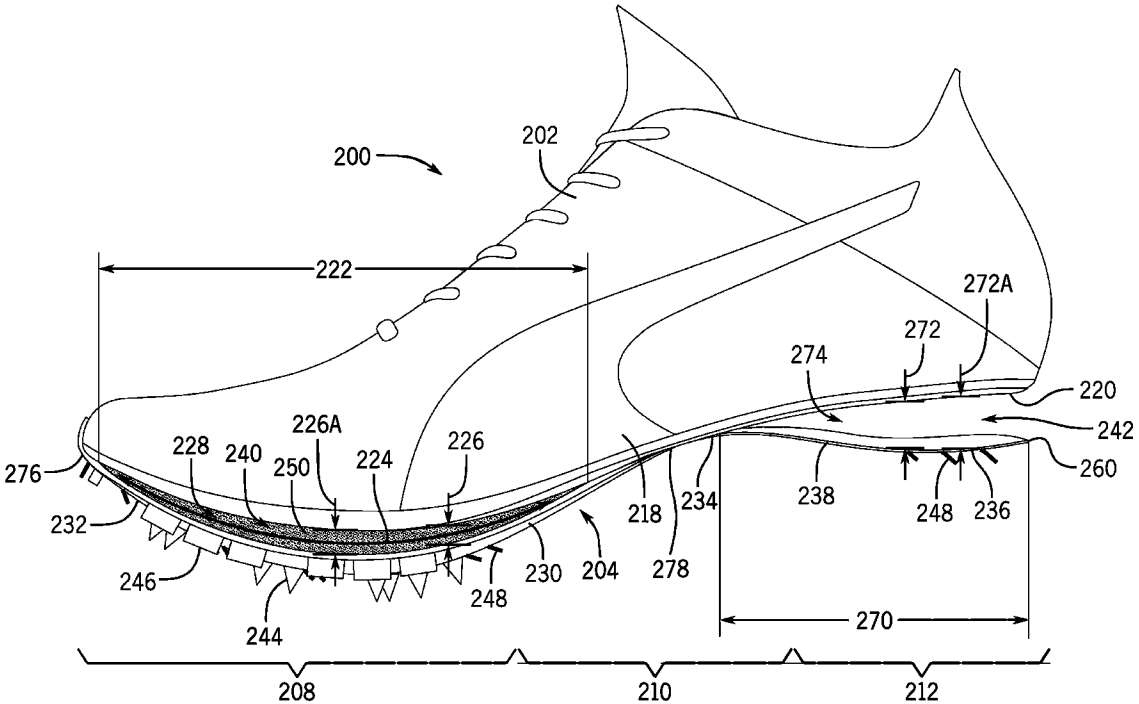
FIG. 4 is a lateral side view of an article of footwear configured as a left shoe that includes an upper and a sole structure, according to another embodiment of the disclosure.
Figure 5:
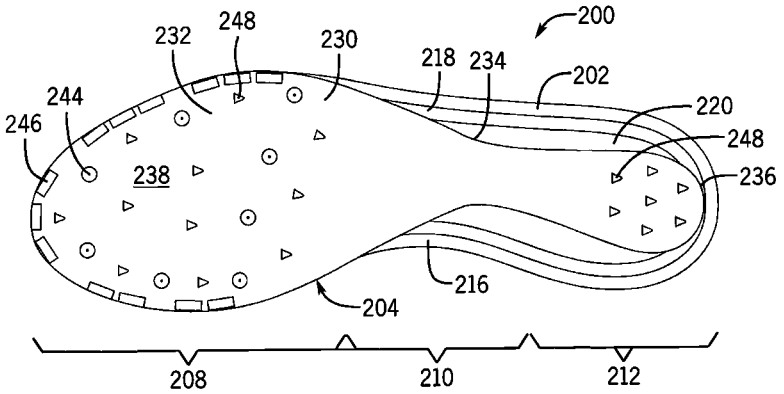
FIG. 5 is a bottom view of the article of footwear of FIG. 4.
Figure 6:
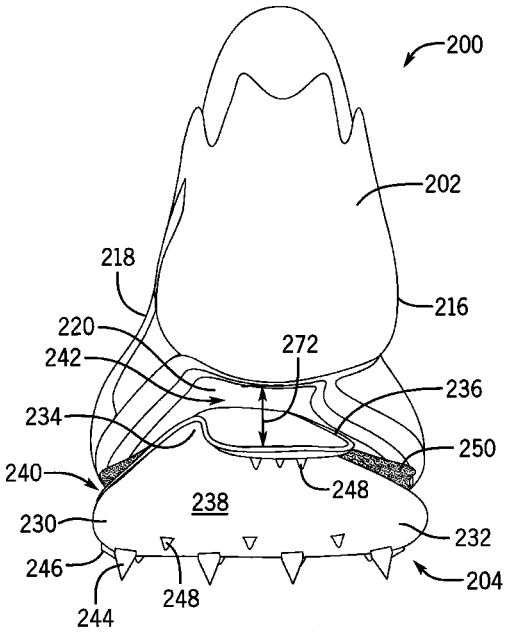
FIG. 6 is a rear view of the article of footwear of FIG. 4.

FIGS. 4-6 show another embodiment of an article of footwear 200. In many aspects, the article of footwear 200 is similar to the article of footwear 100 described above and similar numbering in the 200 series is used for the article of footwear 200. For example, the article of footwear 200 includes an upper 202, a top portion 220, and a sole structure 204 with an outsole 230. The upper 202 defines a forefoot region 208, a midfoot region 210, and a heel region 212. Further, the article of footwear 200 also includes a medial side 216 corresponding to an inside portion of the article of footwear 200 and a lateral side 218 corresponding to an outside portion of the article of footwear 200.

Additionally, the outsole 230 may be a rigid plate formed from one or more materials to impart durability, wear-resistance, abrasion resistance, or traction to the sole structure 204. The outsole 230 has a front portion 232, a middle portion 234, and a rear portion 236 with a terminal end 260. The outsole 230 extends front to rear through the forefoot region 208 and the midfoot region 210 and at least partially through the heel region 212. Further, the outsole 230 can extend across the entire forefoot region 208 from the medial side 216 to the lateral side 218 and only partially across the midfoot and heel regions 210, 212. The front portion 232 of the outsole 230 is coupled to the top portion 220 at the forefoot region 208 at a forefoot coupling point 276 and the middle portion 234 is coupled to the top portion 220 at the midfoot region 210 at a midfoot coupling point 278. The outsole 230 is spaced from the top portion 220 between the forefoot coupling point 276 and the midfoot coupling point 278, and defines a front spacing 240, a first longitudinal length 222, a curved length 224, a first gap height 226 with a maximum first gap height 226A, and a front spacing volume 228. As further illustrated in FIGS. 4 and 6, the middle portion 234 of the outsole 230 extends away from the midfoot coupling point 278, spacing the rear portion 236 of the outsole 230 from the top portion 220 and defining a rear spacing 242, a second longitudinal length 270, a second gap height 272 with a maximum second gap height 272A, and a rear spacing volume 274. The outsole 230 also has at least one ground engaging member (e.g., a spike 244, a tooth 246, or a barb 248) extending from a bottom surface 238 thereof.

In some aspects, however, the articles of footwear 100, 200 differ from each other. For example, the sole structure 204 includes a front cushioning member 250. The front cushioning member 250 may be positioned within the front spacing 240 between the outsole 230 and the upper 202 and can extend across the front portion 232 from the medial side 216 to the lateral side 218. In some embodiments, for example, the volume of the front cushioning member 250 can be in a range of about 85 percent to about 95 percent of the front spacing volume 228.

The front cushioning member 250 can be individually constructed from a thermoplastic material, such as PU, for example, and/or an ethylene-vinyl acetate (EVA), copolymers thereof, or a similar type of material. In other embodiments, the front cushioning member 250 may be an EVA-Solid-Sponge ("ESS") material, an EVA foam (e.g., PUMA® ProFoam Lite™, IGNITE Foam), polyurethane, polyether, an olefin block copolymer, a thermoplastic material (e.g., a thermoplastic polyurethane, a thermoplastic elastomer, a thermoplastic polyolefin, etc.), or a supercritical foam. The front cushioning member 250 may be a single polymeric material or may be a blend of materials, such as an EVA copolymer, a thermoplastic polyurethane, a polyether block amide (PEBA) copolymer, and/or an olefin block copolymer. One example of a PEBA material is PEBAX®.

In embodiments where the front cushioning member 250 is formed from a supercritical foaming process, the supercritical foam may comprise micropore foams or particle foams, such as a TPU, EVA, PEBAX®, or mixtures thereof, manufactured using a process that is performed within an autoclave, an injection molding apparatus, or any sufficiently heated/pressurized container that can process the mixing of a supercritical fluid (e.g., $CO_2$, $N_2$, or mixtures thereof) with a material (e.g., TPU, EVA, polyolefin elastomer, or mixtures thereof) that is preferably molten. In one example process, a solution of supercritical fluid and molten material can be pumped into a pressurized container, after which the pressure within the container is released, such that the molecules of the supercritical fluid rapidly convert to gas to form small pockets within the material and cause the material to expand into a foam, which may be used as the front cushioning member 250. In further embodiments, the front cushioning member 250 may be formed using alternative methods known in the art, including the use of an expansion press, an injection machine, a pellet expansion process, a cold foaming process, a compression molding technique, die cutting, or any combination thereof. For example, the front cushioning member 250 may be formed using a process that involves an initial foaming step in which supercritical gas is used to foam a material and then compression molded or die cut to a particular shape. Additionally, or alternatively, an air-bladder/bag made out of blown polymer (e.g., TPU) and pressurized with air can be used as a front cushioning member.

The sole structure 204 as described with the front cushioning member 250 provided within the front spacing 240 of the outsole 230 can provide spring and dampening properties. This can reduce the severity of the impact to a user's foot and leg joints during use.

Figure 7:
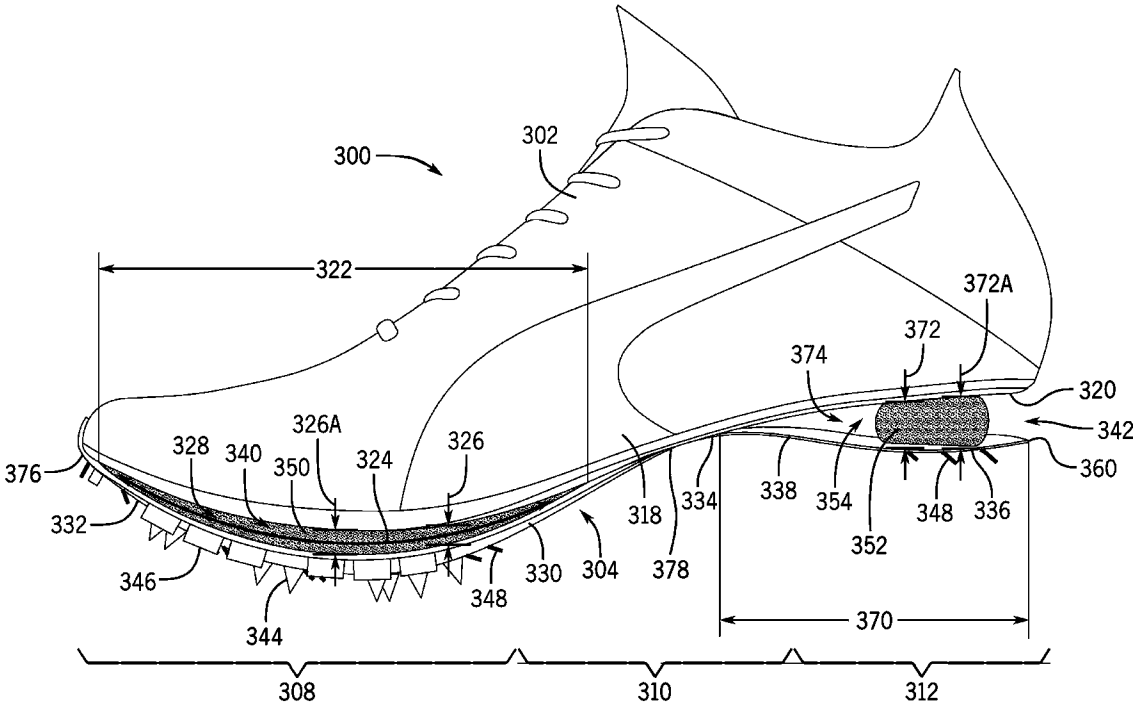
FIG. 7 is a lateral side view of an article of footwear configured as a left shoe that includes an upper and a sole structure, according to an embodiment of the disclosure.
Figure 8:
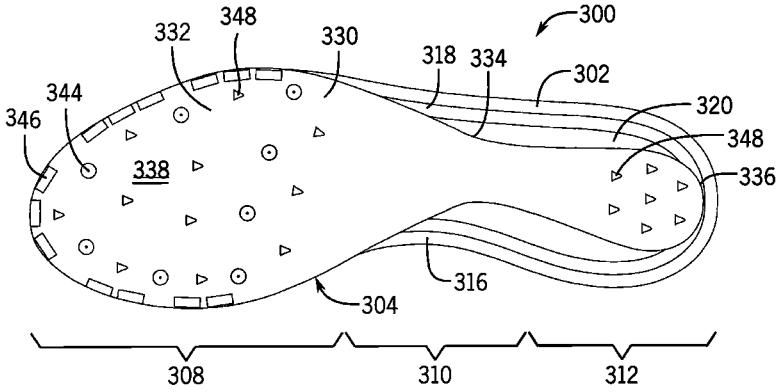
FIG. 8 is a bottom view of the article of footwear of FIG. 7.
Figure 9:
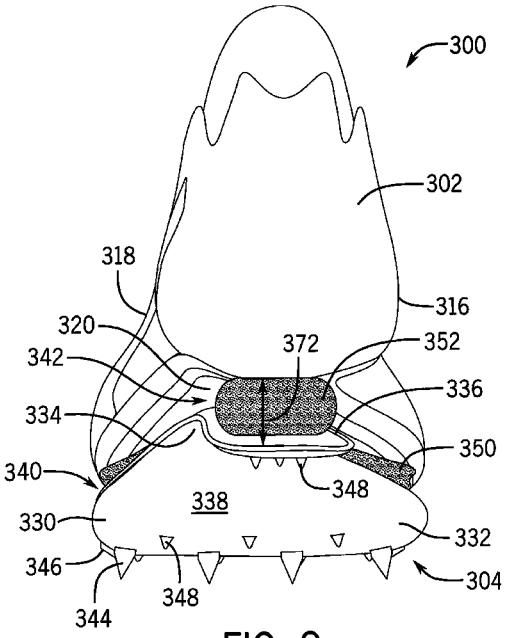
FIG. 9 is a rear view of the article of footwear of FIG. 7.

FIGS. 7-9 show another embodiment of an article of footwear 300. In many aspects, the article of footwear 300 is similar to the article of footwear 200 described above and similar numbering in the 300 series is used for the article of footwear 300. For example, the article of footwear 300 includes an upper 302, a top portion 320, and a sole structure 304 with an outsole 330. The upper 302 defines a forefoot region 308, a midfoot region 310, and a heel region 312. Further, the article of footwear 300 also includes a medial side 316 corresponding to an inside portion of the article of footwear 300 and a lateral side 318 corresponding to an outside portion of the article of footwear 300.

Additionally, the outsole 330 may be a rigid plate formed from one or more materials to impart durability, wear-resistance, abrasion resistance, or traction to the sole structure 304. The outsole 330 has a front portion 332, a middle portion 334, and a rear portion 336 with a terminal end 360. The outsole 330 extends front to rear through the forefoot region 308 and the midfoot region 310 and at least partially through the heel region 312. Further, the outsole 330 can extend across the entire forefoot region 308 from the medial side 316 to the lateral side 318 and only partially across the midfoot and heel regions 310, 312. The front portion 332 of the outsole 330 is coupled to the top portion 320 at the forefoot region 308 at a forefoot coupling point 376 and the middle portion 334 is coupled to the top portion 320 at the midfoot region 310 at a midfoot coupling point 378. The outsole 330 is spaced from the top portion 320 between the forefoot coupling point 376 and the midfoot coupling point 378, defining a front spacing 340 at the forefoot region 308, a first longitudinal length 322, a curved length 324, a first gap height 326 with a maximum first gap height 326A, and a front spacing volume 328. As further illustrated in FIGS. 7 and 9, the middle portion 334 of the outsole 330 extends away from the midfoot coupling point 378, spacing the rear portion 336 of the outsole 330 from the top portion 320 and defining a rear spacing 342, a second longitudinal length 370, a second gap height 372 with a maximum second gap height 372A, and a rear spacing volume 374. The outsole 330 also has at least one ground engaging member (e.g., a spike 344, a tooth 346, or a barb 348) extending from a bottom surface 338 thereof.

Further, the sole structure 304 includes a front cushioning member 350. The front cushioning member 350 is positioned within the front spacing 340 between the outsole 330 and the upper 302 and extends across the forefoot region 308 from the medial side 316 to the lateral side 318 similar to that of the front cushioning member 250 in the article of footwear 200. The front cushioning member 350 can be formed from any of the materials and processes described above with respect to the front cushioning member 250 of the article of footwear 200.

In some aspects, however, the articles of footwear 200, 300 differ from each other. For example, the sole structure 304 also includes a rear cushioning member 352. The rear cushioning member 352 may be positioned within the rear spacing 342 between the outsole 330 and the upper 302. The rear cushioning member 352 extends across a portion of the rear portion 336 of the outsole 330. In some embodiments, for example, the volume of the rear cushioning member 352 can be in a range of about 35 percent to about 50 percent of the rear spacing volume 374. In some embodiments, the rear cushioning member 352 can define a rear spacing pocket 354 adjacent the front side of the rear cushioning member 352. The rear spacing pocket 354 extends longitudinally between the midfoot coupling point 378 and the rear cushioning member 352, latitudinally between the medial side 316 and the lateral side 318, and vertically between the top portion 320 and the outsole 330. As shown in FIGS. 7 and 9, the rear cushioning member 352 is positioned directly beneath where the heel of a user's foot would be received within the upper 302. For example, the rear cushioning member 352 is positioned within the rear spacing pocket 354 at the location of and adjacent the maximum second gap height 372A. The rear cushioning member 352 can be formed from any of the materials and processes described above with respect to the front cushioning member 250 of the article of footwear 200.

The sole structure 304 as described with the front cushioning member 350 provided within the front spacing 340 of the outsole 330 and the rear cushioning member 352 provided within the rear spacing 342 of the outsole 330 can provide spring and dampening properties, which can reduce the severity of the impact to a user's foot and leg joints during use.

FIGS. 10-24 show other embodiments of an article of footwear 400, 500, 600, 700, 800. In many aspects, the articles of footwear 400, 500, 600, 700, 800 are similar to the articles of footwear 100, 200, 300 described above and similar numbering in the 400, 500, 600, 700, 800 series is used for the articles of footwear 400, 500, 600, 700, 800. For example, each of the articles of footwear 400, 500, 600, 700, 800 include an upper 402, 502, 602, 702, 802; a top portion 420, 520, 620, 720, 820; and a sole structure 404, 504, 604, 704, 804 with an outsole 430, 530, 630, 730, 830. Each outsole 430, 530, 630, 730, 830 may be a rigid plate and has a front portion 432, 532, 632, 732, 832; a middle portion 434, 534, 634, 734, 834; and a rear portion 436, 536, 636, 736, 836 with a terminal end 460, 560, 660, 760, 860. Additionally, each article of footwear 400, 500, 600, 700, 800 defines a forefoot region 408, 508, 608, 708, 808; a midfoot region 410, 510, 610, 710, 810; and a heel region 412, 512, 612, 712, 812 and has a medial side 416, 516, 616, 716, 816 and a lateral side 418, 518, 618, 718, 818. The outsole 430, 530, 630, 730, 830 can also be coupled to the top portion 420, 520, 620, 720, 820 at a forefoot coupling point 476, 576, 676, 767, 876 and at a midfoot coupling point 478, 578, 678, 778, 878.

Further, each article of footwear 400, 500, 600, 700, 800 defines a front spacing 440, 540, 640, 740, 840 with a first longitudinal length 422, 522, 622, 722, 822; a curved length 424, 524, 624, 724, 824; a first gap height 426, 526, 626, 726, 826 with a maximum first gap height 426A, 526A, 626A, 726A, 826A; and a front spacing volume 428, 528, 628, 728, 828 and a rear spacing 442, 542, 642, 742, 842 with a second longitudinal length 470, 570, 670, 770, 870; a second gap height 472, 572, 672, 772, 872 with a maximum second gap height 472A, 572A, 672A, 772A, 872A; and a rear spacing volume 474, 574, 674, 774, 874 and has at least one ground engaging member (e.g., a spike 444, 544, 644, 744, 844; a tooth 446, 546, 646, 746, 846; or a barb 448, 548, 648, 748, 848) extending from a bottom surface 438, 538, 638, 738, 838 of the outsole 430, 530, 630, 730, 830. However, each embodiment differs regarding the inclusion and arrangement of the front and rear cushioning members. When included, however, the materials comprising and processes for making the front and rear cushioning members are as described above.

Figure 10:
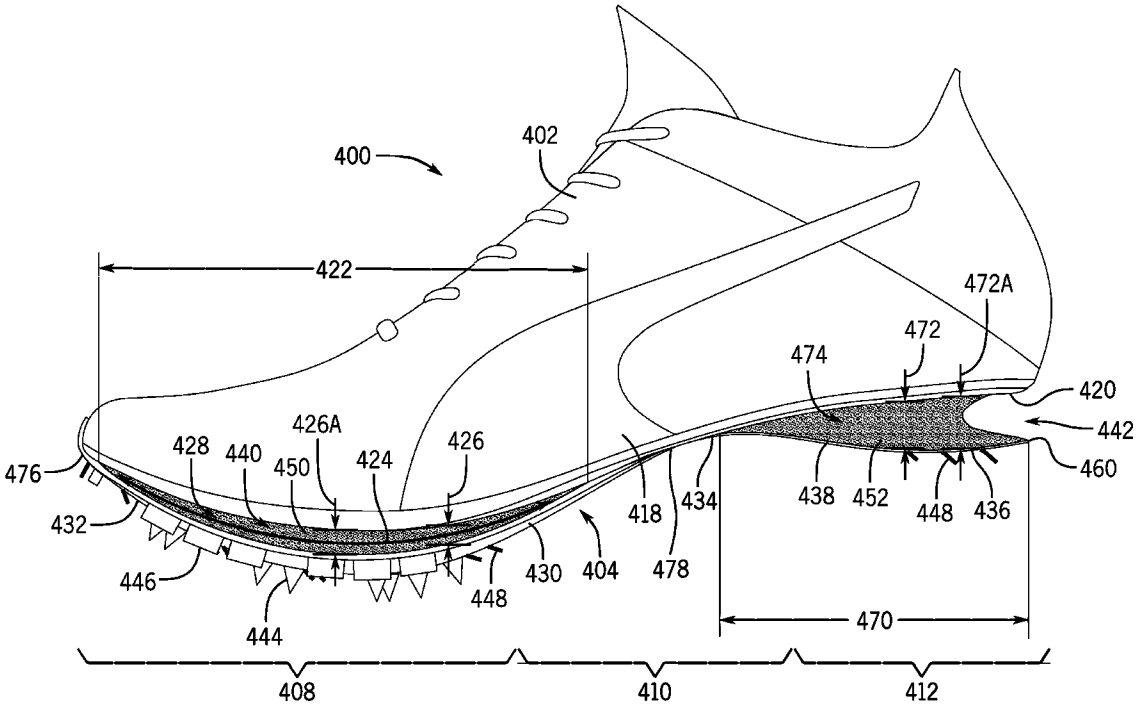
FIG. 10 is a lateral side view of an article of footwear configured as a left shoe that includes an upper and a sole structure, according to an embodiment of the disclosure.
Figure 11:
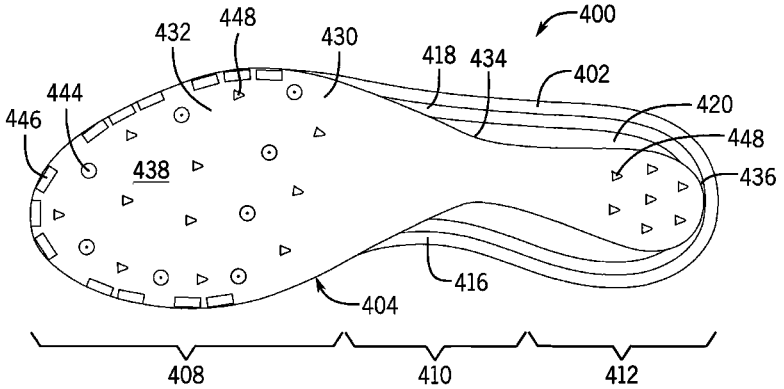
FIG. 11 is a bottom view of the article of footwear of FIG. 10.
Figure 12:
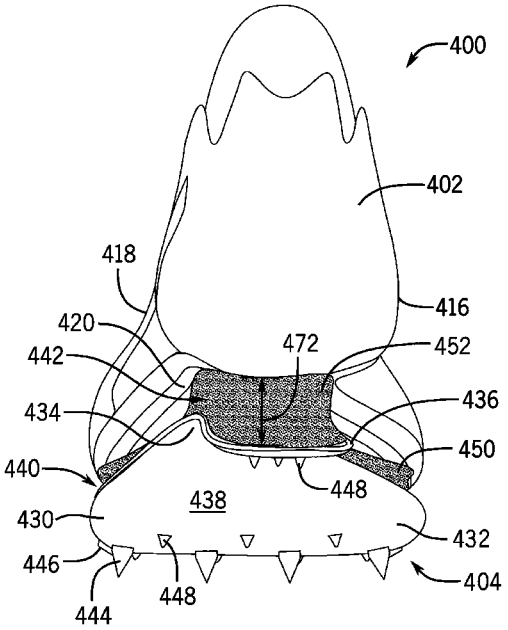
FIG. 12 is a rear view of the article of footwear of FIG. 10.

FIGS. 10-12 illustrate the article of footwear 400 in which both a front cushioning member 450 and a rear cushioning member 452 are provided (hidden in FIG. 11). The front cushioning member 450 is positioned within the front spacing 440 between the outsole 430 and the upper 402 and extends across the front portion 432 of the outsole 430 from the medial side 416 to the lateral side 418. In some embodiments, for example, the volume of the front cushioning member 450 can be in a range of about 85 percent to about 95 percent of the front spacing volume 428. Further, the rear cushioning member 452 is positioned within the rear spacing 442 between the outsole 430 and the upper 402 and extends across the rear portion 436 of the outsole 430 from the medial side 416 to the lateral side 418. In some embodiments, for example, the volume of the rear cushioning member 452 can be in a range of about 70 percent to about 95 percent of the rear spacing volume 474.

Figure 13:
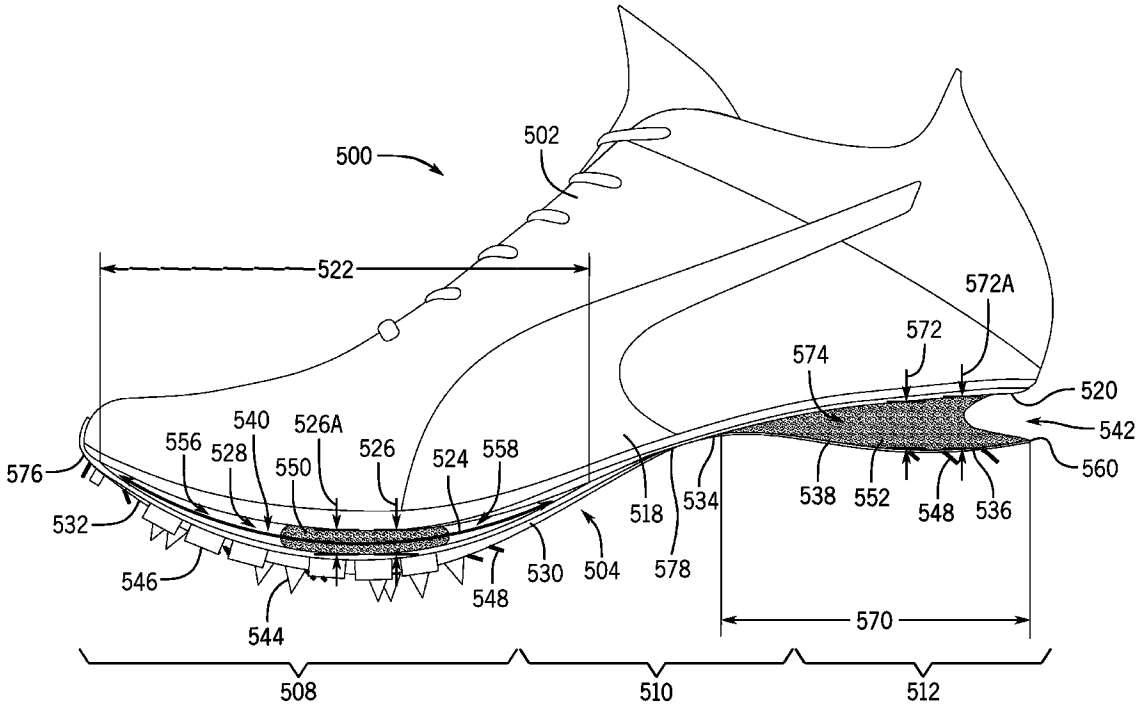
FIG. 13 is a lateral side view of an article of footwear configured as a left shoe that includes an upper and a sole structure, according to an embodiment of the disclosure.
Figure 14:
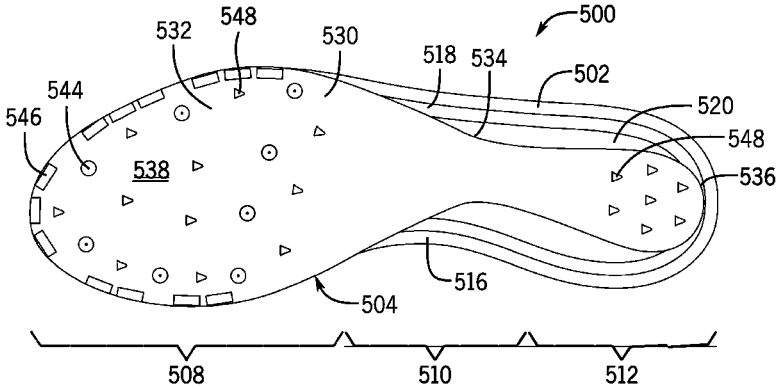
FIG. 14 is a bottom view of the article of footwear of FIG. 13.
Figure 15:
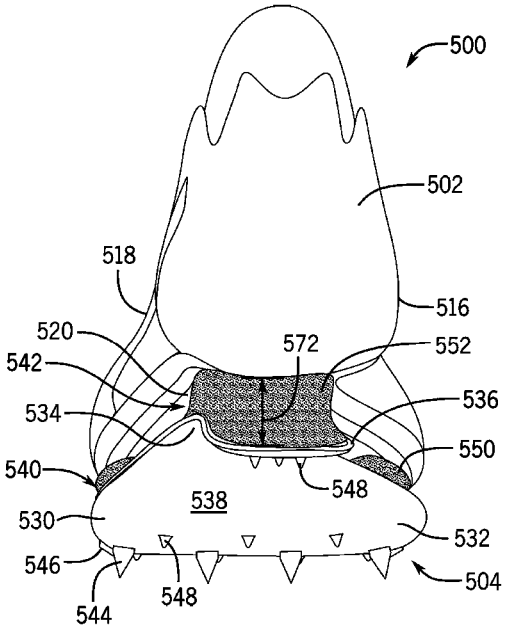
FIG. 15 is a rear view of the article of footwear of FIG. 13.

In FIGS. 13-15, the article of footwear 500 is shown with both a front cushioning member 550 and a rear cushioning member 552 (hidden in FIG. 14). The front cushioning member 550 is positioned within the front spacing 540 between the outsole 530 and the upper 502 and extends across a portion of the front portion 532 of the outsole 530. In some embodiments, for example, the volume of the front cushioning member 550 can be in a range of about 35 percent to about 50 percent of the front spacing volume 528. In some embodiments, the front cushioning member 550 defines a first front spacing pocket 556 and a second front spacing pocket 558 adjacent the front and rear sides of the front cushioning member 550, respectively. The first front spacing pocket 556 extends longitudinally between the forefoot coupling point 576 and the front cushioning member 550, latitudinally between the medial side 516 and the lateral side 518, and vertically between the top portion 520 and the outsole 530. The second front spacing pocket 558 extends longitudinally between the front cushioning member 550 and the midfoot coupling point 578, latitudinally from the medial side 516 to the lateral side 518. and vertically between the top portion 520 and the outsole 530. As shown, the front cushioning member 550 can be positioned directly beneath where the ball of a user's foot would be received within the upper 502. For example, the front cushioning member 550 is positioned within the front spacing pocket 556 at the location of and adjacent the maximum first gap height 526A. Further, the rear cushioning member 552 is positioned within the rear spacing 542 between the outsole 530 and the upper 502 and extends across the rear portion 536 of the outsole 530 from the medial side 516 to the lateral side 518. In some embodiments, for example, the volume of the rear cushioning member 552 can be in a range of about 70 percent to about 95 percent of the rear spacing volume 574.

Figure 16:
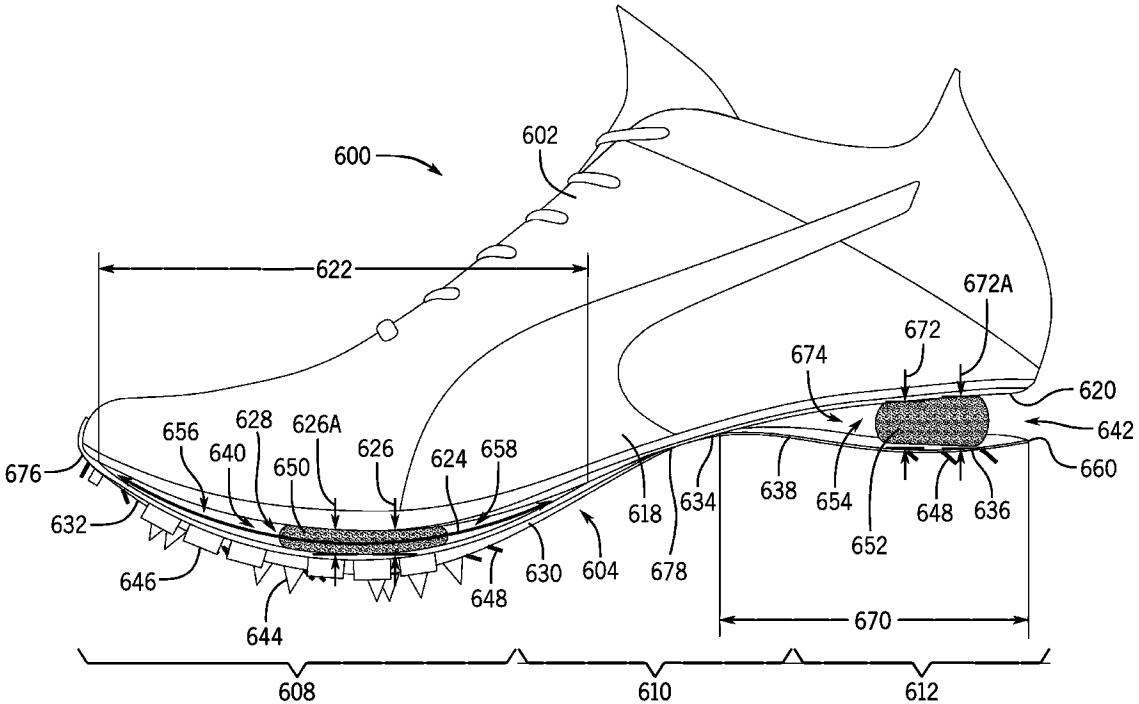
FIG. 16 is a lateral side view of an article of footwear configured as a left shoe that includes an upper and a sole structure, according to an embodiment of the disclosure.
Figure 17:
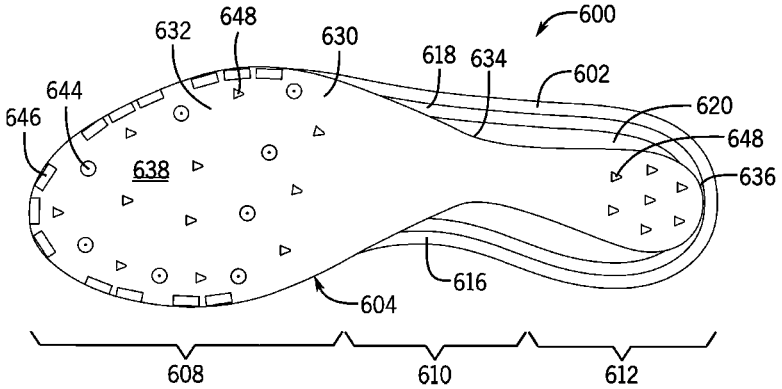
FIG. 17 is a bottom view of the article of footwear of FIG. 16.
Figure 18:
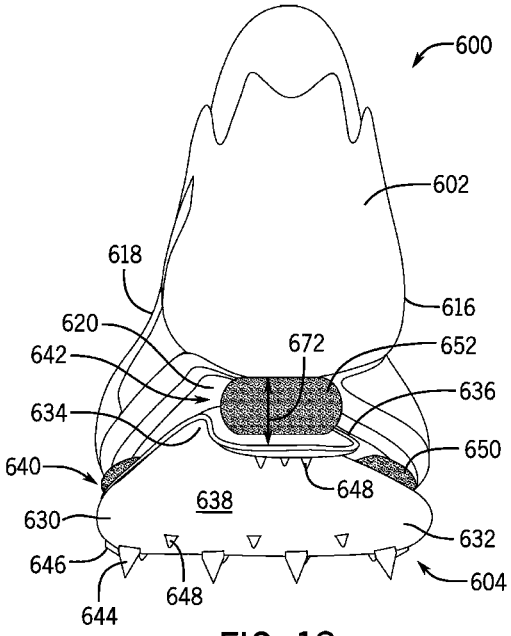
FIG. 18 is a rear view of the article of footwear of FIG. 16.

FIGS. 16-18 show the article of footwear 600 with both a front cushioning member 650 and a rear cushioning member 652 (hidden in FIG. 17). The front cushioning member 650 is positioned within the front spacing 640 between the outsole 630 and the upper 602 and extends across a portion of the front portion 632 of the outsole 630. In some embodiments, for example, the volume of the front cushioning member 650 can be in a range of about 35 percent to about 50 percent of the front spacing volume 628. In some embodiments, the front cushioning member 650 defines a first front spacing pocket 656 and a second front spacing pocket 658 adjacent the front and rear sides of the front cushioning member 650, respectively. The first front spacing pocket 656 extends longitudinally between the forefoot coupling point 676 and the front cushioning member 650, latitudinally between the medial side 616 and the lateral side 618, and vertically between the top portion 620 and the outsole 630. The second front spacing pocket 658 extends longitudinally between the front cushioning member 650 and the midfoot coupling point 678, latitudinally between the medial side 616 and the lateral side 618, and vertically between the top portion 620 and the outsole 630. As shown, the front cushioning member 650 can be positioned directly beneath where the ball of a user's foot would be received within the upper 602. For example, the front cushioning member 650 is positioned within the front spacing pocket 656 at the location of and adjacent the maximum first gap height 626A. The rear cushioning member 652 is positioned within the rear spacing 642 between the outsole 630 and the upper 602. The rear cushioning member 652 extends across a portion of the rear portion 636 of the outsole 630. In some embodiments, for example, the volume of the rear cushioning member 652 can be in a range of about 35 percent to about 50 percent of the rear spacing volume 674. In some embodiments, the rear cushioning member 652 can define a rear spacing pocket 654 adjacent the front side of the rear cushioning member 652. The rear spacing pocket 654 extends longitudinally between the midfoot coupling point 678 and the rear cushioning member 652, latitudinally between the medial side 616 and the lateral side 618, and vertically between the top portion 620 and the outsole 630. As shown, the rear cushioning member 652 is positioned directly beneath where the heel of a user's foot would be received within the upper 602. For example, the rear cushioning member 652 is positioned within the rear spacing pocket 654 at the location of and adjacent the maximum second gap height 672A.

Figure 19:
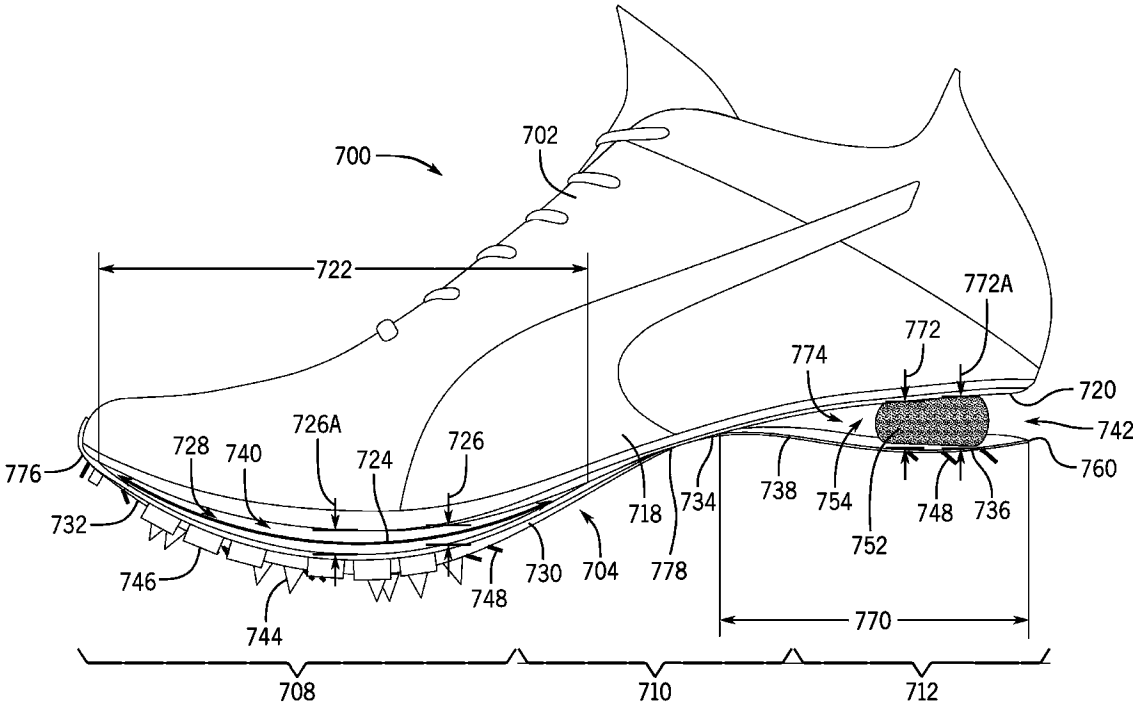
FIG. 19 is a lateral side view of an article of footwear configured as a left shoe that includes an upper and a sole structure, according to an embodiment of the disclosure.
Figure 20:
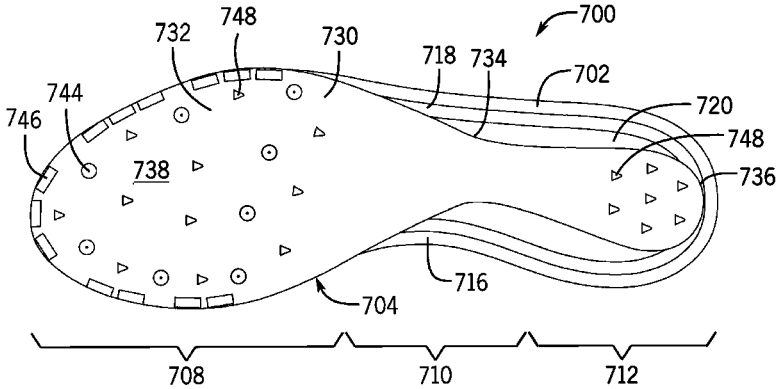
FIG. 20 is a bottom view of the article of footwear of FIG. 19.
Figure 21:
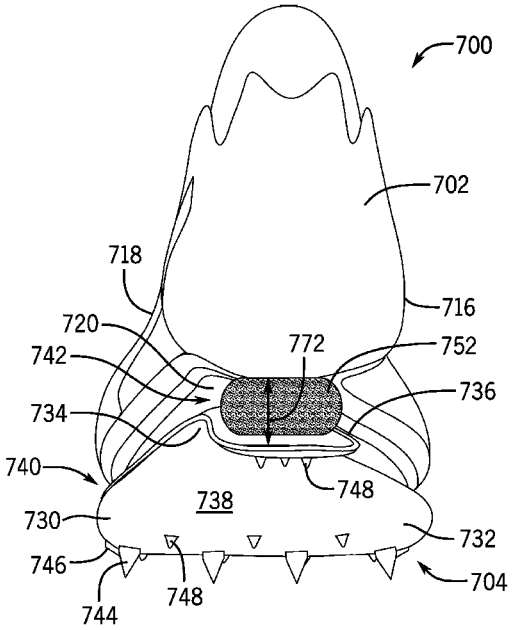
FIG. 21 is a rear view of the article of footwear of FIG. 19.

The article of footwear 700 is shown in FIGS. 19-21. The article of footwear 700 does not have a front cushioning member within the front spacing 740 but does have a rear cushioning member 752 within the rear spacing 742 (hidden in FIG. 20). The rear cushioning member 752 is positioned within the rear spacing 742 between the outsole 730 and the upper 702. The rear cushioning member 752 extends across a portion of the rear portion 736 of the outsole 730. In some embodiments, for example, the volume of the rear cushioning member 752 can be in a range of about 35 percent to about 50 percent of the rear spacing volume 774. In some embodiments, the rear cushioning member can define a rear spacing pocket 754 adjacent the front side of the rear cushioning member 752. The rear spacing pocket 754 extends longitudinally between the midfoot coupling point 778 and the rear cushioning member 752, latitudinally between the medial side 716 and the lateral side 718, and vertically between the top portion 720 and the outsole 730. As shown, the rear cushioning member 752 is positioned directly beneath where the heel of a user's foot would be received within the upper 702. For example, the rear cushioning member 752 is positioned within the rear spacing pocket 754 at the location of and adjacent the maximum second gap height 772A.

Figure 22:
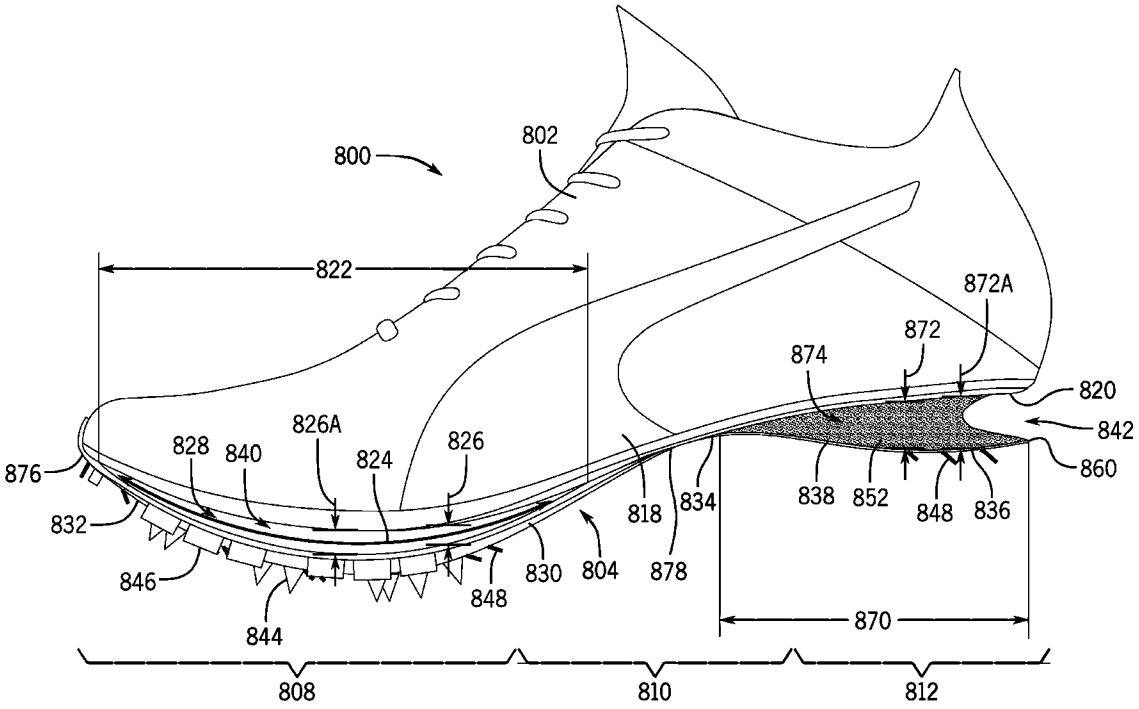
FIG. 22 is a lateral side view of an article of footwear configured as a left shoe that includes an upper and a sole structure, according to an embodiment of the disclosure.
Figure 23:
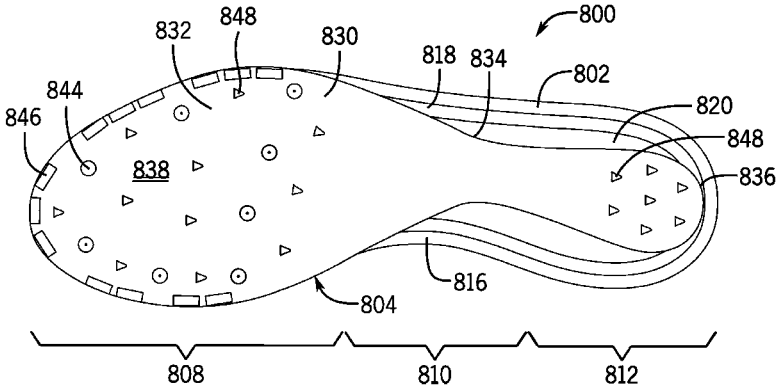
FIG. 23 is a bottom view of the article of footwear of FIG. 22.
Figure 24:
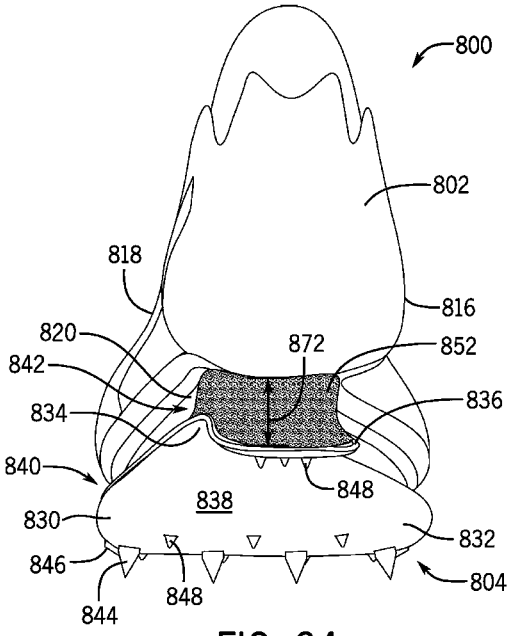
FIG. 24 is a rear view of the article of footwear of FIG. 22.

FIGS. 22-24 illustrate the article of footwear 800. The article of footwear 800 does not have a front cushioning member within the front spacing 840 but does have a rear cushioning member 852 within the rear spacing 842 (hidden in FIG. 23). The rear cushioning member 852 is positioned within the rear spacing 842 between the outsole 830 and the upper 802 and extends across the rear portion 836 of the outsole 830 from the medial side 816 to the lateral side 818. In some embodiments, for example, the volume of the rear cushioning member 852 can be in a range of about 70 percent to about 95 percent of the rear spacing volume 874.

Figure 25:
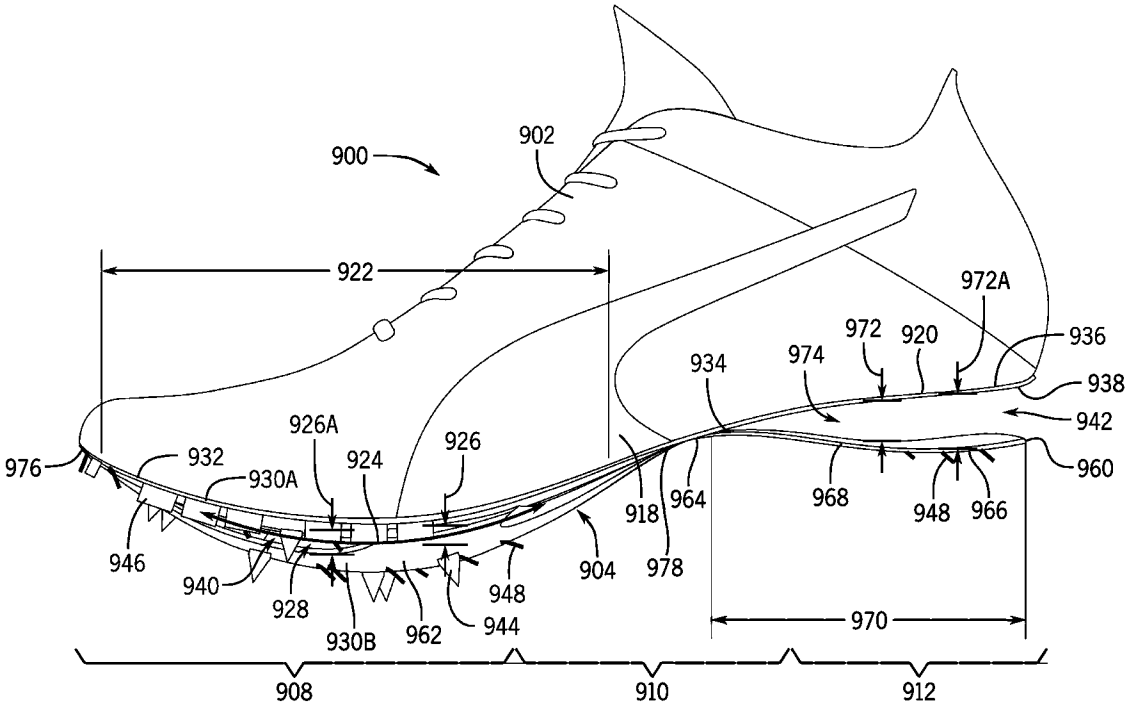
FIG. 25 is a lateral side view of an article of footwear configured as a left shoe that includes an upper and a sole structure, according to an embodiment of the disclosure.
Figure 26:
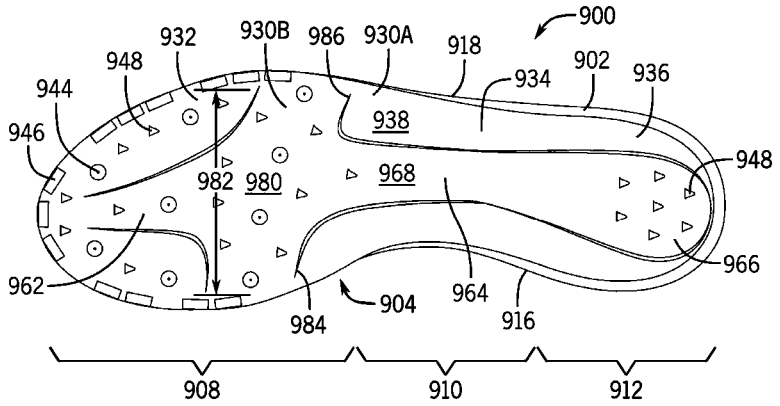
FIG. 26 is a bottom view of the article of footwear of FIG. 25.
Figure 27:
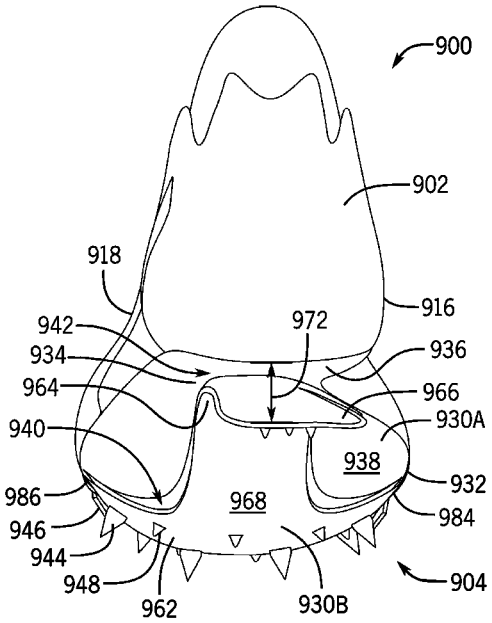
FIG. 27 is a rear view of the article of footwear of FIG. 25.

FIGS. 25-27 show another embodiment of an article of footwear 900. In many aspects, the article of footwear 900 is similar to the article of footwear 100 described above and similar numbering in the 900 series is used for the article of footwear 900. For example, the article of footwear 900 includes an upper 902, a top portion 920, and a sole structure 904 with an outsole 930. The upper 902 defines a forefoot region 908, a midfoot region 910, and a heel region 912. Further, the article of footwear 900 also includes a medial side 916 corresponding to an inside portion of the article of footwear 900 and a lateral side 918 corresponding to an outside portion of the article of footwear 900.

Further, the outsole 930 may be a rigid plate formed from one or more materials to impart durability, wear-resistance, abrasion resistance, or traction to the sole structure 904. The outsole 930 may comprise a PU plastic, such as a TPU material, for example. Other thermoplastic elastomers consisting of block copolymers are also possible. In other embodiments, the outsole 930 can include carbon fiber or high-density wood, for example. The outsole 930 can also include any combination of ground engaging members (e.g., spikes 944, teeth 946, and barbs 948) extending from the outsole 930 to aid in traction.

In some aspects, however, the articles of footwear 100, 900 differ from each other. For example, the outsole 930 includes an upper outsole 930A and a lower outsole 930B. The upper outsole 930A extends along the top portion 920 and can be attached thereto. The upper outsole 930A extends from the forefoot region 908 through the heel region 912 and from the medial side 916 to the lateral side 918. The upper outsole 930A has a front portion 932, a middle portion 934, and a rear portion 936. In some embodiments, the upper outsole 930A can have a uniform thickness.

The lower outsole 930B extends from and along the upper outsole 930A. In some embodiments, the outsole 930, including the upper outsole 930A and the lower outsole 930B, can be integrally formed as a continuous and unitary structure. The lower outsole 930B has a front portion 962, a middle portion 964, and a rear portion 966. In some embodiments, the lower outsole 930B can have a uniform thickness. In some embodiments, the lower outsole 930B can have a thickness substantially the same as the thickness of the upper outsole 930A.

In FIGS. 25 and 27, the article of footwear 900 is shown in a rested or unloaded state. The lower outsole 930B has a cross-like shape with a center section 980 and is connected to the upper outsole 932 at locations at the front portion 962 of the article of footwear 900 at a forefoot coupling point 976A and at the medial and lateral sides 916, 918 in the forefoot region 908 at a medial coupling point 984 and a lateral coupling point 986, respectively. However, it is contemplated that the lower outsole 930B can be attached to the upper outsole 930A in other locations, including, for example, around the periphery of the front portion 932 of the upper outsole 930A. The middle portion 964 of the lower outsole 930B can also be attached to the middle portion 934 of the upper outsole 930A in the midfoot region 910 of the article of footwear 900 at a midfoot coupling point 978. The lower outsole 930B is spaced from the upper outsole 930A between the forefoot coupling point 976, the medial coupling point 984, the lateral coupling point 986, and the midfoot coupling point 978, defining a front spacing 940. The front spacing 940 has a first longitudinal length 922 defined as a straight line distance between the coupling points of the upper outsole 930A and the lower outsole 930B at the forefoot region 908 and at the midfoot region 910. The front spacing 940 also has a latitudinal width 982 defined as a straight line distance between the coupling points of the upper outsole 930A and the lower outsole 930B at the medial and lateral sides 916, 918 (see FIG. 26). In the embodiment shown, when looking from the side (see FIG. 25), the front spacing 940 has a crescent profile, which has a curved length 924 defined as a curved line following the midpoint between the upper outsole 930A and the lower outsole 930B along the first longitudinal length 922 and between the forefoot coupling point 976 and the midfoot coupling point 978. The front spacing 940 also has a first gap height 926 defined by the distance between the upper outsole 920A and the lower outsole 930B.

The first gap height 926 is largest at the center section 980, defining a maximum first gap height 980A, and decreases moving outward from the center section 980 along the first longitudinal length 922 and along the latitudinal width 982. The front spacing 940 also has a front spacing volume 928 as defined by the upper outsole 920A, the lower outsole 930B, and an unseen boundary extending from and between the periphery of the lower outsole 920B and the upper outsole 930A.

As illustrated in FIGS. 25 and 27, the middle portion 964 of the lower outsole 930B extends away from the middle portion 934 of the upper outsole 930A at the connection point in midfoot region 910. The rear portion 966 of the lower outsole 930B is spaced from the rear portion 936 of the upper outsole 930A, defining a rear spacing 942 between the rear portions 936, 966. When viewed from the side, the rear spacing 942 has a wedge profile. As shown, the rear spacing 942 has a second longitudinal length 970 defined as a straight line distance between the midfoot coupling point 978 and a terminal end 960 of the rear portion 936 of the lower outsole 930B. The rear spacing 942 also has a second gap height 972 defined by the distance between the upper outsole 930A and the lower outsole 930B along the second longitudinal length 970. The second gap height 972 increases from the midfoot region 910 toward the heel region 912 along the second longitudinal length 970 and is substantially constant along the heel region 912 beneath where the heel of a user's foot would be received within the upper 902. The greatest height of the second gap height 972 defines a maximum second gap height 972A. The rear spacing 942 also has a rear spacing volume 974 as defined by the upper outsole 930A, the lower outsole 930B, and an unseen boundary extending from and between the periphery of the lower outsole 930B and the upper outsole 930A in the heel region 912.

In the rested state, the first longitudinal length 922 of the article of footwear 900 is greater than the second longitudinal length 970, and the maximum first gap height 926 is smaller than the maximum second gap height 972. In some embodiment, the maximum second gap height 972A can be in a range from about 2.0 times to about 3.0 times the maximum first gap height 926A. In some embodiments, the first longitudinal length 922 can be in a range from about 1.5 times to about 2.0 times the second longitudinal length 970. In some embodiments, the front spacing volume is approximately the same as the rear spacing volume.

In a neutral state (not shown), when a user's foot is received within the upper 902 and the user is standing (i.e., no downward force is being applied to the article of footwear 900 other than the weight of the user), the front spacing volume 928 decreases due to the upper outsole 930A being urged toward the lower outsole 930B under the force of the weight of the user. In some embodiments, for example, the percentage decrease in the front spacing volume 928 from the rested state to the neutral state can be in a range of about 1 percent to about 20 percent, more preferably the percentage decrease in the front spacing volume 928 can be in a range of about 5 percent to about 10 percent. Additionally, the rear spacing volume 974 will be decreased in the neutral state. In some embodiments, for example, the percentage decrease of the rear spacing volume 974 from the rested state to the neutral state can be in a range of about 1 percent to about 50 percent, more preferably the percentage decrease in the rear spacing volume 974 can be in a range of about 10 percent to about 30 percent. Further, the middle portion 964 of the lower outsole 930B contacts the upper outsole 930A in the midfoot region 910 and provides additional support of the arch of the user when in the neutral state.

During use, in an active state, when the lower outsole 930B is in contact with the ground and a user exerts a downward force in the forefoot region 908, the downward force will urge the upper outsole 930A toward the lower outsole 930B and further decrease the front spacing volume 928 while lengthening the first longitudinal length 922 and the latitudinal width 982. In some embodiments, for example, the percentage decrease in the front spacing volume 928 from the rested state to the active state can be in a range of about 10 percent to about 100 percent, more preferably, the percentage decrease in the front spacing volume 928 can be in a range of about 50 percent to about 90 percent. Additionally, in the active state, if a user applies a force to the heel portion 912, the rear spacing volume 974 will experience a percentage decrease from the rested state. For example, the percentage decrease can be in a range of about 90 percent to about 100 percent. Further, the middle portion 964 of the lower outsole 930B can act as a fulcrum when in the active state. For example, a user can strike the heel portion 912 on the ground while walking or running and rotate the foot forward about the middle portion 964 in the midfoot region 910, and continue rotating the foot forward, striking the forefoot region 908 on the ground.

The configuration of the outsole 930, with the front spacing 940 and rear spacing 942 provided between the upper outsole 930A and the lower outsole 930B, can provide force absorption as a user exerts downward force onto the forefoot region 908 and the heel region 912, respectively, of the article of footwear 900 and can also provide a spring effect as the downward force from the user is relieved. This can reduce the severity of the impact to a user's foot and leg joints during use.

As stated above, some combination of ground engaging members (e.g., spikes 944, teeth 946, and barbs 948) can be provided on the outsole 930. Looking at FIG. 26, the distribution of spikes 944, teeth 946, and barbs 948 can be on both the upper outsole 930A and the lower outsole 930B. For example, spikes 944 and barbs 948 can extend from bottom surfaces 938, 968 of the upper and lower outsoles 930A, 930B at the front portions 932, 962. Teeth 946 can be provided around the periphery of the front portion 932 of the upper outsole 930A and barbs 948 can extend from the bottom surface 968 of the lower outsole 930B at the rear portion 966

Figure 28:
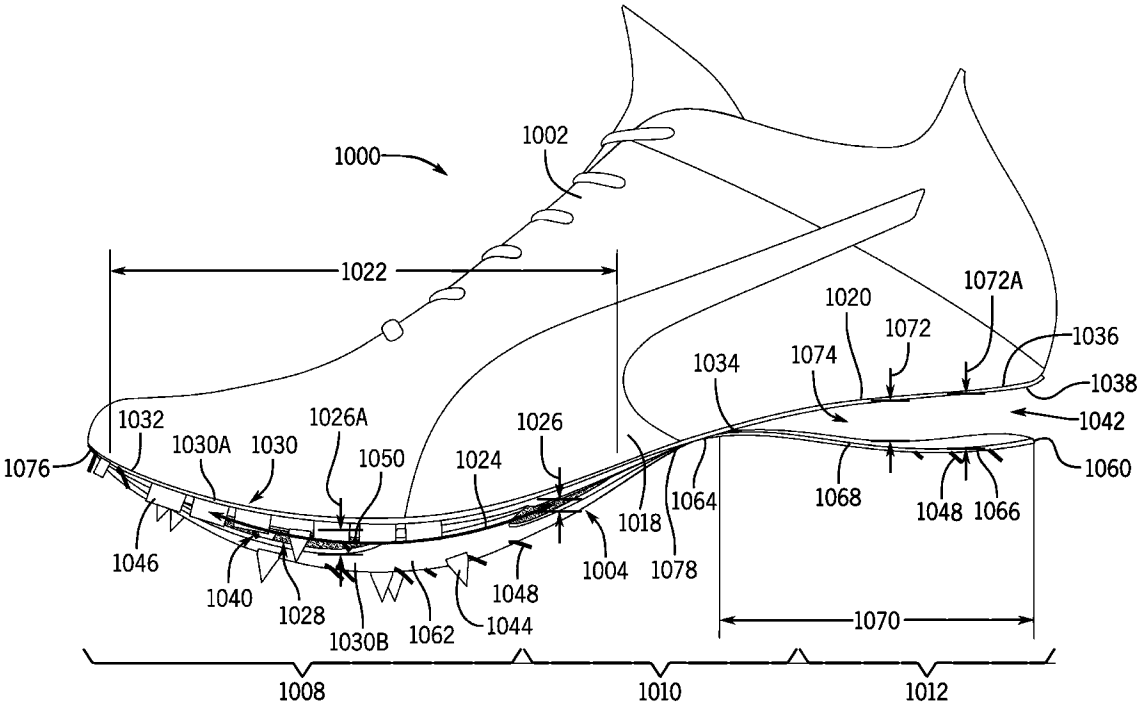
FIG. 28 is a lateral side view of an article of footwear configured as a left shoe that includes an upper and a sole structure, according to an embodiment of the disclosure.
Figure 29:
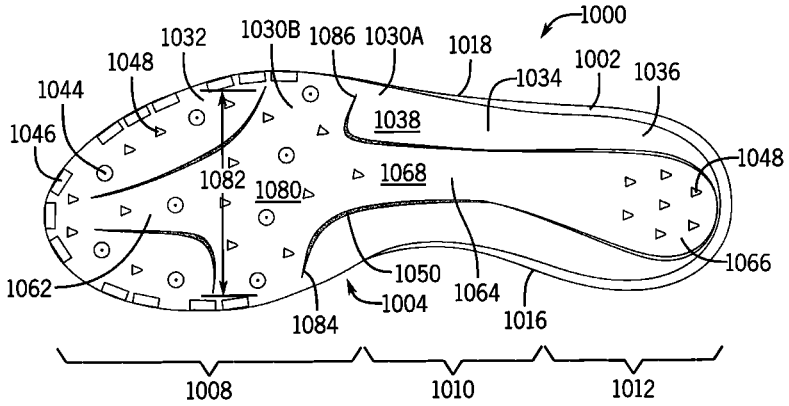
FIG. 29 is a bottom view of the article of footwear of FIG. 28.
Figure 30:
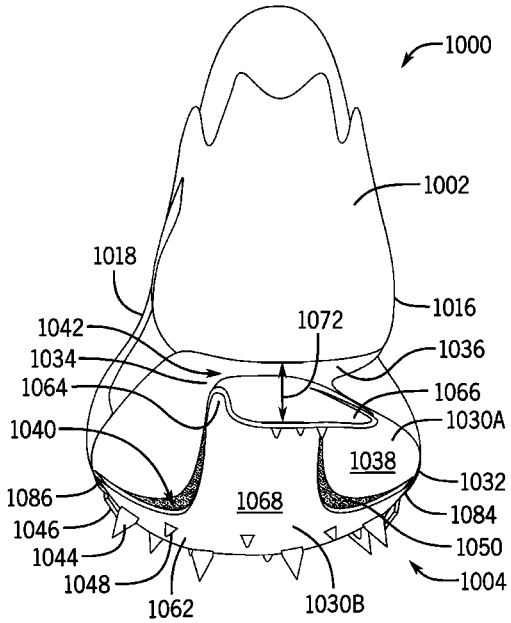
FIG. 30 is a rear view of the article of footwear of FIG. 28.

FIGS. 28-30 show another embodiment of an article of footwear 1000. In many aspects, the article of footwear 1000 is similar to the article of footwear 900 described above and similar numbering in the 1000 series is used for the article of footwear 900. For example, the article of footwear 1000 includes an upper 1002, a top portion 1020, and a sole structure 1004 with an outsole 1030. The outsole 1030 may be a rigid plate formed from one or more materials to impart durability, wear-resistance, abrasion resistance, or traction to the sole structure 1004. The outsole 1030 has an upper outsole 1030A and a lower outsole 1030B. The upper outsole 1030A has a front portion 1032, a middle portion 1034, and a rear portion 1036 and the lower outsole 1030B has a front portion 1062, a middle portion 1064, a rear portion 1066 with a terminal end 1060, and has a cross-like shape with a center section 1080. The upper 1002 defines a forefoot region 1008, a midfoot region 1010, and a heel region 1012. The upper and lower outsoles 1030A, 1030B define a front spacing 1040, a first longitudinal length 1022, a latitudinal width 1082, a curved length 1024, a first gap height 1026 with a maximum first gap height 1026A, a front spacing volume 1028, a rear spacing 1042, a second longitudinal length 1070, a second gap height 1072 with a maximum second gap height 1072A, and a rear spacing volume 1074. Further, the article of footwear 1000 also includes a medial side 1016 corresponding to an inside portion of the article of footwear 1000 and a lateral side 1018 corresponding to an outside portion of the article of footwear 1000. The lower outsole 1030B can be coupled to the upper outsole 1030A at a forefoot coupling point 1076, a medial coupling point 1084, a lateral coupling point 1086, and a midfoot coupling point 1078. Additionally, at least one ground engaging member (e.g., a spike 1044, a tooth 1046, or a barb 1048) can extend from either or both bottom surfaces 1038, 1068 of the upper and lower outsoles 1030A, 1030B.

In some aspects, however, the articles of footwear 900, 1000 differ from each other. For example, the sole structure 1004 includes a front cushioning member 1050. The front cushioning member 1050 may be positioned within the front spacing 1040 between the lower outsole 1030B and the upper outsole 1030A and can extend across the front portion 1062 of the lower outsole 1030B. In some embodiments, for example, the volume of the front cushioning member 1050 can be in a range of about 85 percent to about 95 percent of the front spacing volume 1028. The front cushioning member 1050 can be formed from any of the materials and processes described above with respect to the front cushioning member 250 of the article of footwear 200.

Figure 31:
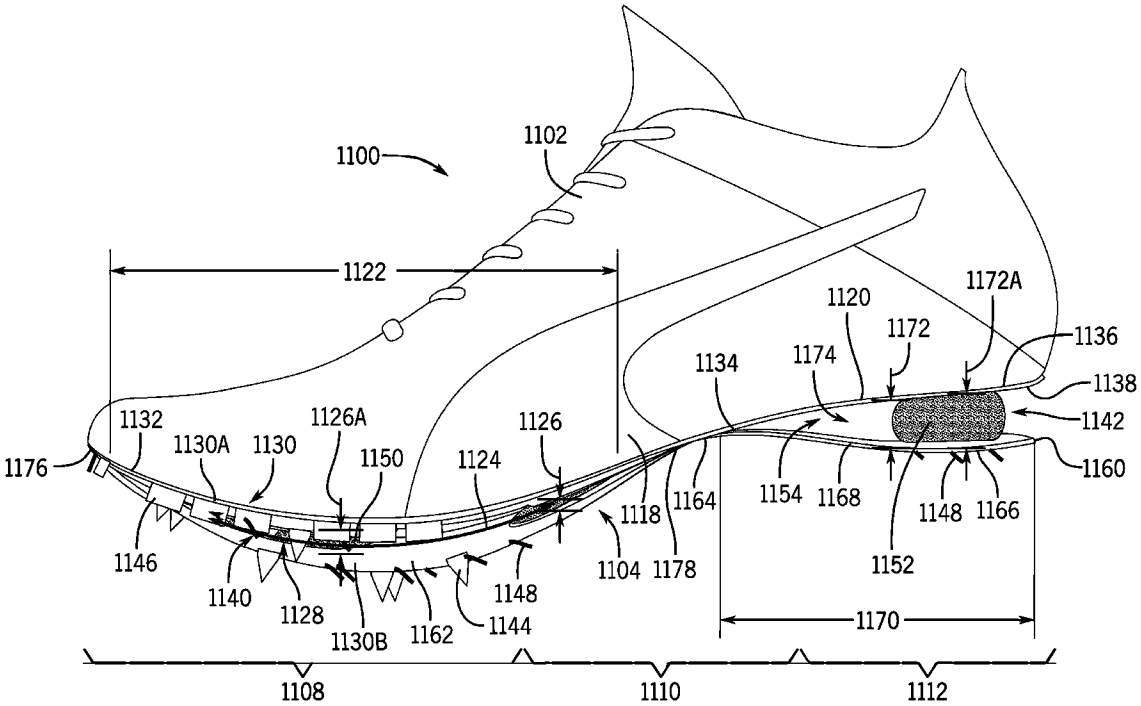
FIG. 31 is a lateral side view of an article of footwear configured as a left shoe that includes an upper and a sole structure, according to an embodiment of the disclosure.
Figure 32:
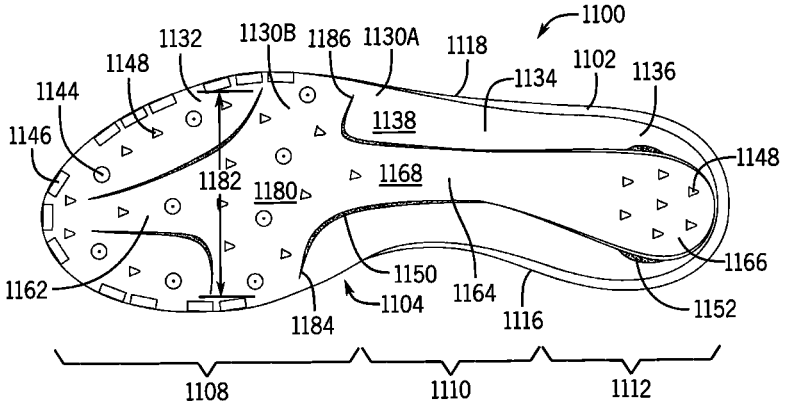
FIG. 32 is a bottom view of the article of footwear of FIG. 31.
Figure 33:
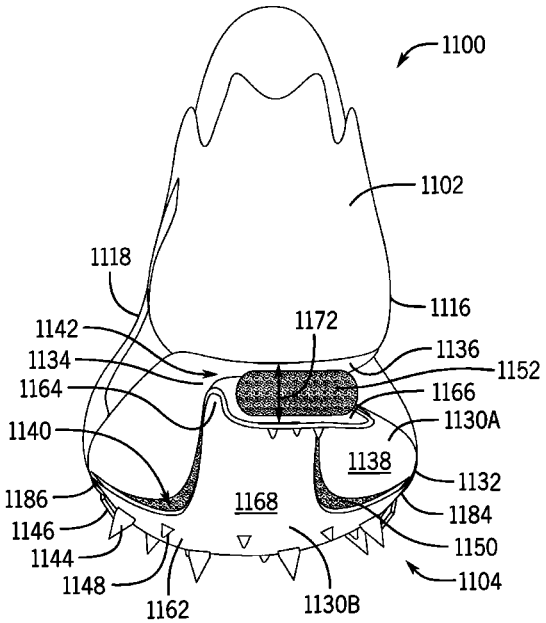
FIG. 33 is a rear view of the article of footwear of FIG. 31.

The sole structure 1004 as described with the front cushioning member 1050 provided within the front spacing 1040 of the outsole 1030 can provide spring and dampening properties. This can reduce the severity of the impact to a user's foot and leg joints during use. It is contemplated that the location of the lowest point of the center section 1080 (e.g., at the location of the maximum first gap height 1026A) can be positioned within the outsole 1030 depending on the running behavior of the athlete, such that the lowest point is always the first ground contact spot. Doing so can bundle the force and energy in a single spot rather than distributing the energy and force over the width of the outsole 1030. This could be especially beneficial for runners with flat feet or similar foot issues FIGS. 31-33 show another embodiment of an article of footwear 1100. In many aspects, the article of footwear 1100 is similar to the article of footwear 1000 described above and similar numbering in the 1100 series is used for the article of footwear 1100. For example, the article of footwear 1100 includes an upper 1102, a top portion 1120, and a sole structure 1104 with an outsole 1130. The outsole 1130 may be a rigid plate formed from one or more materials to impart durability, wear-resistance, abrasion resistance, or traction to the sole structure 1104. The outsole 1130 has an upper outsole 1130A and a lower outsole 1130B. The upper outsole 1130A has a front portion 1132, a middle portion 1134, and a rear portion 1136 and the lower outsole 1030B has a front portion 1162, a middle portion 1164, and a rear portion 1166 with a terminal end 1160, and has a cross-like shape with a center section 1180. The upper 1102 defines a forefoot region 1108, a midfoot region 1110, and a heel region 1112. The upper and lower outsoles 1130A, 1130B define a front spacing 1140, a first longitudinal length 1122, a latitudinal width 1182, a curved length 1124, a first gap height 1126 with a maximum first gap height 1126A, a front spacing volume 1128, a rear spacing 1142, a second longitudinal length 1170, a second gap height 1172 with a maximum second gap height 1172A, and a rear spacing volume 1174. Further, the article of footwear 1100 also includes a medial side 1116 corresponding to an inside portion of the article of footwear 1100 and a lateral side 1118 corresponding to an outside portion of the article of footwear 1100. The lower outsole 1130B can be coupled to the upper outsole 1130A at a forefoot coupling point 1176, a medial coupling point 1184, a lateral coupling point 1186, and a midfoot coupling point 1178. Additionally, at least one ground engaging member (e.g., a spike 1144, a tooth 1146, or a barb 1148) can extend from either or both bottom surfaces 1138, 1168 of the upper and lower outsoles 1130A, 1130B.

Further, the sole structure 1104 includes a front cushioning member 1150. The front cushioning member 1150 is positioned within the front spacing 1140 between the lower outsole 1130B and the upper outsole 1130A and extends across the lower outsole 1130B. The front cushioning member 1150 can be formed from any of the materials and processes described above with respect to the front cushioning member 250 of the article of footwear 200.

In some aspects, however, the articles of footwear 1000, 1100 differ from each other. For example, the sole structure 1104 includes a rear cushioning member 1152 similar to that of the front cushioning member 1050 in the article of footwear 1000. The rear cushioning member 1152 may be positioned within the rear spacing 1142 between the lower outsole 1130B and the upper outsole 1130A. The rear cushioning member 1152 extends across a portion of the rear portion 1166 of the lower outsole 1130B. In some embodiments, for example, the volume of the rear cushioning member 1152 can be in a range of about 35 percent to about 50 percent of the rear spacing volume 1174. In some embodiments, the rear cushioning member 1152 can define a rear spacing pocket 1154 adjacent the front side of the rear cushioning member 1152. The rear spacing pocket 1154 extends longitudinally between the midfoot coupling point 1178 and the rear cushioning member 1152, latitudinally between the medial side 1116 and the lateral side 1118, and vertically between the upper outsole 1130A and the lower outsole 1130B. As shown in FIGS. 31 and 33, the rear cushioning member 1152 is positioned directly beneath where the heel of a user's foot would be received within the upper 1102. For example, the rear cushioning member 1152 is positioned within the rear spacing pocket 1154 at the location of and adjacent the maximum second gap height 1172A. The rear cushioning member 1152 can be formed from any of the materials and processes described above with respect to the front cushioning member 250 of the article of footwear 200.

The sole structure 1104 as described with the front cushioning member 1150 provided within the front spacing 1140 of the outsole 1130 and the rear cushioning member 1152 provided within the rear spacing 1142 of the outsole 1130 can provide spring and dampening properties, which can reduce the severity of the impact to a user's foot and leg joints during use.

FIGS. 34-48 show other embodiments of an article of footwear 1200, 1300, 1400, 1500, 1600. In many aspects, the articles of footwear 1200, 1300, 1400, 1500, 1600 are similar to the articles of footwear 900, 1000, 1100 described above and similar numbering in the 1200, 1300, 1400, 1500, 1600 series is used for the articles of footwear 1200, 1300, 1400, 1500, 1600. For example, each of the articles of footwear 1200, 1300, 1400, 1500, 1600 include an upper 1202, 1302, 1402, 1502, 1602; a top portion 1220, 1320, 1420, 1520, 1620; and a sole structure 1204, 1304, 1404, 1504, 1604 with an outsole 1230, 1330, 1430, 1530, 1630. Each outsole 1230, 1330, 1430, 1530, 1630 may be a rigid plate and has an upper outsole 1230A, 1330A, 1430A, 1530A, 1630A with a front portion 1232, 1332, 1432, 1532, 1632; a middle portion 1234, 1334, 1434, 1534, 1634; and a rear portion 1236, 1336, 1436, 1536, 1636 and a lower outsole 1230B, 1330B, 1430B, 1530B, 1630B with a front portion 1262, 1362, 1462, 1562, 1662; a middle portion 1264, 1364, 1464, 1564, 1664; and a rear portion 1266, 1366, 1466, 1566, 1666 with a terminal end 1260, 1360, 1460, 1560, 1660. The upper outsole 1230A, 1330A, 1430A, 1530A, 1630A extends along the top portion 1220, 1320, 1420, 1520, 1620 and can be attached thereto. The lower outsole 1230B, 1330B, 1430B, 1530B, 1630B having a cross-like shape with a center section 1280, 1380, 1480, 1580, 1680. Additionally, each article of footwear 1200, 1300, 1400, 1500, 1600 defines a forefoot region 1208, 1308, 1408, 1508, 1608; a midfoot region 1210, 1310, 1410, 1510, 1610; and a heel region 1212, 1312, 1412, 1512, 1612 and has a medial side 1216, 1316, 1416, 1516, 1616 and a lateral side 1218, 1318, 1418, 1518, 1618. The lower outsole 1230B, 1330B, 1430B, 1530B, 1630B can be coupled to the upper outsole 1230A, 1330A, 1430A, 1530A, 1630A at a forefoot coupling point 1276, 1376, 1476, 1576, 1676; a medial coupling point 1284, 1384, 1484, 1584, 1684; a lateral coupling point 1286, 1386, 1486, 1586, 1686; and a midfoot coupling point 1278, 1378, 1478, 1578, 1678.

Further, each article of footwear 1200, 1300, 1400, 1500, 1600 defines a front spacing 1240, 1340, 1440, 1540, 1640; a first longitudinal length 1222, 1322, 1422, 1522, 1622; latitudinal width 1282, 1382, 1482, 1582, 1682; a curved length 1224, 1324, 1424, 1524, 1624; a first gap height 1226, 1326, 1426, 1526, 1626 with a maximum first gap height 1226A, 1326A, 1426A, 1526A, 1626A; a front spacing volume 1228, 1328, 1428, 1528, 1628; a rear spacing 1242, 1342, 1442, 1542, 1642; a second longitudinal length 1270, 1370, 1470. 1570, 1670; a second gap height 1272, 1372, 1472, 1572, 1672 with a maximum second gap height 1272A, 1372A, 1472A, 1572A, 1672A; and a rear spacing volume 1274, 1374, 1474, 1574, 1674. Each article of footwear 1200, 1300, 1400, 1500, 1600 also has at least one ground engaging member (e.g., a spike 1244, 1344, 1444, 1544, 1644; a tooth 1246, 1346, 1446, 1546, 1646; or a barb 1248, 1348, 1448, 1548) extending from at least one of a bottom surface 1238, 1338, 1438, 1538, 1638 of the upper outsole 1230A, 1330A, 1430A, 1530A, 1630A or a bottom surface 1268, 1368, 1468, 1568, 1668 of the lower outsole 1230B, 1330B, 1430B, 1530B, 1630B. However, each embodiment differs in the inclusion and arrangement of the front and rear cushioning members. When included, however, the materials comprising and processes for making the front and rear cushioning members are as described above.

Figure 34:
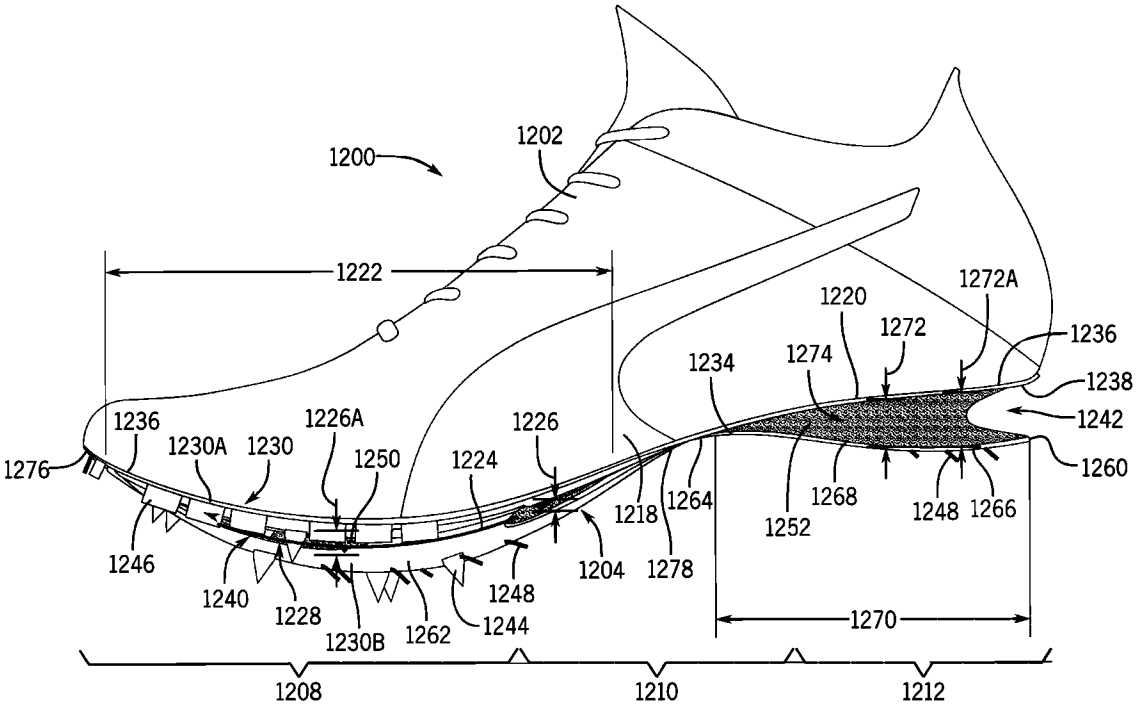
FIG. 34 is a lateral side view of an article of footwear configured as a left shoe that includes an upper and a sole structure, according to an embodiment of the disclosure.
Figure 35:
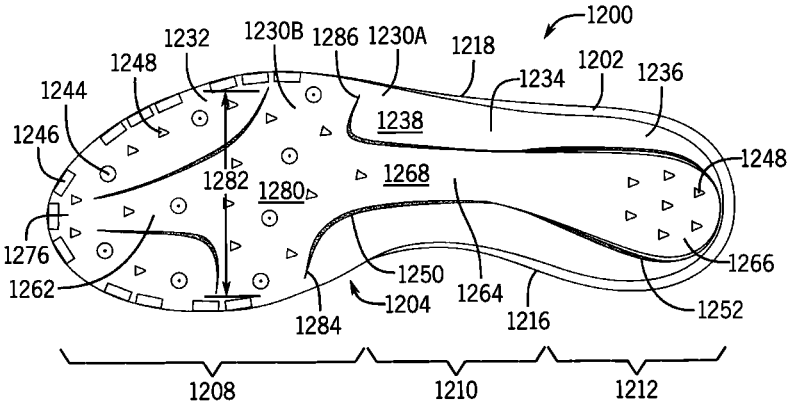
FIG. 35 is a bottom view of the article of footwear of FIG. 34.
Figure 36:
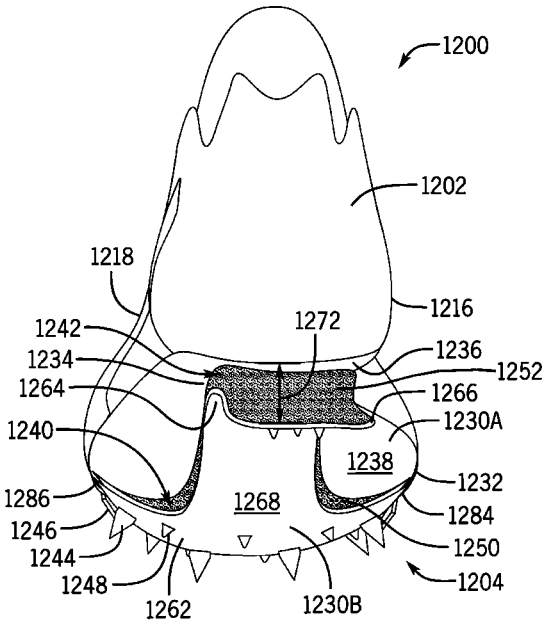
FIG. 36 is a rear view of the article of footwear of FIG. 34.

In FIGS. 34-36, illustrating the article of footwear 1200, both a front cushioning member 1250 and a rear cushioning member 1252 are provided. The front cushioning member 1250 is positioned within the front spacing 1240 between the lower outsole 1230B and the upper outsole 1230A and extends across the front portion 1262 of the lower outsole 1230B. In some embodiments, for example, the volume of the front cushioning member 1250 can be in a range of about 85 percent to about 95 percent of the front spacing volume 1228. Further, the rear cushioning member 1252 is positioned within the rear spacing 1242 between the lower outsole 1230B and the upper outsole 1230A and extends across the rear portion 1266 of the lower outsole 1230B. In some embodiments, for example, the volume of the rear cushioning member 1252 can be in a range of about 70 percent to about 95 percent of the rear spacing volume 1274.

Figure 37:
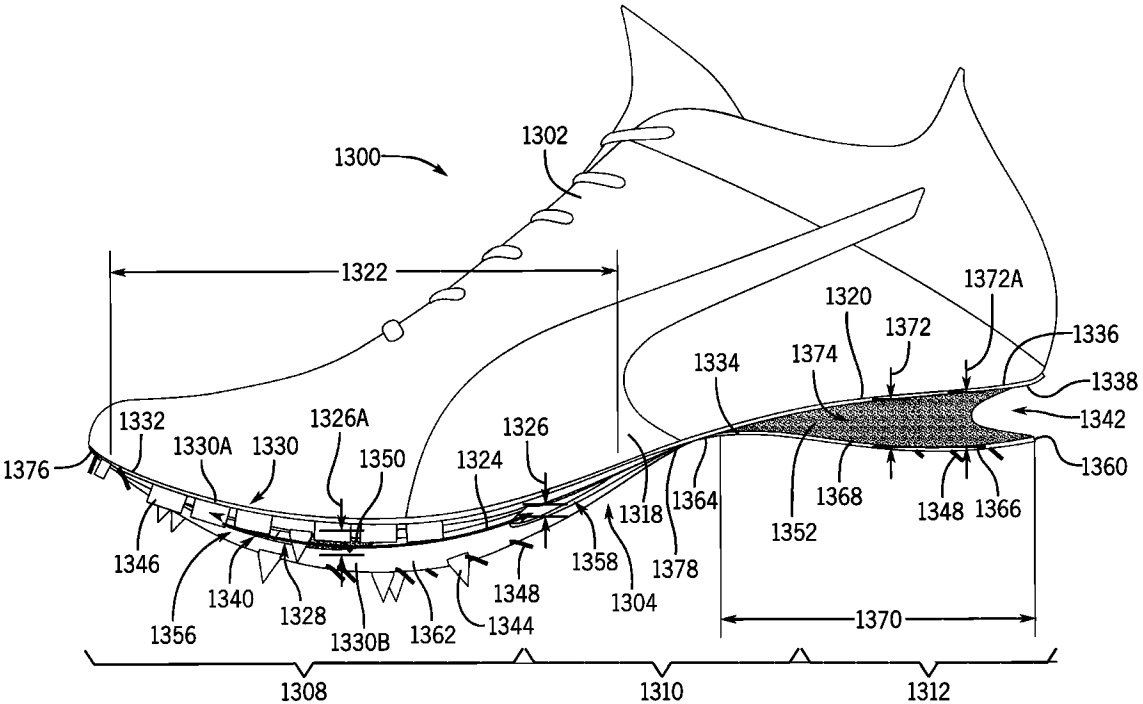
FIG. 37 is a lateral side view of an article of footwear configured as a left shoe that includes an upper and a sole structure, according to an embodiment of the disclosure.
Figure 38:
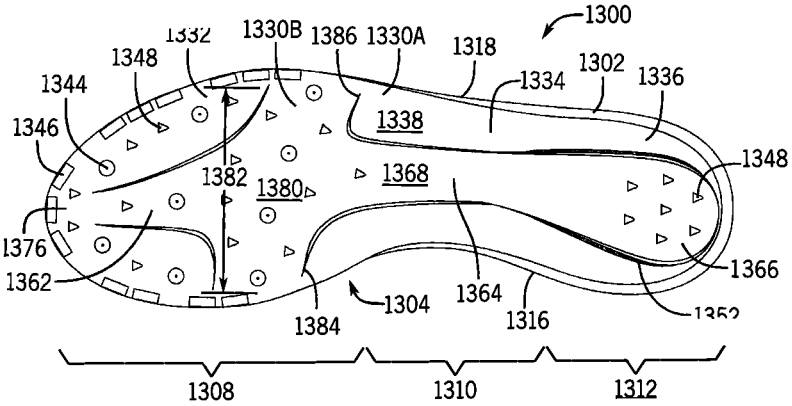
FIG. 38 is a bottom view of the article of footwear of FIG. 37.
Figure 39:
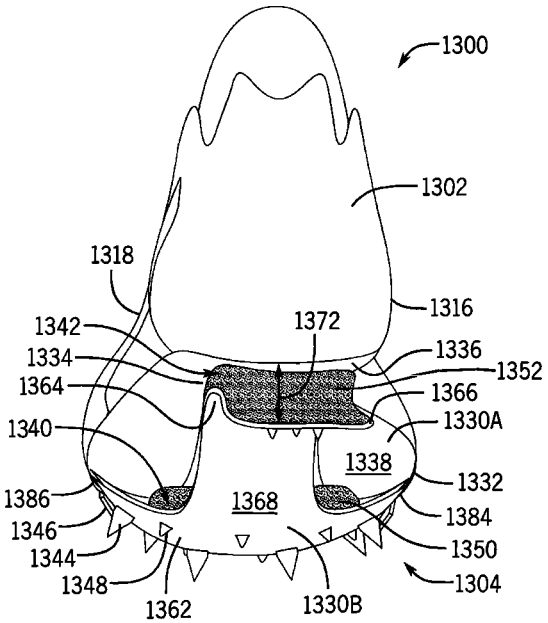
FIG. 39 is a rear view of the article of footwear of FIG. 37.

In FIGS. 37-39, the article of footwear 1300 is shown with both a front cushioning member 1350 and a rear cushioning member 1352. The front cushioning member 1350 is positioned within the front spacing 1340 between the lower outsole 1330B and the upper outsole 1330A and extends across a portion of the front portion 1362 of the lower outsole 1330B. In some embodiments, for example, the volume of the front cushioning member 1350 can be in a range of about 35 percent to about 50 percent of the front spacing volume 1328. In some embodiments, the front cushioning member 550 can define a first front spacing pocket 1356 and a second front spacing pocket 1358 adjacent the front and rear sides of the front cushioning member 1350, respectively. The first front spacing pocket 1356 extends longitudinally between the forefoot coupling point 1376 and the front cushioning member 1350, latitudinally between the medial side 1316 and the lateral side 1318, and vertically between the upper outsole 1330A and the lower outsole 1330B. The second front spacing pocket 1358 extends longitudinally between the front cushioning member 1350 and the midfoot coupling point 1378, latitudinally between the medial side 1316 and the lateral side 1318, and vertically between the upper outsole 1330A and the lower outsole 1330B. As shown, the front cushioning member 1350 can be positioned directly beneath where the ball of a user's foot would be received within the upper 1302. For example, the front cushioning member 1350 is positioned within the front spacing pocket 1356 at the location of and adjacent the maximum first gap height 1326A. Further, the rear cushioning member 1352 is positioned within the rear spacing 1342 between the lower outsole 1330B and the upper outsole 1330A and extends across the rear portion 1366 of the lower outsole 1330B. In some embodiments, for example, the volume of the rear cushioning member 1352 can be in a range of about 70 percent to about 95 percent of the rear spacing volume 1374.

Figure 40:
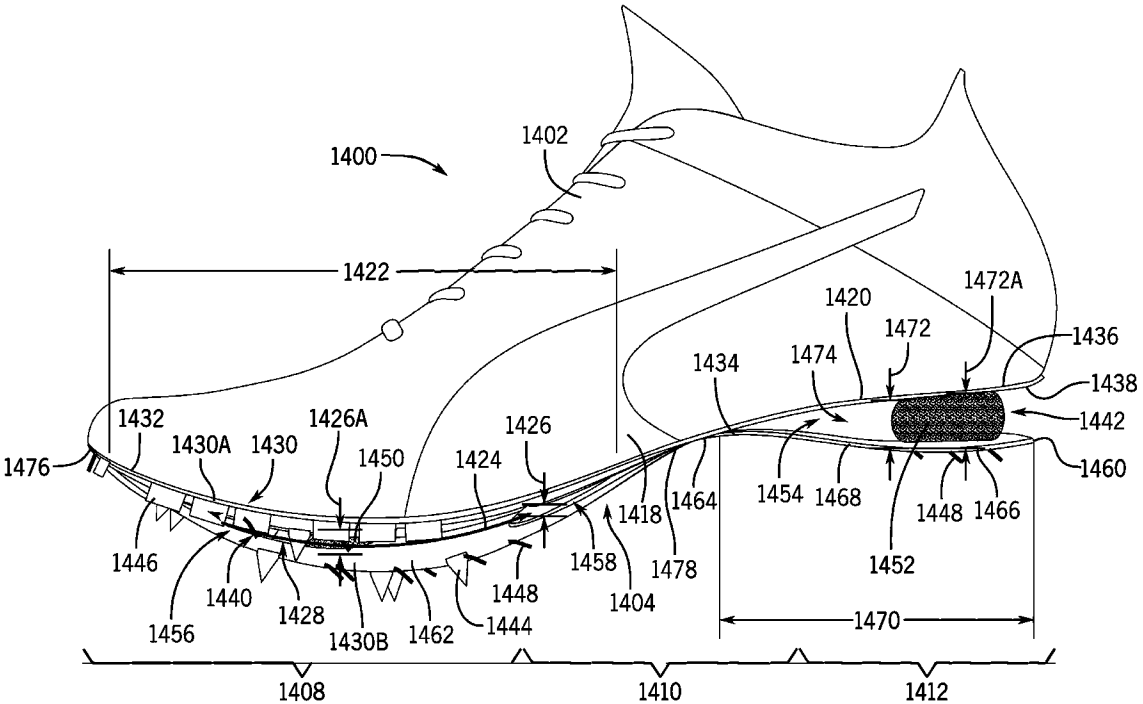
FIG. 40 is a lateral side view of an article of footwear configured as a left shoe that includes an upper and a sole structure, according to an embodiment of the disclosure.
Figure 41:
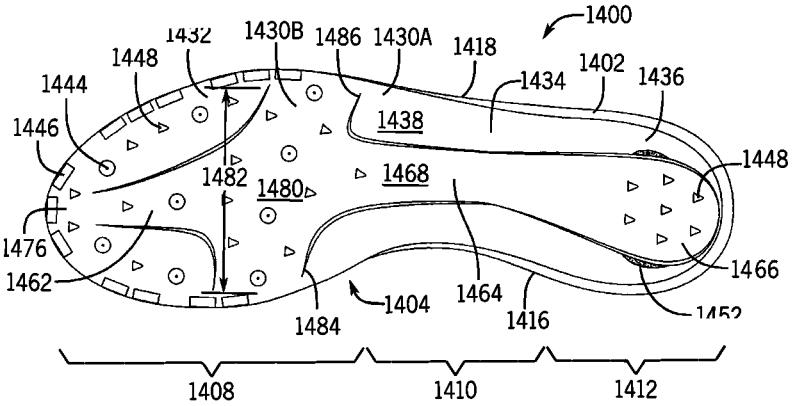
FIG. 41 is a bottom view of the article of footwear of FIG. 40.
Figure 42:
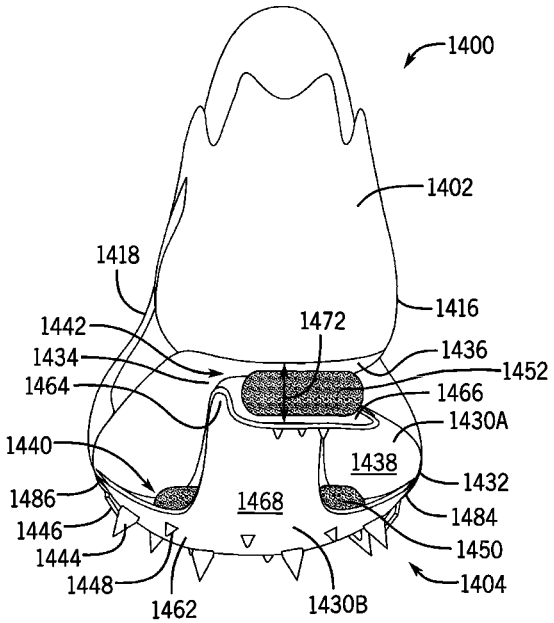
FIG. 42 is a rear view of the article of footwear of FIG. 40.

FIGS. 40-42 show the article of footwear 1400 with both a front cushioning member 1450 and a rear cushioning member 1452. The front cushioning member 1450 is positioned within the front spacing 1440 between the lower outsole 1430B and the upper outsole 1430A and extends across a portion of the front portion 1462 of the lower outsole 1430B. In some embodiments, for example, the volume of the front cushioning member 1450 can be in a range of about 35 percent to about 50 percent of the front spacing volume 1428. In some embodiments, the front cushioning member 1450 can define a first front spacing pocket 1456 and a second front spacing pocket 1458 adjacent the front and rear sides of the front cushioning member 1450, respectively. The first front spacing pocket 1456 extends longitudinally between the forefoot coupling point 1476 and the front cushioning member 1450, latitudinally between the medial side 1416 and the lateral side 1418, and vertically between the upper outsole 1430A and the lower outsole 1430B. The second front spacing pocket 1458 extends longitudinally between the front cushioning member 1450 and the midfoot coupling point 1478, latitudinally between the medial side 1416 and the lateral side 1418, and vertically between the upper outsole 1430A and the lower outsole 1430B. As shown, the front cushioning member 1450 can be positioned directly beneath where the ball of a user's foot would be received within the upper 1402. For example, the front cushioning member 1450 is positioned within the front spacing pocket 1456 at the location of and adjacent the maximum first gap height 1426A. The rear cushioning member 1452 is positioned within the rear spacing 1442 between the lower outsole 1430B and the upper outsole 1430A. The rear cushioning member 1452 extends across a portion of the rear portion 1466 of the lower outsole 1430B. In some embodiments, for example, the volume of the rear cushioning member 1452 can be in a range of about 35 percent to about 50 percent of the rear spacing volume 1474. In some embodiments, the rear cushioning member 1452 can define a rear spacing pocket 1454 adjacent the front side of the rear cushioning member 1452. The rear spacing pocket 1454 extends longitudinally between the midfoot coupling point 1478 and the rear cushioning member 1452, latitudinally between the medial side 1416 and the lateral side 1418, and vertically between the upper outsole 1430A and the lower outsole 1430B. As shown, the rear cushioning member 1452 is positioned directly beneath where the heel of a user's foot would be received within the upper 1402. For example, the rear cushioning member 1452 is positioned within the rear spacing pocket 1454 at the location of and adjacent the maximum second gap height 1472A.

Figure 43:
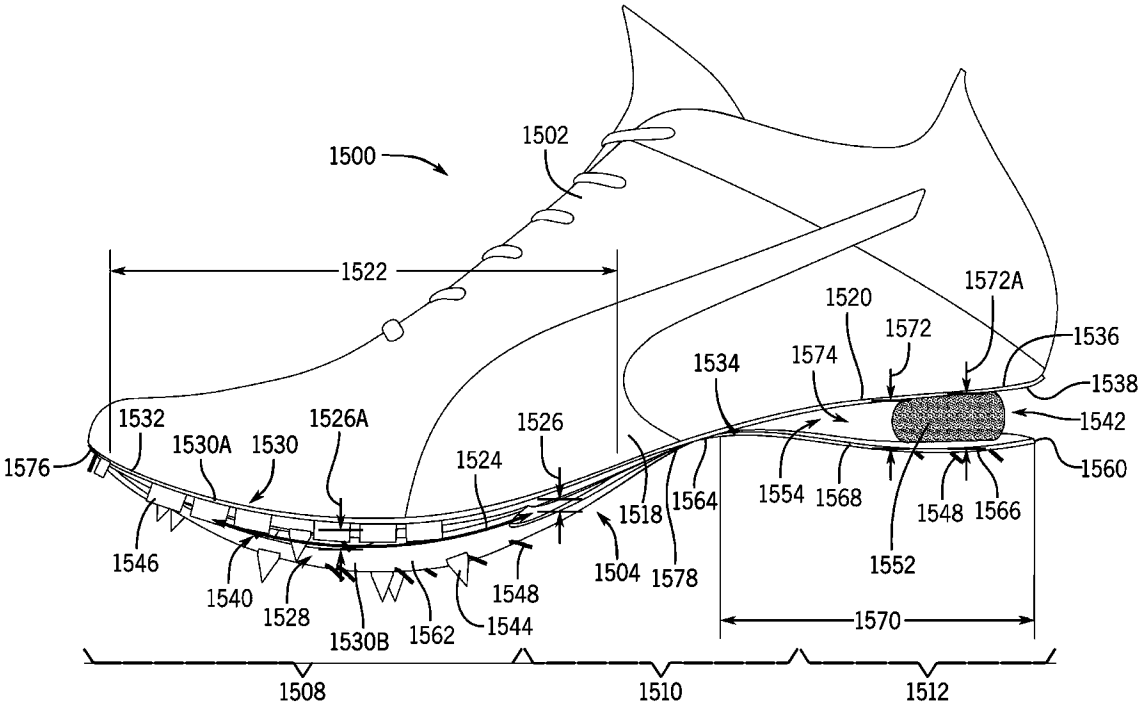
FIG. 43 is a lateral side view of an article of footwear configured as a left shoe that includes an upper and a sole structure, according to an embodiment of the disclosure.
Figure 44:
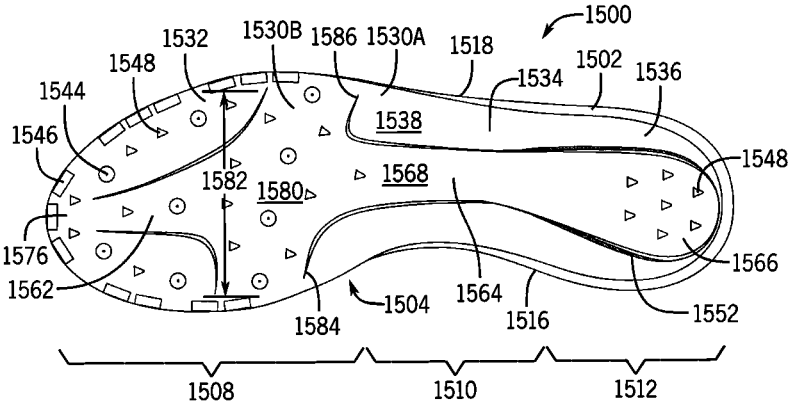
FIG. 44 is a bottom view of the article of footwear of FIG. 43.
Figure 45:
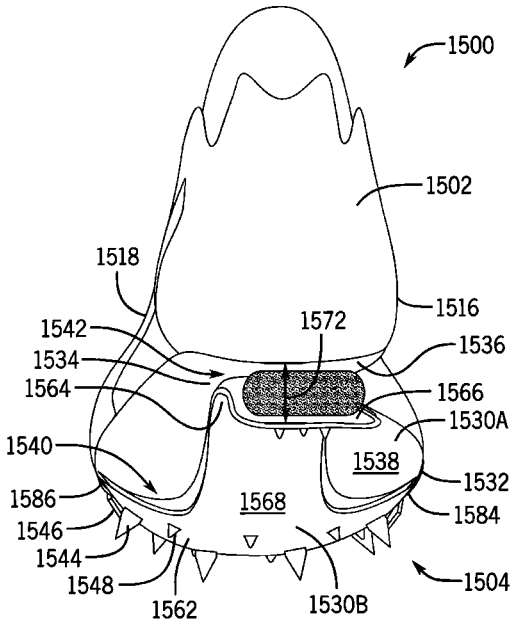
FIG. 45 is a rear view of the article of footwear of FIG. 43.

The article of footwear 1500 is shown in FIGS. 43-45. The article of footwear 1500 does not have a front cushioning member within the front spacing 1540 but does have a rear cushioning member 1552 within the rear spacing 1542. The rear cushioning member 1552 is positioned within the rear spacing 1542 between the lower outsole 1530B and the upper outsole 1530A. The rear cushioning member 1552 extends across a portion of the rear portion 1566 of the lower outsole 1530B. In some embodiments, for example, the volume of the rear cushioning member 1552 can be in a range of about 35 percent to about 50 percent of the rear spacing volume 1574. In some embodiments, the rear cushioning member can define a rear spacing pocket 1554 adjacent the front side of the rear cushioning member 1552.

The rear spacing pocket 1554 extends longitudinally between the midfoot coupling point 1578 and the rear cushioning member 1552, latitudinally between the medial side 1516 and the lateral side 1518, and vertically between the upper outsole 1530A and the lower outsole 1530B. As shown, the rear cushioning member 1552 is positioned directly beneath where the heel of a user's foot would be received within the upper 1502. For example, the rear cushioning member 1552 is positioned within the rear spacing pocket 1554 at the location of and adjacent the maximum second gap height 1572A.

Figure 46:
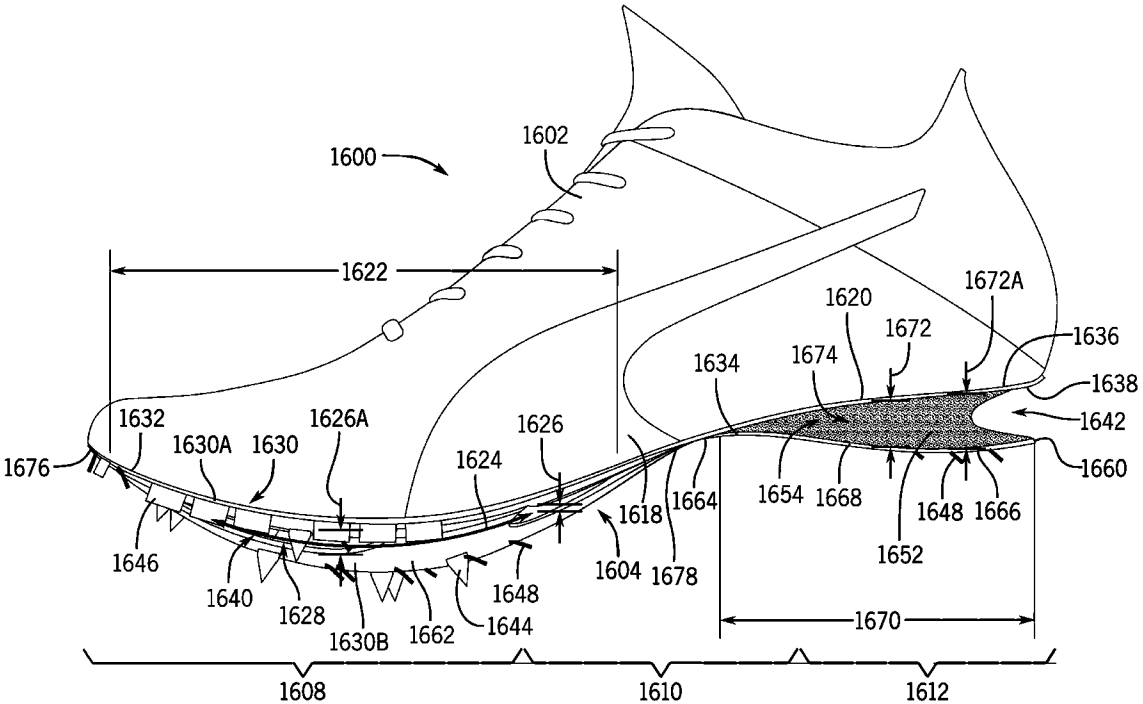
FIG. 46 is a lateral side view of an article of footwear configured as a left shoe that includes an upper and a sole structure, according to an embodiment of the disclosure.
Figure 47:
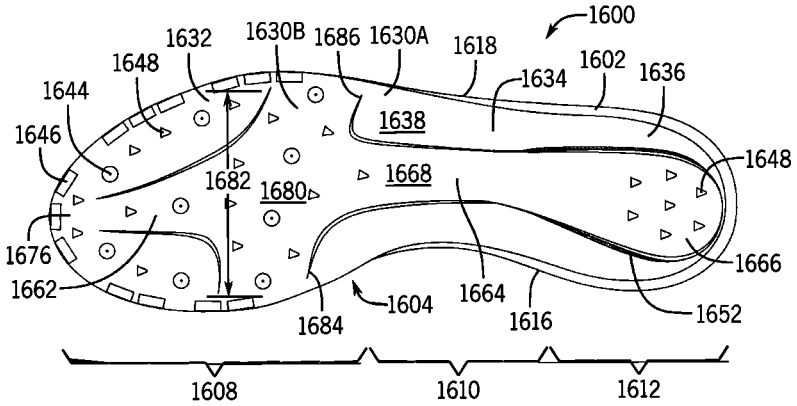
FIG. 47 is a bottom view of the article of footwear of FIG. 46.
Figure 48:
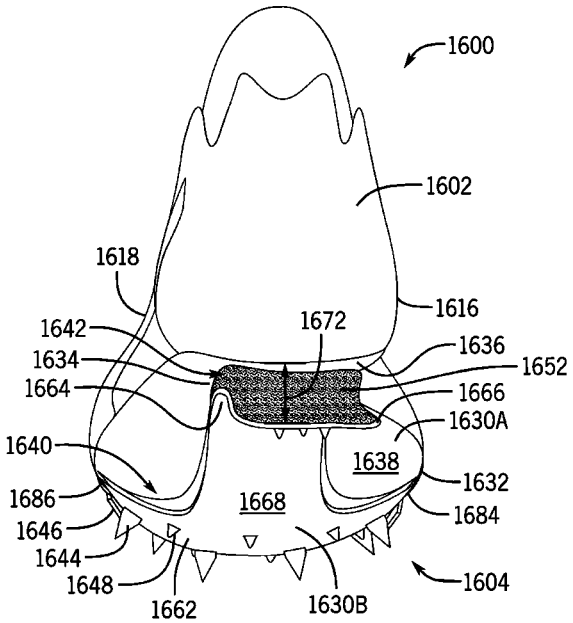
FIG. 48 is a rear view of the article of footwear of FIG. 46.

FIGS. 46-48 illustrate the article of footwear 1600. The article of footwear 1600 does not have a front cushioning member within the front spacing 1640 but does have a rear cushioning member 1652 within the rear spacing 1642. The rear cushioning member 1652 is positioned within the rear spacing 1642 between the lower outsole 1630B and the upper outsole 1630A and extends across the rear portion 1666 of the lower outsole 1630B. In some embodiments, for example, the volume of the rear cushioning member 1652 can be in a range of about 70 percent to about 95 percent of the rear spacing volume 1674.

FIGS. 49-59 illustrates the article of footwear 1700. In many aspects, the article of footwear 1700 is similar to the article of footwear 1400 described above and similar numbering in the 1700 series is used for the article of footwear 1700. For example, the article of footwear 1700 can include an upper 1702 (see FIGS. 54-59), a top portion 1720, and a sole structure 1704 with an outsole 1730. The upper 1702 defines a forefoot region 1708, a midfoot region 1710, and a heel region 1712. Further, the article of footwear 1700 also includes a medial side 1716 corresponding to an inside portion of the article of footwear 1700 and a lateral side 1718 corresponding to an outside portion of the article of footwear 1700. Additionally, the sole structure 1704 includes an outsole 1730, which may be a rigid plate formed from one or more materials to impart durability, wear-resistance, abrasion resistance, or traction to the sole structure 1704. The outsole 1730 has an upper outsole 1730A and a lower outsole 1730B, the space therebetween in the forefoot and heel regions 1708, 1712 defining a front spacing 1740 and a rear spacing 1742, respectively. The upper outsole 1730A has a front portion 1732, a middle portion 1734, and a rear portion 1736 and the lower outsole 1730B has a front portion 1762, and a rear portion 1766. The upper outsole 1730 extends along the top portion 1720 and can be attached thereto. A front cushioning member 1750 is located in the front spacing 1740, and the front spacing 1740 further defines a first longitudinal length 1722, a curved length 1724, a first gap height 1726 with a maximum first gap height 1726A, and a front spacing volume 1728. A rear cushioning member 1752 is located in the rear spacing 1742, and the rear spacing 1742 further defines a second longitudinal length 1770, a second gap height 1772 with a maximum second gap height 1772A, and a rear spacing volume 1774.

In some aspects, however, the articles of footwear 1700, 1400 differ from each other. For example, the lower outsole 1730B is formed from a front lower outsole segment 1790 and a rear lower outsole segment 1792 coupled to the upper outsole 1730A at the front portion 1732 and the rear portion 1736, respectively. Further, at least one ground engaging member (e.g., a large spike 1744 or a small spike 1794) can extend from the bottom surface 1768 of the lower outsole 1730B.

Figure 51:
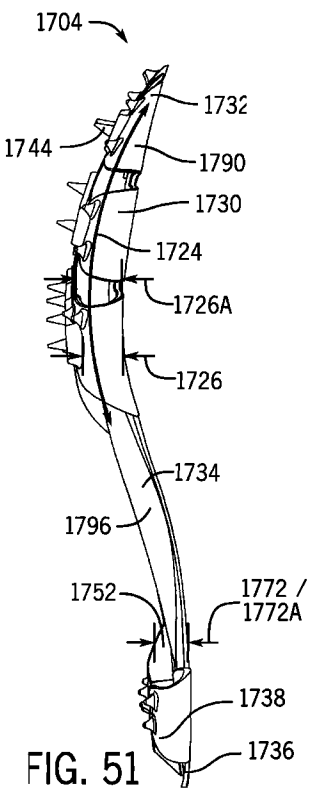
FIG. 51 is a lateral side view of the sole structure of FIG. 49.
Figure 50:
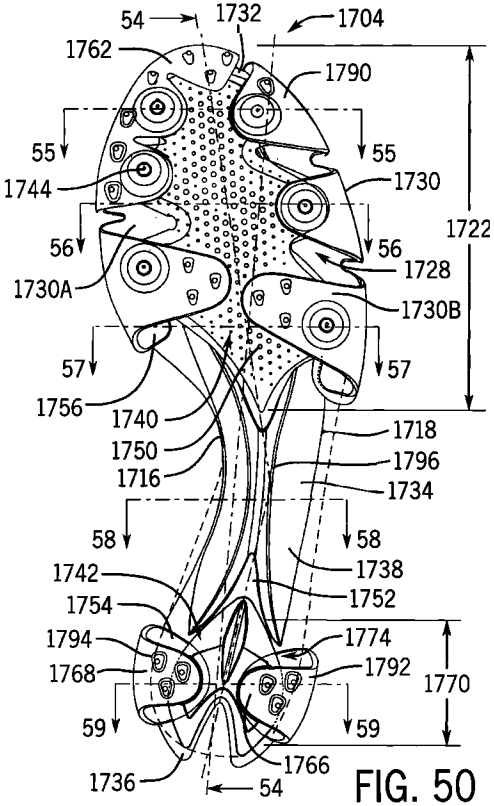
FIG. 50 is a bottom view of the sole structure of FIG. 49.
Figure 49:
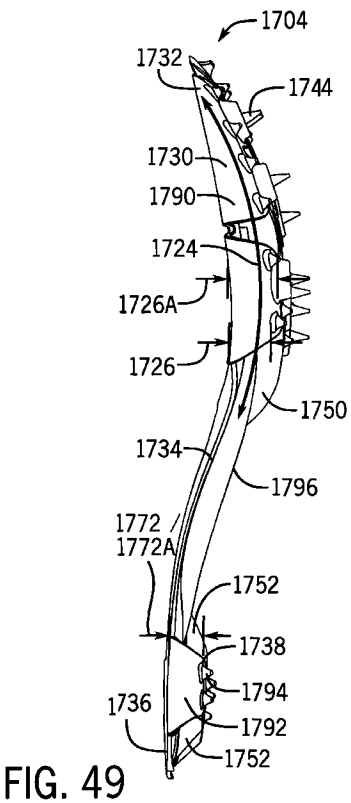
FIG. 49 is a medial side view of a sole structure for an article of footwear configured as a left shoe that includes an upper and a sole structure, according to another embodiment of the disclosure.
Figure 52:
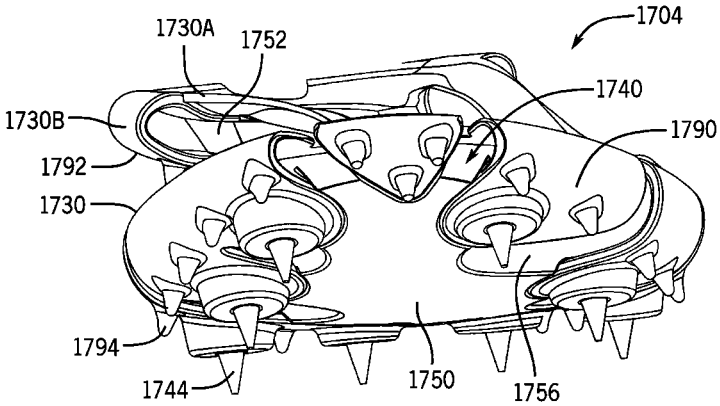
FIG. 52 is a front view of the sole structure of FIG. 49.
Figure 53:
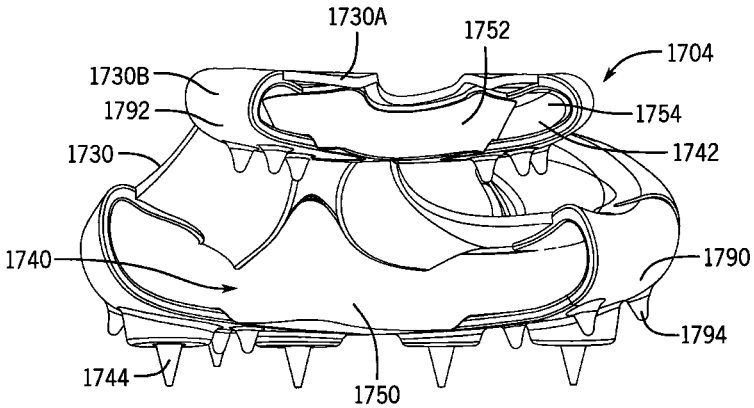
FIG. 53 is a rear view of the sole structure of FIG. 49.
Figure 54:
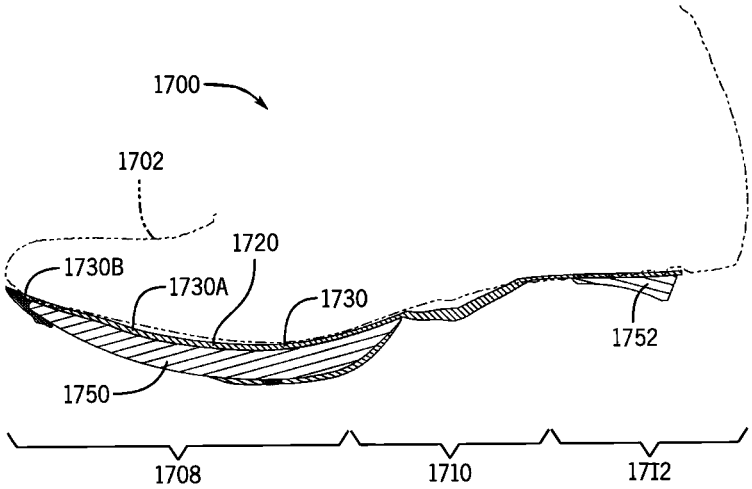
FIG. 54 is a cross-sectional view of the sole structure of FIG. 49 on an article of footwear taken along line 54-54 of FIG. 50.
Figure 55:
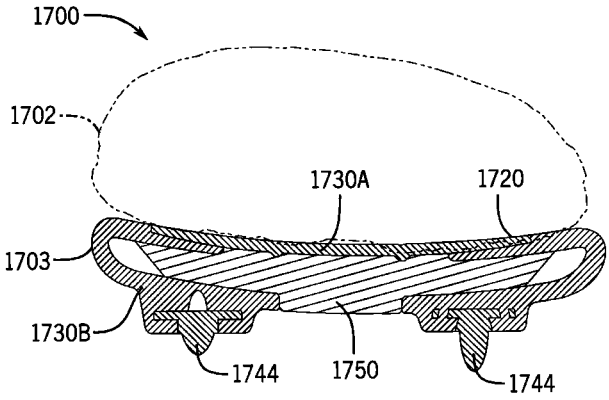
FIG. 55 is a cross-sectional view of the sole structure of FIG. 49 on an article of footwear taken along line 55-55 of FIG. 50.
Figure 56:
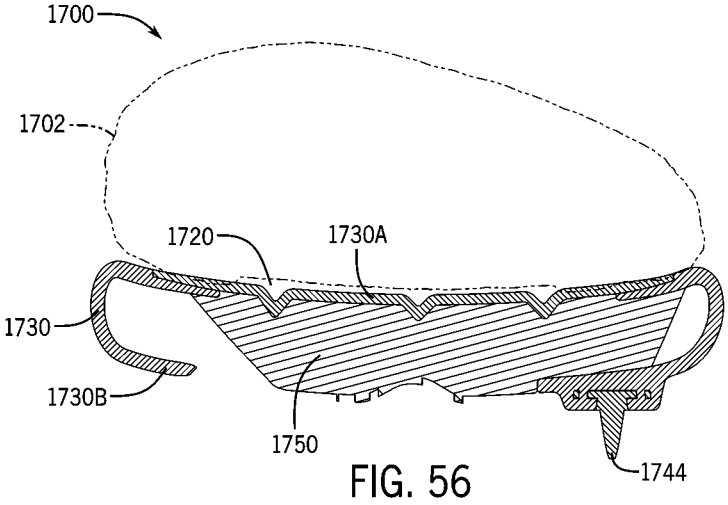
FIG. 56 is a cross-sectional view of the sole structure of FIG. 49 on an article of footwear taken along line 56-56 of FIG. 50.
Figure 57:
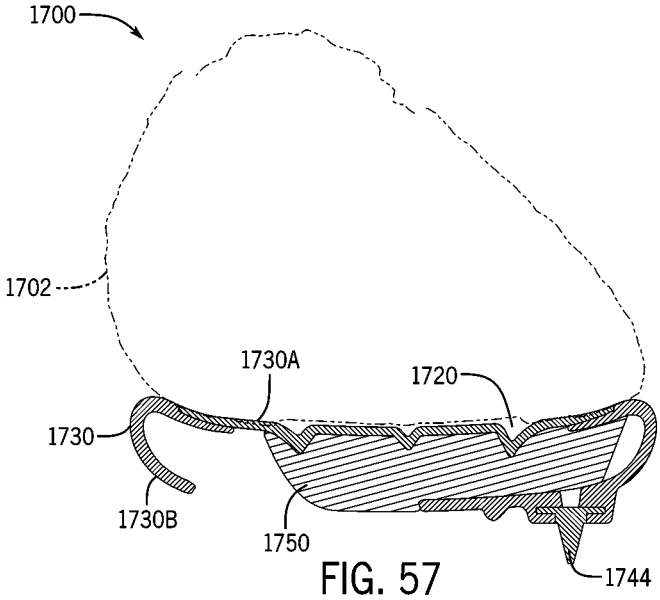
FIG. 57 is a cross-sectional view of the sole structure of FIG. 49 on an article of footwear taken along line 57-57 of FIG. 50.
Figure 58:
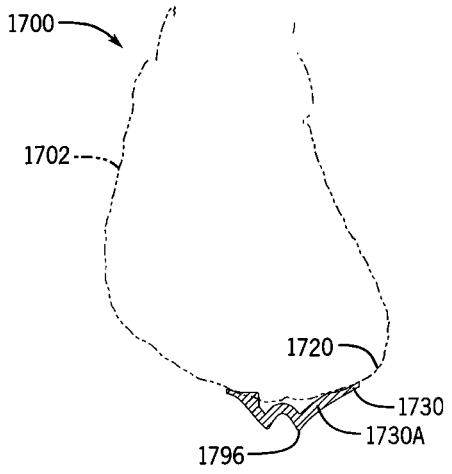
FIG. 58 is a cross-sectional view of the sole structure of FIG. 49 on an article of footwear taken along line 58-58 of FIG. 50.
Figure 59:
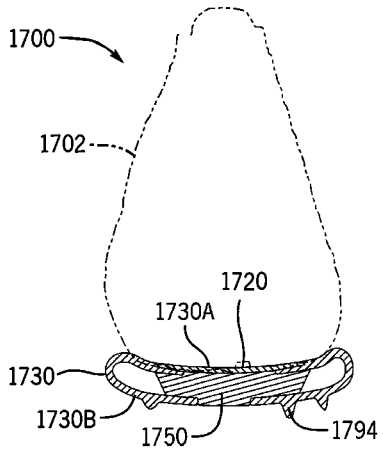
FIG. 59 is a cross-sectional view of the sole structure of FIG. 49 on an article of footwear taken along line 59-59 of FIG. 50.

Additionally, the structure of the outsole 1730, including the coupling of the upper and lower outsoles 1730A, 1730B, is different. For example, the front lower outsole segment 1790 of the lower outsole 1730B extends outward from the periphery of the front portion 1732 of the upper outsole segment 1730A and curves downward and then inward to extend at least partially beneath the upper outsole 1730A to form the front spacing 1740. In some embodiments, the front lower outsole segment 1790 can be formed as a set of fingers, or claws 1790A, that do not extend across the entire front spacing 1740 as shown in FIGS. 49-51. Further, the front spacing volume 1728 is defined by the upper outsole 1730A, the front lower outsole segment 1790, and an unseen boundary extending from and between the set of claws of the front lower outsole segment 1790. The front cushioning member 1750 is located at least substantially within the front spacing 1740, encased by the set of claws 1790A. In some embodiments, the front cushioning member 1750 can extend beyond the front spacing 1742 toward the rear portion 1736. In some embodiments, for example, the volume of the front cushioning member 1750 can be in a range of about 50 percent to about 75 percent of the front spacing volume 1728. In some embodiments, the front cushioning member 1750 can define a front spacing pocket 1756 between the curved portions of the front lower outsole segment 1790 and the periphery of the front cushioning member 1750. In some embodiments, the front cushioning member 1750 can extend downward between the set of fingers and in line with the front lower outsole segment 1790 (see FIGS. 52 and 55-57).

Looking at the rear lower outsole segment 1792, some differences from the lower outsole 1430B of the article of footwear 1400 are also present. The rear lower outsole segment 1792 of the lower outsole 1730B extends outward from the periphery of the rear portion 1736 of the upper outsole segment 1730A and curves downward and then inward to extend at least partially beneath the upper outsole 1730A to form the rear spacing 1742. In some embodiments, the rear lower outsole segment 1792 can be formed as a set of fingers, or claws 1792A, that do not extend across the entire rear spacing 1742 as shown in FIGS. 49-51. Further, the rear spacing volume 1774 is defined by the upper outsole 1730A, the rear lower outsole segment 1792, and an unseen boundary extending from and between the set of claws 1792A of the rear lower outsole segment 1792. The rear cushioning member 1752 is received within the rear spacing 1744. In some embodiments, the rear cushioning member 1752 can extend beyond the rear spacing 1744 toward the front portion 1732. In some embodiments, for example, the volume of the rear cushioning member 1752 can be in a range of about 50 percent to about 75 percent of the rear spacing volume 1774. In some embodiments, the rear cushioning member 1752 can define a rear spacing pocket 1754 between the curved portions of the rear lower outsole segment 1792 and the periphery of the rear cushioning member 1752. In some embodiments, the rear cushioning member 1752 can extend downward between the set of fingers and in line with the rear lower outsole segment 1792 (see FIGS. 53 and 59).

While running, the sets of claws 1790A, 1792A can partially collapse into the front cushioning member 1750 and the rear cushioning member 1752, respectively. The resiliency of the front and rear cushioning members 1750, 1752 and the sets of claws 1790A, 1792A, can provide additional energy return to a user. Each of the claws of the sets of claws 1790A, 1792A can be independently movable relative to the other claws.

Additionally, or alternatively, the sets of claws 1790A, 1792A can be coupled together via an additional plate (not shown) positioned between the front and rear cushioning members 1750, 1752 and the sets of claws 1790A, 1792A. The plate can be formed from a material such as TPU. While running, the sets of claws 1790A, 1792A can collapse into the plate and displace the force across the front and rear cushioning members 1750, 1752.

FIGS. 49-51 and 58 further illustrate the upper outsole 1730A including a set of ribs 1796 protruding downward from a bottom surface 1738 of the upper outsole 1730 and extending from the front portion 1732 to the rear portion 1736. The set of ribs 1796 add rigidity to the upper outsole 1730A and can further aid in supporting the arch of a user's foot.

Figure 62:
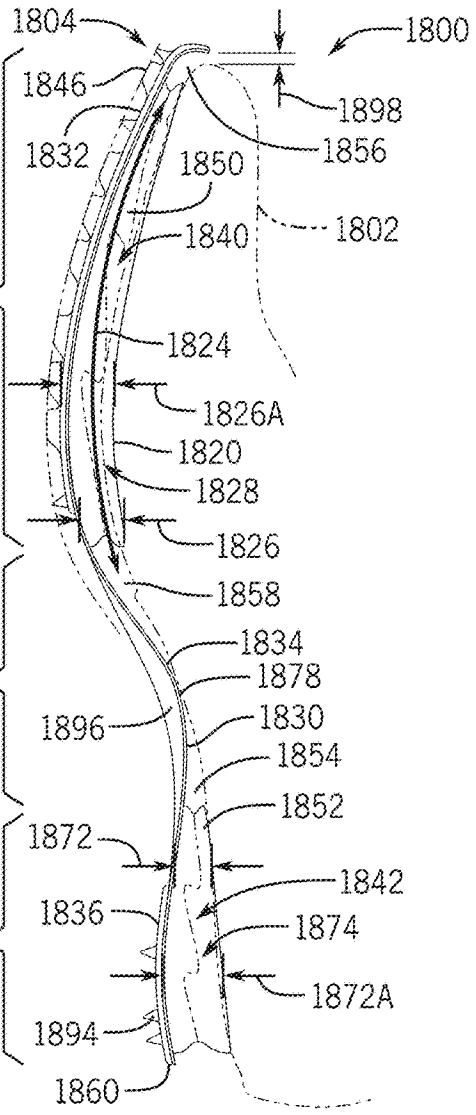
FIG. 62 is a lateral side view of the sole structure of FIG. 60 on an article of footwear.
Figure 61:
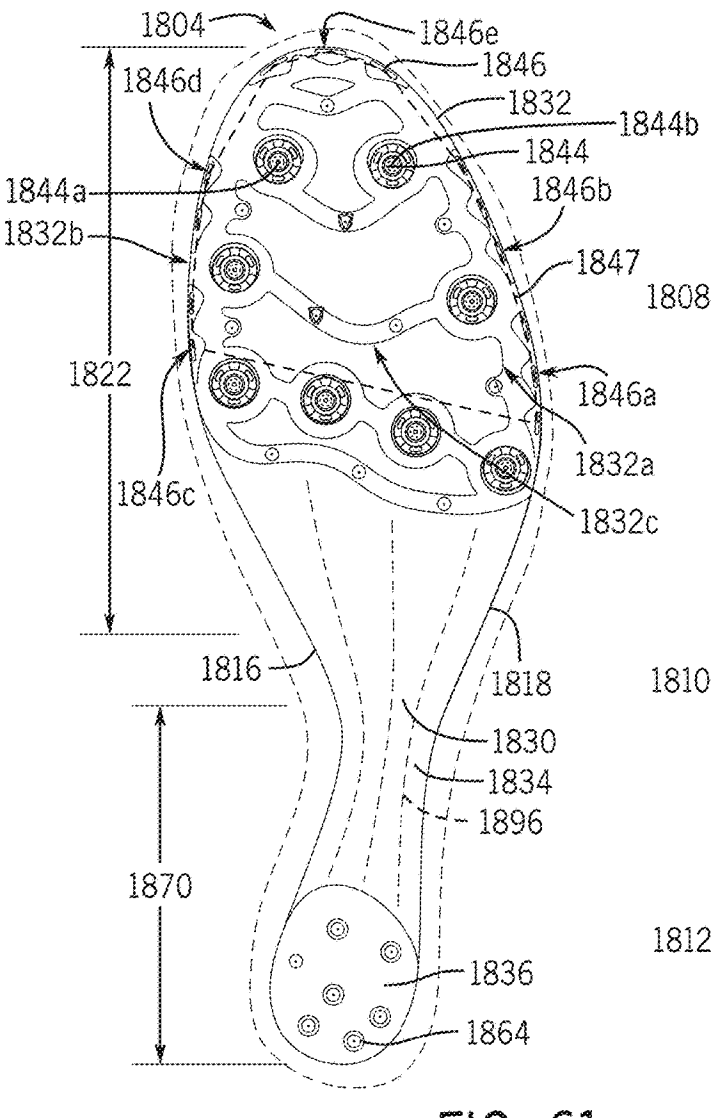
FIG. 61 is a bottom view of the sole structure of FIG. 60.
Figure 60:
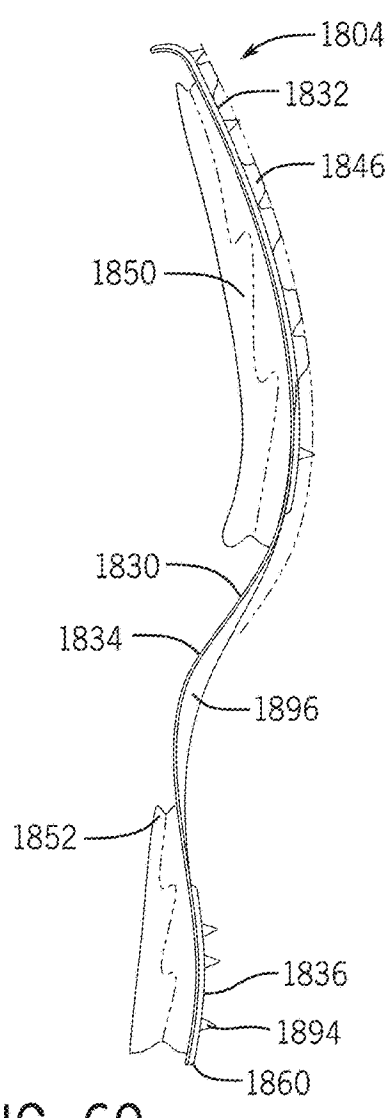
FIG. 60 is a medial side view of a sole structure for an article of footwear configured as a left shoe that includes an upper and a sole structure, according to another embodiment of the disclosure.
Figure 65:
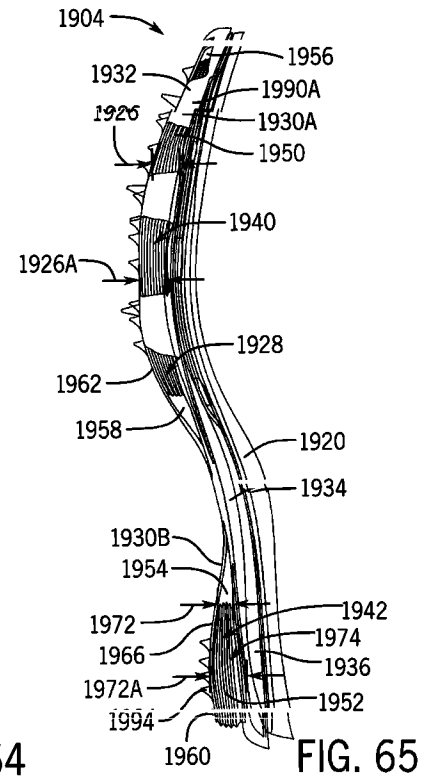
FIG. 65 is a lateral side view of the sole structure of FIG. 63.
Figure 64:
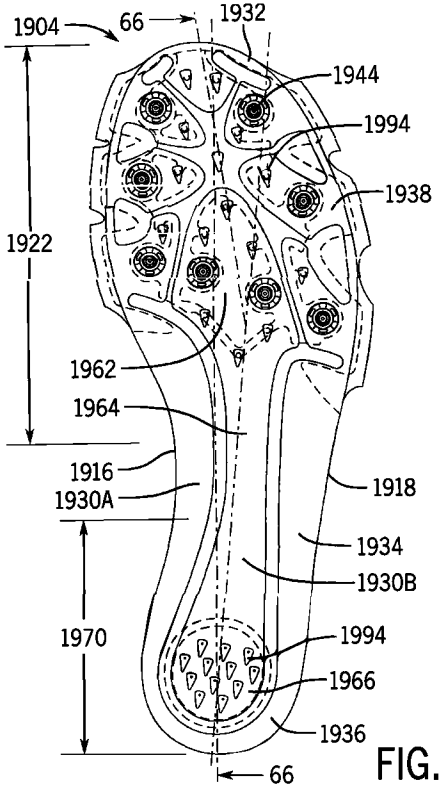
FIG. 64 is a bottom view of the sole structure of FIG. 63.
Figure 63:
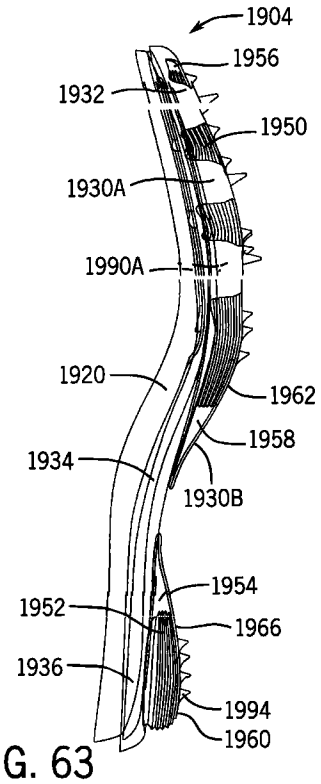
FIG. 63 is a medial side view of a sole structure for an article of footwear configured as a left shoe, according to another embodiment of the disclosure.
Figure 66:
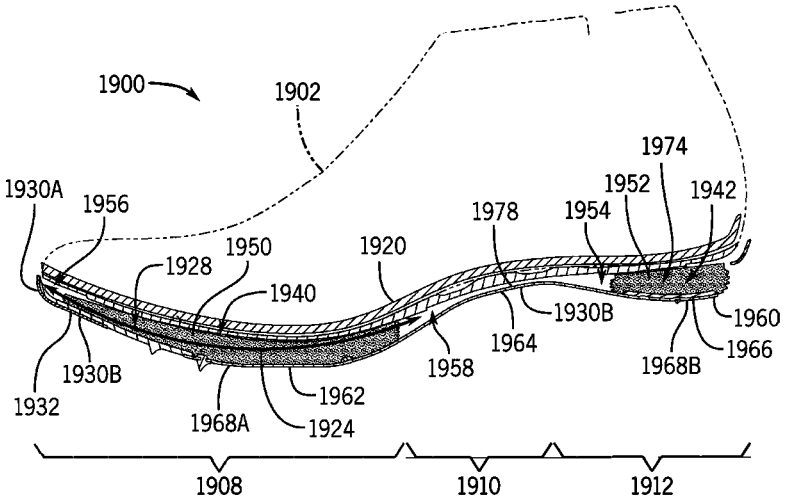
FIG. 66 is a cross-sectional view of the sole structure of FIG. 63 on an article of footwear taken along line 66-66 of FIG. 64.
Figure 67:
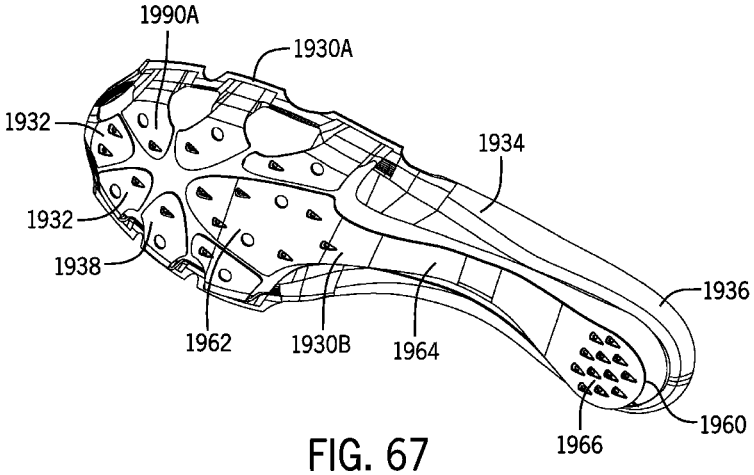
FIG. 67 is an isometric view of an outsole of the sole structure of FIG. 63 of an article of footwear.

FIGS. 60-62 illustrate another embodiment of an article of footwear 1800. In many aspects, the article of footwear 1800 is similar to the article of footwear 600 described above and similar numbering in the 1800 series is used for the article of footwear 1800. For example, the article of footwear 1800 can include an upper 1802 (see FIG. 62), a top portion 1820, and a sole structure 1804 with an outsole 1830 spaced from the top portion 1820. The space between the top portion 1820 and the outsole 1830 in the forefoot and heel regions 1808, 1812 defining a front spacing 1840 and a rear spacing 1842, respectively. The upper 1802 defines a forefoot region 1808, a midfoot region 1810, and a heel region 1812. Further, the article of footwear 1800 includes a medial side 1816 corresponding to an inside portion of the article of footwear 1800 and a lateral side 1818 corresponding to an outside portion of the article of footwear 1800. Further, the outsole 1830 may be a rigid plate and has a front portion 1832 (e.g., a first portion), a middle portion 1834 (e.g., a second portion), and a rear portion 1836 (e.g., a third portion) with a terminal end 1860. The front portion 1832 extends across the forefoot region 1808 of the sole structure 1804 from the medial side 1816 to the lateral side 1818 and each of the middle portion 1834 and the rear portion 1836 extend partially across the midfoot region 1810 and the heel region 1812 of the sole structure 1084, respectively. The outsole 1830 can be coupled to the top portion 1820 at a midfoot coupling point 1878. A front cushioning member 1850 is located in the front spacing 1840, which further defines a first longitudinal length 1822, a curved length 1824, a first gap height 1826 with a maximum first gap height 1826A, a front spacing volume 1828, a first front spacing pocket 1856, and a second front spacing pocket 1858. A rear cushioning member 1852 is located in the rear spacing 1842, which further defines a second longitudinal length 1870, a second gap height 1872 with a maximum second gap height 1872A, a rear spacing volume 1874, and a rear spacing pocket 1854.

Further, spikes 1844 and teeth 1846 extend downward from a bottom surface 1838 of the outsole 1830. As illustrated in FIG. 61, a first plurality of spikes 1844 is provided along a lateral portion 1832*a* of the outsole 1830 and a second plurality of spikes 1844 is provided along a medial portion 1832*b* of the outsole 1830. Each of the first and second pluralities of spikes 1844 are arranged in longitudinal rows extending substantially in heel-to-toe direction (e.g., to follow an outer profile of the outsole 1830). Correspondingly, the teeth 1846 are arranged around the periphery of the outsole 1830 in the front portion 1832 so that the teeth 1846 are closer to the edge of the outsole 1830 than are the spikes 1844 (e.g., with a first plurality extending along a lateral edge and a second plurality extending along a medial edge). The teeth 1846 arranged around the periphery define a first region 1847 of the outsole 1830. All of the teeth 1846 are disposed entirely within the first region 1847 of the outsole 1830. A first toe-most spike 1844*a* and a second toe-most spike 1844*b* are located entirely within the first region 1847 of the outsole 1830. In some embodiments, the teeth 1846 can be arranged in one or more groups around the periphery of the front portion 1832 (e.g., to extend along an edge of the outsole 1830). For example, the outsole 1830 includes five groups of the teeth 1846, namely, a rear lateral group 1846*a*, a front lateral group 1846*b*, a rear medial group 1846*c*, a front medial group 1846*d*, and a front end group 1846*e* (e.g., a toe end group), which are spaced around the periphery of the front portion 1832.

As described above, in some embodiments, the outsole 1830 can include any combination of ground engaging members (e.g., spikes, teeth, and barbs) that extend from the bottom surface 1838 of the outsole 1839 and which can be positioned throughout the front portion 1832 and the rear portion 1836.

In some aspects, however, the articles of footwear 1800, 600 differ from each other. For example, the front portion 1832 of the outsole 1830 extends beyond the top portion 1820 defining a toe gap 1898. Further, a set of small spikes 1894 can also extend from the bottom surface 1838 of the outsole 1830. As shown, the set of small spikes 1894 are provided in the front portion 1832 and the rear portion 1836, but other arrangements are contemplated, including having the set of small spikes 1894 in only one of either the front portion 1832 or the rear portion 1836. More specifically, a plurality of small spikes 1894 is provided on a middle portion 1832*c* of the outsole 1830 that extends between the lateral portion 1832*a* and the medial portion 1832*b*. Additionally, the outsole 1830 includes a set of ribs 1896 protruding downward from the bottom surface 1838 of the outsole 1830 and extending from the front portion 1832 to the rear portion 1836. The set of ribs 1896 add rigidity to the outsole 1830 and can further aid in supporting the arch of a user's foot.

FIGS. 63-67 illustrate another embodiment of an article of footwear 1900. In many aspects, the article of footwear 1900 is similar to the article of footwear 1700 described above and similar numbering in the 1900 series is used for the article of footwear 1900. For example, the article of footwear 1900 can include an upper 1902 (see FIG. 66), a top portion 1920, and a sole structure 1904 with an outsole (first outsole segment 1930A) spaced from the top portion 1920. The first outsole segment 1930A extends along the top portion 1932 and can be attached thereto. The upper 1902 defines a forefoot region 1908, a midfoot region 1910, and a heel region 1912 (see FIG. 66). Further, the article of footwear 1900 also includes a medial side 1916 corresponding to an inside portion of the article of footwear 1900. Additionally, the first outsole segment 1930A has a front portion 1932, a middle portion 1934, and a rear portion 1936.

Continuing, the front portion 1932 of the first outsole segment 1930A in the forefoot region 1908 extends downward and then inward. The front portion 1932 of the first outsole segment 1930A extends at least partially beneath the top portion 1920. In some embodiments, the front portion 1932 can be formed as a set of fingers, or claws 1990A, that do not extend across the entire front spacing 1940.

In some aspects, however, the articles of footwear 1900, 1700 differ from each other. For example, the article of footwear 1900 has a second outsole segment 1930B with a front portion 1962, a middle portion 1964, and a rear portion 1966 with a terminal end 1960. The front portion 1962 of the second outsole segment 1930B is positioned adjacent and within the set of claws 1990A and beneath the top portion 1940. The set of claws 1990A of the first outsole segment 1930A and the front portion 1962 of the second outsole segment 1930B define a front spacing 1940. The front spacing 1940 defines a first longitudinal length 1922, a curved length 1924, a first gap height 1926 with a maximum first gap height 1926A, a front spacing volume 1928, a first front spacing pocket 1956, and a second front spacing pocket 1958. A front cushioning member 1950 is located in the front spacing 1940. The rear portion 1966 extends beneath the top portion 1920 in the heel region 1912 and defines a rear spacing 1942 therebetween. The rear spacing 1942 defines a second longitudinal length 1970, a second gap height 1972 with a maximum second gap height 1972A, a rear spacing volume 1974, and a rear spacing pocket 1954. The front portion 1962 is coupled to the front cushioning member 1950, the middle portion 1964 can be coupled to the top portion 1920 at a midfoot coupling point 1978 (see FIG. 66), and the rear portion 1966 is coupled to a rear cushioning member 1952.

Continuing, both the first outsole segment 1930A and the second outsole segment 1930B may be rigid plates formed from one or more materials to impart durability, wear-resistance, abrasion resistance, or traction to the sole structure 1904. Further, as shown in the illustrated embodiment, a number of ground engaging members are provided on the first and second outsole segments 1930A, 1930B. Spikes 1944 and small spikes 1994 are provided extending from bottom surfaces 1938, 1968A in the front portions 1932, 1962 of the first and second outsole segments 1930A, 1930B, and small spikes 1994 are provided extending from a bottom surface 1968B in the rear portion 1966 of the second outsole segment 1930B. It should be understood that other arrangements of ground engaging members, as described in the discussion of any of the other embodiments above, are contemplated.

In other embodiments, other configurations are possible. For example, certain features and combinations of features that are presented with respect to particular embodiments in the discussion above can be utilized in other embodiments and in other combinations, as appropriate. Further, any of the embodiments described herein may be modified to include any of the structures or methodologies disclosed in connection with other embodiments. Additionally, the present disclosure is not limited to articles of footwear of the type specifically shown. Still further, aspects of the articles of footwear of any of the embodiments disclosed herein may be modified to work with any type of footwear, apparel, or other athletic equipment.

As noted previously, it will be appreciated by those skilled in the art that while the invention has been described above in connection with particular embodiments and examples, the invention is not necessarily so limited, and that numerous other embodiments, examples, uses, modifications and departures from the embodiments, examples and uses are intended to be encompassed by the claims attached hereto. The entire disclosure of each patent and publication cited herein is incorporated by reference, as if each such patent or publication were individually incorporated by reference herein. Various features and advantages of the invention are set forth in the following claims.

INDUSTRIAL APPLICABILITY

Numerous modifications to the present invention will be apparent to those skilled in the art in view of the foregoing description. Accordingly, this description is to be construed as illustrative only and is presented for the purpose of enabling those skilled in the art to make and use the invention. The exclusive rights to all modifications which come within the scope of the appended claims are reserved.

We claim:

1. An article of footwear having a sole structure and an upper, the sole structure defining a forefoot region, a midfoot region, and a heel region, and comprising:

a support board coupled to the upper;

an outsole contacting the support board in the midfoot region, defining a ground engaging surface in at least a forefoot region of the sole structure, the outsole including;

a plurality of first ground engaging elements each having a spike that extends away from the ground engaging surface, the plurality of first ground engaging elements including first and second toe-most first ground engaging elements;

a plurality of second ground engaging elements extending away from the ground engaging surface a first gap defined between the outsole and the support board in the forefoot region;

a first cushioning member extending between the outsole and the support board within the first gap, a second gap defined between the outsole and the support board in the heel region; and a second cushioning member extending between the outsole and the support board within the second gap, wherein the outsole is spaced from the support board along an entirety of the heel region, wherein the second cushioning member defines a variable thickness measured between the outsole and the support board, and wherein the variable thickness increases and then decreases in a toe to heel direction.

2. The article of footwear of claim 1, wherein the outsole is configured as a rigid plate that extends between a lateral side and a medial side of the sole structure in the forefoot region.

3. The article of footwear of claim 1, wherein the outsole includes a first portion in the forefoot region of the sole structure, a second portion in a midfoot region of the sole structure, and a third portion in a heel region of the sole structure.

4. The article of footwear of claim 3, wherein at least one of:

the first portion extends across the forefoot region from a lateral side of the sole structure to a medial side of the sole structure, the second portion extends partially across the sole structure from the lateral side to the medial side, or the third portion extend partially across the sole structure from the lateral side to the medial side.

5. The article of footwear of claim 3, wherein the third portion of the outsole further includes the plurality of second ground engaging elements extending away from the ground engaging surface in the heel region of the outsole.

6. The article of footwear of claim 1, wherein each of the second ground engaging elements of the plurality of second ground engaging elements is shaped differently from first ground engaging elements of the plurality of first ground engaging elements.

7. The article of footwear of claim 1, wherein a rear void is defined between the support board and the outsole heelward of the first cushioning member, and wherein the rear void is empty.

8. The article of footwear of claim 1, wherein a height between the outsole and support board is variable along an entirety of the heel region.

9. An article of footwear having a sole structure and an upper, the sole structure defining a forefoot region, a midfoot region, and a heel region, and comprising:

a support board coupled to the upper;

an outsole contacting the support board in the midfoot region, defining a ground engaging surface and including:

a lateral outsole portion that is disposed on a lateral side of the outsole and has a plurality of first ground engaging elements and a plurality of second ground engaging elements extending away from the ground engaging surface, and a medial outsole portion that is disposed on a medial side of the outsole and has some of the plurality of first ground engaging elements and some of the plurality of second ground engaging elements extending away from the ground engaging surface;

a first gap defined between the outsole and the support board in the forefoot region; a first cushioning member disposed between the outsole and the support board within the first gap, a second gap defined between the outsole and the support board in the heel region; and a second cushioning member extending between the outsole and the support board within the second gap, wherein the outsole is spaced from the support board along an entirety of the heel region, and wherein a height of the second cushioning member, measured between the outsole and support board, increases and then decreases in the heel region in a toe to heel direction.

10. The article of footwear of claim 9, wherein the support board is a strobel board.

11. The article of footwear of claim 10, wherein the support board extends through the forefoot region, the midfoot region, and the heel region of the sole structure.

12. The article of footwear of claim 9, wherein each of the plurality of first ground engaging elements and the plurality of second ground engaging elements are arranged in longitudinal rows extending generally in a heel-to-toe direction in a forefoot region.

13. The article of footwear of claim 9, wherein a front void is defined between the support board, the front cushioning member, and a toe portion of the outsole.

14. An article of footwear having a sole structure and an upper, the sole structure defining a forefoot region, a midfoot region, and a heel region, and comprising:

a support board coupled to the upper;

an outsole defining a ground engaging surface and including:

a plurality of first ground engaging elements each having a round base, the plurality of first ground engaging elements including a first group of first ground engaging elements positioned on a medial side of the outsole in a forefoot region and a second group of first ground engaging elements positioned on a lateral side of the outsole in the forefoot region, a plurality of second ground engaging elements spaced around a periphery of the outsole in the forefoot region, and a gap defined between the outsole and the support board in the heel region; and a cushioning member disposed between the outsole and the upper within the gap, the cushioning member defining a height measured between the outsole and the support board, wherein the height increases and then decreases in a toe to heel direction.

15. The article of footwear of claim 14, wherein the outsole extends through the midfoot region of the sole structure and into the heel region of the sole structure, and wherein the outsole includes a plurality of longitudinal ribs in the midfoot region.

16. The article of footwear of claim 14, wherein the plurality of second ground engaging elements includes at least two groups of second ground engaging elements.

17. The article of footwear of claim 14, wherein a heel void is defined between the outsole and the support board heelward of the cushioning member.

18. The article of footwear of claim 14, wherein a volume of the cushioning member is less than a volume of the gap.

* * * * *